US006962631B2

(12) United States Patent
Sugiura et al.

(10) Patent No.: US 6,962,631 B2
(45) Date of Patent: Nov. 8, 2005

(54) STEEL PLATE EXCELLENT IN SHAPE FREEZING PROPERTY AND METHOD FOR PRODUCTION THEREOF

(75) Inventors: Natsuko Sugiura, Futtsu (JP); Naoki Yoshinaga, Futtsu (JP); Manabu Takahashi, Futtsu (JP); Tohru Yoshida, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 336 days.

(21) Appl. No.: 10/380,844

(22) PCT Filed: Sep. 21, 2001

(86) PCT No.: PCT/JP01/08277

§ 371 (c)(1),
(2), (4) Date: Mar. 20, 2003

(65) Prior Publication Data

US 2003/0196735 A1 Oct. 23, 2003

(30) Foreign Application Priority Data

| | | |
|---|---|---|
| Sep. 21, 2000 | (JP) | 2000-286447 |
| Jun. 5, 2001 | (JP) | 2001-170079 |
| Jun. 5, 2001 | (JP) | 2001-170083 |
| Jun. 5, 2001 | (JP) | 2001-170106 |
| Jun. 8, 2001 | (JP) | 2001-174650 |
| Jun. 28, 2001 | (JP) | 2001-196317 |
| Jun. 28, 2001 | (JP) | 2001-196510 |

(51) Int. Cl.[7] ..... C22C 38/06; C22C 38/02; C22C 38/04; C21D 8/00

(52) U.S. Cl. ..... 148/320; 148/330; 148/331; 148/332; 148/333; 148/334; 148/335; 148/336; 148/602; 148/603; 148/648; 148/650; 148/651; 148/653; 148/654; 148/661

(58) Field of Search ..... 148/320, 330–336, 148/602, 603, 648, 650, 651, 654, 653, 661

(56) References Cited

FOREIGN PATENT DOCUMENTS

| | | |
|---|---|---|
| JP | 11-117039 A | 4/1999 |
| JP | 11-323489 A | 11/1999 |
| JP | 11-350064 A | 12/1999 |
| JP | 2000-109964 A | 4/2000 |

*Primary Examiner*—Deborah Yee
(74) *Attorney, Agent, or Firm*—Baker Botts LLP

(57) ABSTRACT

A ferritic steel sheet wherein a mean value of X-ray random intensity ratios of a group of {100}<011> to {223}<110> orientations is 3.0 or more and a mean value of X-ray random intensity ratios of three crystal orientations of {554}<225>, {111}<112>, and {111}<110> is 3.5 or less and further at least one of the r values in a rolling direction and a direction at a right angle of that is 0.7 or less.

40 Claims, 7 Drawing Sheets

STEEL PLATE EXCELLENT IN SHAPE FREEZING PROPERTY AND METHOD FOR PRODUCTION THEREOF

CROSS-REFERENCE TO RELATED APPLICATIONS

This application is a national stage application of PCT Application No. PCT/JP01/08277 which was filed on Sep. 21, 2001 and published on Mar. 28, 2002 as International Publication No. WO 02/24968 (the "International Application"). This application claims priority from the International Application pursuant to 35 U.S.C. § 365. The present application also claims priority under 35 U.S.C. § 119 from Japanese Patent Application No. 2000-286447, filed on Sep. 21, 2000, Japanese Patent Application Nos. 2001-170079, 2001-170106 and 2001-170083, all filed on Jun. 5, 2001, Japanese Patent Application No. 2001-174650, filed on Jun. 8, 2001, and Japanese Patent Application Nos. 2001-196317 and 2001-196510, both filed on Jun. 28, 2001, the entire disclosures of which are incorporated herein by reference.

TECHNICAL FIELD

The present invention relates to a steel sheet (including both hot-rolled steel sheet and cold-rolled steel sheet) excellent in shape fixability and other mechanical properties and mainly used for parts of automobiles and a method for producing the same.

BACKGROUND ART

In order to keep down the amount of emission of carbonic acid gases from an automobile, high strength steel sheet is being used to try to reduce the weight of the automobile body. Also, in order to ensure the safety of passengers as, high strength steel sheet is now being frequently used in addition to mild steel sheet for the automobile body. Further, in order to reduce the weight of the automobile body in the future, there is a fast growing new demand for raising the level of usage strength of high strength steel sheet more than the past.

However, when bending high strength steel sheet, due to the high strength, the bent shape tends to depart from the shape of the die and return to the shape before bending. The phenomenon of trying to return to the original shape even after bending is referred to as "springback". When this springback occurs, even if the steel sheet is bent, the intended shape cannot be obtained in the bent part after bending.

Also, a wall camber phenomenon arises wherein the flat surface of a side wall becomes a surface having curvature due to elastic recovery from bending and springback during shaping. The intended shape cannot be obtained in the bent part and poor dimensional accuracy occurs.

Accordingly, in the body of a conventional automobile, steel sheet of a high strength of 440 MPa or less has been mainly used.

Irrespective of the fact that the weight of automobile bodies must be reduced by using steel sheet of a high strength of 490 MPa or more for the automobile body, in actuality a high strength steel sheet having small springback and good shape fixability does not exist.

There is no need to add that it is extremely important to increase the shape fixability after shaping in steel sheet of a high strength of 440 MPa or less and mild steel sheet for improving the shape accuracy of products such automobiles and home electric appliances.

JP-A-10-72644 discloses an austenitic stainless cold-rolled steel sheet having a small springback (dimensional accuracy in the present invention) characterized in that the degree of integration of the {200} structure in planes parallel to a rolled surface is 1.5 or more. The publication, however, does not describe any art for reducing the springback phenomenon or the wall camber phenomenon of ferritic steel sheet.

Also, as art for reducing the springback of the ferritic stainless steel, JP-A-2001-32050 discloses an invention setting a reflected X-ray intensity ratio of {100} planes parallel to the sheet surface at 2 or more at the center of the sheet thickness. This publication, however, does not describe anything concerning the reduction of the wall camber and does not describe anything regarding the group of {100}<011> to {223}<110> orientations and the {112}<110> orientation important for the reduction of the wall camber.

Also, some of the present inventors disclosed a thin ferritic steel sheet having a ratio of the {100} planes and {111} planes of at least 1 for the purpose of improvement of the shape fixability in the WO00/06791 pamphlet, but this pamphlet does not describe anything regarding the values of X-ray random intensity ratios of the group of {110}<011> to {223}<110> orientations and {554}<225>, {111}<112>, and {111}<110> as in the present invention.

Also, some of the present inventors disclosed a cold-rolled steel sheet having a reflected X-ray intensity ratio of the {100} planes parallel to the sheet surface of 3 or more and a small springback in JP-A-2001-64750. However, this cold-rolled steel sheet is characterized by defining the reflected X-ray intensity ratio of the {100} plane at the outermost surface of the sheet thickness. The measurement position of the X-rays is different from the mean X-ray intensity ratio of the group of {100}<011> to {223}<110> orientations at "½ t of sheet thickness" defined in the present invention.

Also, the publication does not describe anything at all regarding the {554}<225>, {111}<112>, and {111}<110> orientations.

Also, JP-A-2000-297349 discloses a hot-rolled steel sheet having an absolute value of an in-plane anisotropy $\Delta r$ of the r value of 0.2 or less as a steel sheet having good shape fixability. However, this hot-rolled steel sheet is characterized in that the shape fixability is improved by lowering the yield ratio. The publication does not describe the control of the texture aimed at improvement of the shape fixability based on the concept explained in the present invention.

On the other hand, stretch flangeability is also an indispensable characteristic when working steel sheet into automobile parts or the like. If the shape fixability of a high stretch flanging steel sheet is improved, the range of application of the high strength steel sheet to an automobile body becomes further wider.

None of the above publications, however, describes anything from the viewpoint of achieving both stretch flangeability and shape fixability.

Also, on the other hand, high strength steel sheet is also required to have a good press formability enabling press forming to automobile parts having complex shapes. As the method of improving the press formability of high strength steel sheet, for example, JP-A-6-145892 proposes a method of leaving at least a certain amount of austenite in the steel and utilizing working-induced transformation from this remaining austenite to martensite. In such a good workability high strength steel sheet, however, the method of improving the shape fixability has not been clarified.

Further, for the method of increasing the absorption of impact energy at the time of collision of an automobile while maintaining a good workability, for example JP-A-11-080879 proposes a method of similarly utilizing residual austenite. In a high strength steel sheet having good workability and absorption of impact energy, however, the method of improving the shape. All cited references are hereby incorporated herein by reference in their entireties.

SUMMARY OF THE INVENTION

DISCLOSURE OF THE INVENTION

When a mild steel sheet or high strength steel sheet is bending, a large springback occurs due to the strength of the steel sheet, and the shape fixability of the worked and shaped part is poor.

The present invention fundamentally solves this problem and provides steel sheet (hot-rolled steel sheet and cold-rolled steel sheet) excellent in shape fixability and other mechanical properties (stretch flangeability, absorption of impact energy, etc.) and a method for producing the same.

Conventional knowledge had considered that, as a means for suppressing springback, lowering the yield point or deformation stress of the steel sheet was somewhat important. In order to lower the yield point or the deformation stress, steel sheet having a low tensile strength had to be used.

However, this means alone is not a fundamental solution for improving the bendability of steel sheet and keeping springback low.

Therefore, in order to improve the bendability and fundamentally solve the problem of the occurrence of springback, the present inventors newly took note of the influence of the texture of steel sheet upon the bendability and examined and studied the action and effect thereof in detail. They then discovered a steel sheet excellent in bendability.

Namely, as a result of the examination and study, the present inventors clarified that the bendability was remarkably improved by controlling the intensity in the group of {100} <011> to {223}<110> orientations and {554}<225>, {111}<112>, and {111}<110> orientations and further the intensity in the {112}<110> or {100}<011> orientations and further by lowering at least one of the r value in the rolling direction and the r value in a direction at a right angle to the rolling direction as much as possible.

Also, the present inventors clarified that it was extremely important to optimize the composition of ingredients and hot rolling conditions in order to form a texture advantageous for shape fixability.

Also, the present inventors newly found that it was important to make the ferrite phase or bainite phase the maximum phase and to reduce coarse cementite at the grain boundaries obstructing the stretch flangeability as much as possible in order to achieve both high stretch flangeability and shape fixability.

Also, it is expected that the press formability will degrade when at least one of the r value in the rolling direction and the r value in a direction at the right angle to the rolling direction is set at a low value, so it can be considered difficult to achieve both shape fixability and workability. Therefore, as a result of a further intensive study, the present inventors clarified that the shape fixability, workability, and absorption of impact energy can be simultaneously raised by control of the texture and leaving austenite in the microstructure and further by controlling the properties of the residual austenite.

The present invention was made based on the above discoveries and has as its gist the following:

(1) A thin ferritic steel sheet excellent in shape fixability characterized in that a mean value of X-ray random intensity ratios of a group of {100} <011> to {223} <110> orientations at least at ½ of the sheet thickness, is 3.0 or more, and a mean value of X-ray random intensity ratios of three orientations of {554} <225>, {111} <112>, and {111} <110> is 3.5 or less.

(2) A thin ferritic steel sheet excellent in shape fixability according to (1), wherein at least one of an r value in a rolling direction and the r value in a direction at a right angle to the rolling direction is 0.7 or less.

(3) A thin ferritic steel sheet excellent in shape fixability according to (1) or (2), wherein a mean value of X-ray random intensity ratio of {112} <110> is 4.0 or more.

(4) A thin ferritic steel sheet excellent in shape fixability according to (1) or (2), wherein a mean value of X-ray random intensity ratio of {100} <011> is 4.0 or more.

(5) A thin ferritic steel sheet excellent in shape fixability according to any one of (1) to (4), wherein an occupancy of iron carbide at the grain boundaries is 0.1 or less, and a maximum grain size of this iron carbide is 1 $\mu$m or less.

(6) A thin ferritic steel sheet excellent in shape fixability according to any one of (1) to (5), wherein the microstructure is a malti phase structure wherein ferrite or bainite is the maximum phase in terms of percent area and the sum of the percent area of pearlite, martensite, and residual austenite is 30% or less.

(7) A thin ferritic steel sheet excellent in shape fixability according to any one of (1) to (6), wherein the steel sheet comprises; in terms of weight %, C: 0.001 to 0.3%, Si: 0.001 to 3.5%, Mn: less than 3%, P: 0.005 to 0.15%, S: less than 0.03%, Al: 0.01 to 3.0%, N: less than 0.01%, O: less than 0.01%, and remainder Fe and unavoidable impurities.

(8) A thin ferritic steel sheet excellent in shape fixability according to any one of (1) to (7), wherein the steel sheet further contains at least one element selected from the group consisting of, in terms of weight %, Ti: less than 0.20%, Nb: less than 0.20%, V: less than 0.20%, Cr: less than 1.5%, B: less than 0.007%, Mo: less than 1%, Cu: less than 3%, Ni: less than 3%, Sn: less than 0.3%, Co: less than 3%, Ca: 0.0005 to 0.005%, and REM: 0.001 to 0.02%.

(9) A thin ferritic steel sheet excellent in shape fixability according to (7) or (8), wherein the steel sheet satisfies the following Equations (1) and (2).

$$203\sqrt{C}+15.2Ni+44.7Si+104V+31.5Mo+30Mn+11Cr+20Cu+700P+200Al<30 \quad (1)$$

$$44.7Si+700P+200Al>40 \quad (2)$$

(10) A thin ferritic steel sheet excellent in shape fixability according to any one of (1) to (7), wherein the steel sheet is plated.

(11) A method for producing a thin ferritic steel sheet excellent in shape fixability comprising the steps of;

hot rolling, with reheating to a temperature range of 1000° C. to 1300° C., or without reheating, a cast slab containing, in terms of weight %, C: 0.001 to 0.3%, Si: 0.001 to 3.5%, Mn: less than 3%, P: 0.005 to 0.15%, S: less than 0.03%, Al: 0.01 to 3.0%, N: less than 0.01%, C: less than 0.01%, and the remainder Fe and unavoidable impurities, with a total reduction rate of 25% or more at ($Ar_3$−100) to ($Ar_3$+100)° C., terminating the hot rolling at ($Ar_3$−100)° C. or more, cooling the hot rolled steel sheet, then coiling the cooled steel sheet, so that the steel sheet having a mean value of X-ray random intensity ratios of a group of {100} <011>to {223} <110> orientations at least at ½ of the sheet thickness, is 3.0 or more and a mean value of X-ray random intensity ratios of three orientations of {554} <225>, {111} <112>, and {111} <110> is 3.5 or less.

(12) A method for producing a thin ferritic steel sheet excellent in shape fixability comprising the steps of;

hot rolling, with reheating to a temperature range of 1000° C. to 1300° C., or without reheating, a cast slab containing, in terms of weight %, C: 0.001 to 0.3%, Si: 0.001 to 3.5%, Mn: less than 3%, P: 0.005 to 0.15%, S: less than 0.03%, Al: 0.01 to 3.0%, N: less than 0.01%, O: less than 0.01%, and remainder Fe and unavoidable impurities, with a total reduction rate of 25% or more at ($Ar_3$+50) to ($Ar_3$+150)° C., and continuing the hot rolling with a total reduction rate of 5 to 35% at ($Ar_3$−100) to ($Ar_3$+50)° C., terminating the hot rolling at ($Ar_3$−100) to ($Ar_3$+50)° C., cooling the hot rolled steel sheet, then coiling the cooled steel sheet, so that the steel sheet having a mean value of X-ray random intensity ratios of a group of {100} <011> to {223} <110> orientations of at least at ½ of the sheet thickness, is 3.0 or more and a mean value of X-ray random intensity ratios of three orientations of {554} <225>, {111} <112>, and {111} <110> is 3.5 or less.

(13) A method for producing a thin ferritic steel sheet excellent in shape fixability comprising the steps of;

roughing hot rolling, with reheating to a temperature range of 1000° C. to 1300° C., or without reheating, a cast slab containing, in terms of weight %, C: 0.001 to 0.3%, Si: 0.001 to 3.5%, Mn: less than 3%, P: 0.005 to 0.15%, S: less than 0.03%, Al: 0.01 to 3.0%, N: less than 0.01%, O: less than 0.01%, and remainder Fe and unavoidable impurities, exceeding a transformation temperature of $Ar_3$, finish hot rolling at a temperature below an $Ar_3$ transformation temperature, terminating the hot rolling at a temperature below an $Ar_3$ transformation temperature, cooling the hot rolled steel sheet, then coiling the cooled steel sheet, so that the steel sheet having a mean value of X-ray random intensity ratios of a group of {100} <011> to {223} <110> orientations of at least at ½ of the sheet thickness is 3.0 or more and a mean value of X-ray random intensity ratios of three orientations of {554} <225>, {111} <112>, and {111} <110> is 3.5 or less.

(14) A method for producing a thin ferritic steel sheet excellent in shape fixability according to any one of (11) to (13), wherein a mean value of X-ray random intensity ratio of {112} <110> is 4.0 or more.

(15) A method for producing a thin ferritic steel sheet excellent in shape fixability according to any one of (11) to (13), wherein a mean value of X-ray random intensity ratio of {100} <011> is 4.0 or more.

(16) A method for producing a thin ferritic steel sheet excellent in shape fixability according to any one of (11) to (15), wherein the slab further contains at least one element selected from the group consisting of, in terms of weight %, Ti: less than 0.20%, Nb: less than 0.20%, V: less than 0.20%, Cr: less than 1.5%, B: less than 0.007%, Mo: less than 1%, Cu: less than 3%, Ni: less than 3%, Sn: less than 0.3%, Co: less than 3%, Ca: 0.0005 to 0.005%, and REM: 0.001 to 0.02%.

(17) A method for producing a thin ferritic steel sheet excellent in shape fixability according to any one of (11) to (16), wherein the steel sheet is coiled at a critical temperature To determined by the chemical composition of the steel shown in the following Equations:

$$To=-650.4\times\{C\ \%/(1.82\times C\ \%-0.001\}+B$$

where B is found from the ingredients of the steel expressed by mass %

$$B=-50.6\times Mneq+894.3$$

$$Mneq=Mn\ \%+0.24\times Ni\ \%+0.13\times Si\ \%+0.38\times Mo\ \%+0.55\times Cr\ \%+0.16\times Cu\ \%-0.50\times Al\ \%+-0.45\times Co\ \%+0.90\times V\ \%$$

(18) A method for producing a thin ferritic steel sheet excellent in shape fixability according to any one of (11) to (17), wherein hot rolling is controlled so that the effective strain $\epsilon^*$ calculated by the following Equation is 0.4 or more:

$$\varepsilon^* = \sum_{j=1}^{n-1} \varepsilon_j \exp\left[-\sum_{i=j}^{n-1}\left(\frac{t_i}{\tau_i}\right)^{2/3}\right] + \varepsilon_n$$

wherein, n is a number of rolling stands of finish hot rolling, $\epsilon i$ is strain added at an i-th stand, ti is a traveling time (seconds) between the i-th to i+1-th stands, and $\tau i$ can be calculated by the following equation using a gas constant R(=1.987) and a hot rolling temperature Ti(K) of the i-th stand:

$$\tau i=8{,}46\times10^{-9}\cdot\exp\{43800/R/Ti\}$$

(19) A method for producing a thin ferritic steel sheet excellent in shape fixability according to any one of (11) to (18), wherein hot rolling is carried out with a friction coefficient of less than 0.2 for at least one pass in the hot rolling.

(20) A method for producing a thin ferritic steel sheet excellent in shape fixability according to any one of (11) to (18), wherein cooling is controlled to an average cooling rate of more than 10° C./sec from hot rolling terminating temperature to a critical temperature To determined by the chemical composition of the steel, and coiling is carried out at a temperature less than To.

(21) A method for producing a thin ferritic steel sheet excellent in shape fixability according to any one of (11) to (20), wherein the hot rolled steel sheet is pickled by acid, then cold rolled at with a reduction rate of less than 80%, then the cold rolled steel sheet is reheated between 600° C. and $(Ac_3+100)$° C., then cooled.

(22) A method for producing a thin ferritic steel sheet excellent in shape fixability according to any one of claims (11) to (21), wherein the hot rolled steel sheet is pickled by acid, then cold rolled at with a reduction rate of less than 80%, then annealed at a temperature between $Ac_1$ and $Ac_3$ transformation temperature, then cooled to a temperature below 500° C. at a cooling rate of 1 to 250° C./sec.

BEST MODE FOR CARRYING OUT THE INVENTION

Figure 1:
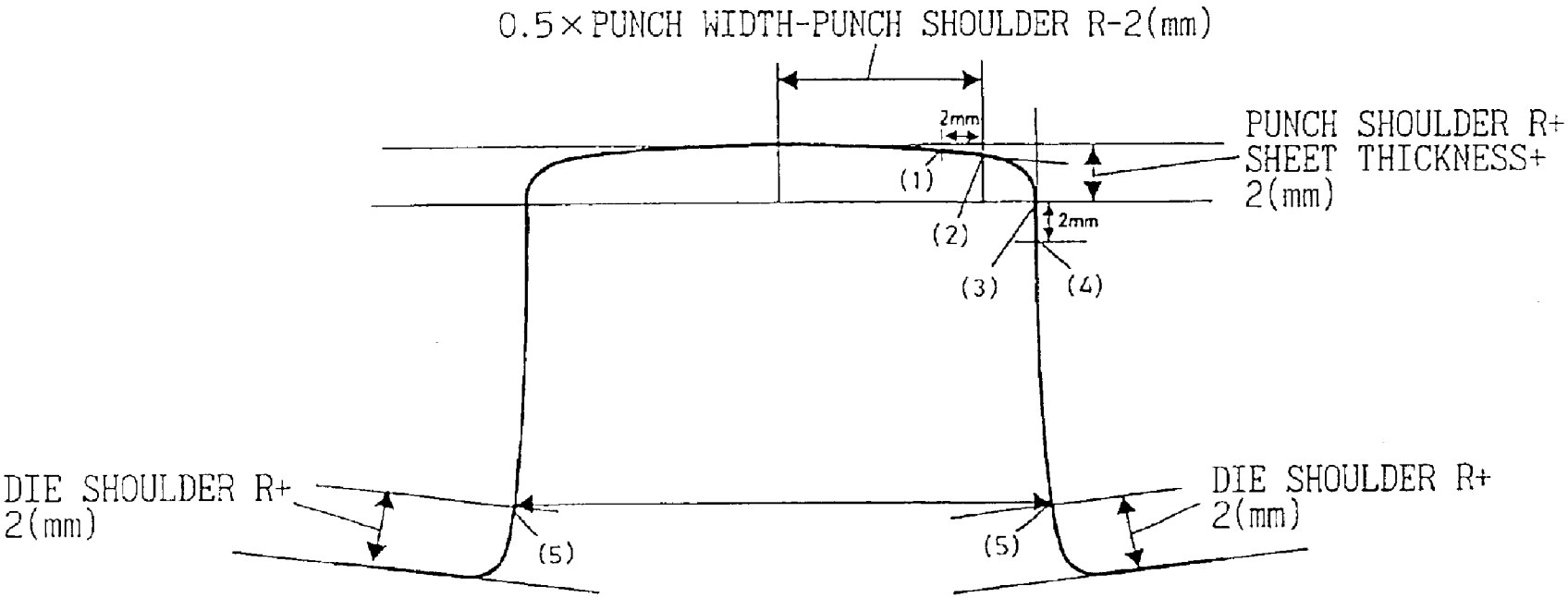
FIG. 1 is a view showing a cross-section of a test piece used for a hat bending test.

The content of the present invention will be explained in detail below.

Mean value of X-ray random intensity ratios of group of {100}<011> to {223}<110> orientations at ½ sheet thickness, mean value of X-ray random intensity ratios of three crystal orientations of {554}<225>, {111}<112>, and {111}<110>, and X-ray random intensity ratio in {112}<110> or {100}<011> orientation:

These values are characteristic values particularly important in the present invention. The mean value of the X-ray random intensity ratios in the group of {100}<011> to {223}<110> orientations when performing X-ray diffraction of the sheet face at the center position of the sheet thickness and finding the intensity ratio of the orientations with respect to random specimens must be 3.0 or more. The shape fixability becomes poor when this mean value is less than 3.0.

The main orientations included in this group of orientations are {100}<011>, {116}<110>, {114}<110>, {113}<110>, {112}<110>, {335}<110>, and {223}<110>. The X-ray random intensity ratios of these orientations may be found from the three-dimensional texture calculated by the vector method based on a {110} pole figure and a three-dimensional texture calculated by the series expansion method using a plurality of pole figures (preferably three or more) among the {110}, {100}, {211}, and {310} pole figures.

For example, as the X-ray random intensity ratios of the crystal orientations in the latter method, use may be made of the intensity ratios of (001)[1-10], (116)[1-10], (114)[1-10], (113)[1-10], (112)[1-10], (335)[1-10] and (223)[1-10] at the $\phi 2=45°$ cross section of the three-dimensional texture as they are.

The mean value of the X-ray random intensity ratios of the group of {100}<011> to {223}<110> orientations is an arithmetic mean of the X-ray random intensity ratios in the above orientations. Where the intensity ratios for all of above orientations cannot be obtained, this may be replaced by the arithmetic mean of the intensity ratios of the orientations of {100}<011>, {116}<110>, {114}<110>, {112}<110>, and {223}<110>.

The present inventors newly found that the orientations of {100}<011> and {112}<110> among the group of orientations are particularly extremely effective orientations for achieving a reduction of the wall camber. It was clarified from the results of the X-ray diffraction performed by the present inventors that the X-ray random intensity ratio of the {100}<011> orientation or the X-ray random intensity ratio of the {112}<110> orientation had to be made the maximum and 4.0 or more in the group of {100}<011> to {223}<110> orientations. When these intensity ratios are less than 4.0, the reduction of springback and wall camber cannot be sufficiently obtained, so it becomes difficult to secure an extremely good shape fixability.

For the {112}(110) orientation and {100}<011> orientation mentioned here, as the range of orientation having similar effects, ±12° is allowed with the direction at the right angle of the rolling direction (transverse direction) as the rotation axis. Further desirably, it is ±6°.

Further, the mean value of the X-ray random intensity ratios of the three crystal orientations of {554}<225>, {111}<112>, and {111}<110> of a sheet face at least at ½ sheet thickness must be 3.5 or less. When this value is over 3.5, even if the intensity ratios of the group of {100}<011> to {223}<110> orientations are proper, it becomes difficult to obtain a good shape fixability. Also the X-ray random intensity ratios of {554}<225>, {111}<112>, and {111}<110> may be found from the three-dimensional texture calculated according to the above methods. Desirably, the mean value of the X-ray random intensity ratios of the group of {100}<011> to {223}<110> orientations is 4.0 or more, and the arithmetic mean value of the X-ray random intensity ratios of {554}<225>, {111}<112>, and {111}<110> is less than 2.5.

More desirably, the mean value of the X-ray random intensity ratios of the group of {100}<011> to {223}<110> orientations is 4.0 or more, the X-ray random intensity ratio of {100}<011> or {112}<110> orientation is 5.0 or more, and the arithmetic mean value of the X-ray random intensity ratios of {554}<225>, {111}<112>, and {111}<110> is less than 2.5.

The reason why the X-ray intensity ratios of the crystal orientations mentioned above are important with respect to the shape fixability at the time of bending is not clear, but is believed to be related to the slip behavior of the crystal at the time of bending deformation.

The specimen supplied for the X-ray diffraction is prepared so that the ½ sheet thickness face becomes the measurement face by reducing the steel sheet to the predetermined thickness by mechanical polishing or the like and then removing strain by chemical polishing, electrolytic polishing, or the like. When there is a segregation band or defects etc. in the center layer of sheet thickness of the steel sheet and inconvenience occurs in the measurement, the specimen may be prepared according to the above method so that an appropriate face becomes the measurement face within a range of ⅜ to ⅝ of the sheet thickness.

Of course, the shape fixability becomes even better by satisfaction of the limitation concerning the X-ray intensity ratio not only in the vicinity of the ½ sheet thickness, but also at as many thicknesses as possible. Note that the crystal orientation expressed by {hkl}<uvw> indicates that a normal direction of the sheet face is parallel to <hkl>, and the rolling direction is parallel to <uvw>.

r value (rL) of rolling direction and r value (rC) in direction at right angle of rolling direction:

These r values are important characteristic values in the present invention. Namely, as a result of the intensive investigations by the present inventors, it was clarified that good shape fixability was not always obtained even if the X-ray intensity ratios of the crystal orientations mentioned above were proper. At least one of rL and rC must be 0.7 or less simultaneously with the X-ray intensity ratios being proper. More preferably, it is 0.55 or less.

It is not particularly necessary to determine the lower limits of rL and rC. Even if these lower limits are not determined, the effects of the present invention can be obtained. The r value is evaluated by a tensile test using a JIS No. 5 tensile test piece. The tensile strain is usually 15%, but where the uniform elongation is less than 15%, the evaluation may be made with a strain as near 15% as possible within the range of the uniform elongation.

Note that the direction for applying the bending differs according to the worked part, so it is not particularly necessary to limit it, but preferably bending work is mainly carried out in a direction vertical to the direction where the r value is small or a direction close to the vertical direction.

In general, it is known that there is a correlation between the texture and the r value, but in the present invention, the limitation related to the X-ray intensity ratio of the above crystal orientation and the limitation related to the r value are not synonymous with each other. In the present invention, a required shape fixability can be secured by limiting only the X-ray intensity ratio, but if the both limitations are simultaneously satisfied, a good shape fixability can be obtained.

Microstructure (1):

From viewpoints of the stretch frangeability and the shape fixability, the structure is made a structure having the ferrite or bainite phase as the maximum phase. Note that when comparing texture of the ferrite and bainite, in the bainite portion, the texture of {100}<011> to {223}<110> orientations advantageous to the shape fixability are apt to develop. The reason for this is not clear, but it can be considered that the bainite easily inherits the austenite texture dominant in the shape fixability formed during the hot rolling.

Accordingly, more desirably the occupancy of the bainite is larger. From this viewpoint, the percent area of the bainite is desirably over 35%.

The percent area of the ferrite or bainite is found from the mean value by observing at least five fields of view of the center portion of the sheet thickness by an optical microscope at 100 to 500 magnifications. Also, the deformed ferrite as worked remarkably degrades the formability, so is not included in the percent area mentioned here.

As the other phase, if the percent areas of the martensite, residual austenite, and pearlite become over 5%, the stretch flangeability is degraded. Accordingly, the sum of the percent areas of these structures is controlled to 5% or less.

Also, when the occupancy of the iron carbide at the grain boundaries becomes over 0.1 or the maximum grain size of the iron carbide becomes over 1 μm, the iron carbide becomes connected at the grain boundaries, and the stretch flangeability is remarkably degraded. Accordingly, it is necessary to reduce the occupancy of the iron carbide at the grain boundaries to 0.1 or less and control the maximum grain size of the iron carbide to 1 μm or less.

The occupancy and maximum grain size of the iron carbide are desirably as small as possible, so lower limits are not particularly defined. The occupancy (–) of the grain boundaries by the iron carbide is given by a ratio d/L of a total length L of grain boundaries in a certain region and a sum d of the lengths of the grain boundaries occupied by the iron carbide in a sectional sample. It is also possible to directly find these L and d by image processing an optical microscope photo with a magnification of 200 times or more.

As a more convenient method, it is also possible to find them by M/N by using a number N of intersecting points of n number of straight lines drawn on the photo and the grain boundaries and a number M of the intersecting points where iron carbide exists at the location of the intersecting points among the N number of intersecting points. By setting the number N of the straight lines employed at this time to 3 or more, a sufficient measurement accuracy can be secured. Also, the magnification of the photo is selected so that the number of intersecting points of one straight line and the grain boundaries becomes 10 or more. By selecting the magnification of the photo in this way, a sufficient measurement accuracy can be secured.

Microstructure (2):

In actual automobile parts, not only does the shape fixability due to the bending in one part become an issue, but also a good press formability such as stretch formability and deep drawability is required at other positions of the same part in many cases.

Accordingly, it is necessary to improve the shape fixability at the time of bending controlling the texture and, at the same time, improve the press formability of the steel sheet per se.

The present inventors found that lowering the yield ratio by containing the martensite in the steel sheet was most desirable in order to raise the stretch formability while satisfying the characteristic feature of the present invention of at least one of rL and rC being 0.7 or less.

At this time, when the martensite volume fraction exceeds 25%, not only is the strength of the steel sheet improved more than the required level, but also the ratio of the martensite connected in a network state increases and remarkably degrades the workability of the steel sheet, so 25% was set as the maximum value of the martensite volume fraction.

Also, in order to obtain the effect of lowering of the yield ratio by the martensite, desirably 3% or more martensite exists when the maximum phase in volume fraction is ferrite and 5% or more martensite exists when the maximum phase in volume fraction is bainite.

Also, when the maximum phase in volume fraction is other than the ferrite or bainite, the strength of the steel material is improved more than the required level and degrades its workability or unnecessary carbide is precipitated, a required amount of martensite cannot be secured, and the workability of the steel sheet is remarkably degraded. Therefore the maximum phase in volume fraction is limited to ferrite or bainite.

Also, even if the residual austenite which has not completed transformation when cooled to room temperature is contained, it does not exert a large influence upon the effects of the present invention. Note that if the volume fraction of the residual austenite found by the reflected X-ray process increases, the yield ratio rises, therefore desirably the residual austenite volume fraction is 2 times or less of the martensite volume fraction. It is further preferred if the volume fraction is the martensite volume fraction or less.

Other than the above, the microstructure of the present invention can include one or two or more of pearlite or cementite in an amount of 15% or less in volume fraction. Also, except the residual austenite, the volume fraction of the microstructure of the present invention is defined as the value found by a point count method by observing two to five fields of view of a ¼ thickness portion of the cross section in the rolling direction of the steel sheet by an optical microscope by 100 to 800 magnifications in accordance with the roughness of the structure.

Microstructure (3):

When comparing ferrite and the other low temperature products (bainite, martensite, acicular ferrite, Widmanstatten ferrite, etc.), the degree of development of the texture is stronger in the latter products. Therefore, in order to secure a high shape fixability, preferably the volume fraction of the ferrite is adjusted so as not to exceed 80%.

As mentioned before, in actual automobile parts, not only does the shape fixability due to the bending in one part becomes an issue, but also a good press formability such as the stretch formability and deep drawability is required at the other positions of the same part in many cases. Accordingly, it is necessary to improve the shape fixability at the time of bending by controlling the texture and, at the same time, improve the press formability of the steel sheet per se. The present inventors found that it was most desirable to leave austenite in the steel sheet as the method of raising the deep drawability together with the stretch formability while satisfying the characteristic feature of the present invention of at least one of rL and rC being 0.7 or less.

When leaving austenite in the steel sheet, if the volume fraction of the residual austenite is less than 3%, the effect of improvement of the stretch formability and the deep drawability is small, so 3% was set as the lower limit of the residual austenite volume fraction. The larger the amount of residual austenite, the better the formability, but if residual austenite of 25% or more in volume fraction is contained, the worked stability of the austenite is lowered, and the workability of the steel sheet is conversely lowered. Therefore, preferably 25% is set as the upper limit of the residual austenite volume fraction.

Also, when the maximum phase in volume fraction is other than ferrite or bainite, the strength of the steel material is raised more than the required level and the workability is degraded or a required amount of the residual austenite cannot be secured due to precipitation of the unnecessary carbide and as a result the workability of the steel sheet is remarkably degraded. Therefore the maximum phase in volume fraction is limited to ferrite or bainite.

The amount of the residual austenite can be calculated by the method disclosed on page 60 of *Journal of the Iron and Steel Institute,* 206 (1968) by using integrated reflection intensities at the (200) plane and (211) plane of the ferrite and (200) plane, (220) plane, and (311) plane of the austenite by X-ray analysis using for example Kα rays of Mo.

Also, the volume fraction of the ferrite or bainite, the maximum phase in volume fraction, can be measured by using image processing or the point count method on a basis of a niter corrosion photo.

A shock absorption use member such as a front side member characteristically exhibits a hat-like sectional shape. The present inventors analyzed the deformation when such a member was crushed at a high speed and as a result found that the deformation had proceeded up to deformation with a high strain of 40% or more at the maximum, but about 70% or more of the entire absorbed energy was absorbed within a strain range of 10% or less of a high speed stress-strain curve. Accordingly, in the present invention, as an indicator of the ability to absorb impact energy at a high speed, a dynamic deformation resistance at the time of high speed deformation of 10% or less was employed. Particularly, a range of 3 to 10% as the amount of strain is most important, so a mean stress σdyn within the range of 3 to 10% of an equivalent strain at the time of high speed tensile deformation was used as the indicator of the absorption of impact energy. This mean stress σdyn at the time of high speed deformation is defined as the mean stress within the 3 to 10% strain range obtained by the dynamic tensile test (measured within a strain rate range of $5\times10^{2}$ to $5\times10^{3}$ (1/s)).

In general, the mean stress σdyn of 3 to 10% at the time of high speed deformation becomes large along with the rise of a static tensile strength (the maximum stress TS in a static tensile test measured within a strain rate range of $5\times10^{-4}$ to $5\times10^{-3}$ (1/s)) of the steel material. Accordingly, the increase of the static tensile strength of the steel material directly contributes to the improvement of the absorption of impact energy of the member.

However, when the strength of the steel sheet rises, the formability to the member is degraded, so it becomes difficult to obtain a required member shape. Accordingly, a steel sheet having a high σdyn at the same TS is preferred. Particularly, the strain level at the time of working to a member is mainly 10% or less, therefore, it is important for the improvement of the formability that the stress in a low strain region, which becomes the indicator of the shape fixability and other formability to be considered at the time of shaping to the member, is low.

Accordingly, it can be said that as a difference between σdyn and the mean value σst of the deformation stress within the equivalent strain range of 3 to 10% at the time of the deformation within the strain rate range of $5\times10^{-4}$ to $5\times10^{-3}$ (1/s) is larger, statically it is more excellent in formability, and dynamically it has a higher absorption of impact energy.

In this relationship, particularly steel sheet satisfying a relationship of $(\sigma dyn-\sigma st)\times TS/1000\geqq40$ is excellent in the formability to the member and simultaneously has a higher absorption of impact energy than other steel sheets. Accordingly, a member having a high absorption of impact energy can be obtained without increasing a total mass of the members.

Next, as the result of an experiments and investigation of the present inventors, it was found that the amount of pre-deformation corresponding to the shaping of a shock absorption use member such as a front side member sometimes reached 20% or more at the maximum according to the position in the member, but the equivalent strain was over 0% and not more than 10% at most positions. By grasping the effect of the pre-deformation in this range, it was possible to estimate the behavior after the pre-working for the whole member. Accordingly, in the present invention, deformation over 0% and not more than 10% in equivalent strain was selected as the pre-deformation given at the working to the member.

If σdyn and σst after pre-deformation over 0% and not more than 10% in equivalent strain is made to satisfy the above $(\sigma dyn-\sigma st)\times TS/1000 \geqq 40$, the member has excellent absorption of impact energy even after pre-working. It was clarified that the absorption of impact energy of the automobile use member actually produced by press forming satisfied the required properties.

As a result of the experiments and investigation, the present inventors found that (σdyn−σst) varied according to the solid solution carbon C in the residual austenite contained in the steel sheet before working to the member and the mean Mn equivalent mass % {Mneq=Mn+(Ni+Cr+Cu+Mo)/2} with respect to the TS of the same level.

The carbon concentration in the residual austenite can be experimentally found by X-ray analysis or Mossbauer spectrum. For example, for a sheet-like specimen, X-ray analysis using the Kα ray of Co, Cu, or Fe may be used to measure the reflection angles of the (002) plane, (022) plane, (113) plane, and (222) plane of the austenite and as described in *Elements of X-ray Diffraction* (B. D. Cullity, as translated into Japanese by Gentaro Matsumura, Chapter 11, Agune Co.), a lattice constant is calculated from the reflection angles, and the C concentration in the austenite is measured from the value of the lattice constant obtained by externally inserting it into $\cos^2\theta=0$ (note, θ is the reflection angle) by using the relationship of the lattice constant of the austenite and the solid solution C concentration in the austenite (for example Equation [1] described in R. C. Ruhl and M. Cohen, *Transaction of The Metallurgical Society of AIME*, vol. 245 (1969), pp. 241–251, that is, a relationship of lattice constant=3.572+0.033×(mass % of C)). Note that, the influence exerted upon the lattice constant of the austenite by the other elements is not very large, therefore there is no difficulty even if the existence of the other elements is ignored.

The present inventors found from the results of experiments performed by the present inventors that the (σdyn−σst) of steel sheet was a large (σdyn−σst) with respect to the same static tensile strength TS where the solid solution C (C) in the residual austenite obtained as described above and the value calculated by using Mneq found from substitute alloy elements incorporated in the steel material (M=678−428×C−33×Mneq) is −140 to 180.

At this time, if M is over 180, the residual austenite transforms to a hard martensite in the low strain region and raises the static stress in the low strain region controlling the formability. As a result, not only is the shape fixability and other formability degraded, but also the value of (σdyn−σst) becomes small, so both good formability and high absorption of impact energy cannot be obtained. Therefore, M was controlled to 180 or less. Also, where M is less than −140, the transformation of the residual austenite is limited to a high strain region, therefore a good formability is obtained, but the effect of increasing (σdyn−σst) disappears, so the lower limit of M was set to −140.

Also, the residual austenite volume fraction after pre-deformation over 0% and not more than 10% in terms of equivalent strain is given can be measured by the above method. In order to secure a high absorption of impact energy after the press forming, the residual austenite volume fraction after plastic working of 5% in equivalent strain must be 2% or more.

The effects of the present invention can be obtained without particularly determining the upper limit of the residual austenite volume fraction after the pre-deformation, but where the amount (%) thereof exceeds 120 times the C concentration (mass %) of the steel sheet, the stability of the austenite is not sufficient and as a result, the formability and absorption of impact energy are lowered. Therefore, the residual austenite volume fraction is preferably controlled to 120×C (%) or less. Here, as the mode of the pre-deformation, any transformation, for example uniaxial stretching, bending, press forming, forging, rolling, pipe-forming, or pipe expansion may be employed.

Also, where the ratio of the residual austenite volume fractions before and after the pre-deformation of 5% in equivalent strain is less than 0.35, a high absorption of impact energy cannot be secured, so 0.35 was set as the lower limit of the ratio. Also, the effects of the present invention can be obtained without particularly determining the upper limit of the ratio, but where this ratio exceeds 0.9 when giving pre-deformation of 10% in equivalent strain as the maximum pre-deformation estimated at present, the residual austenite becomes stable over the required level and the expected effect becomes smaller. Therefore, the ratio of the residual austenite volume fractions before and after the pre-deformation when giving pre-deformation of 10% in equivalent strain is preferably controlled to 0.9 or less.

When the mean grain size of the residual austenite becomes large in comparison with the grain size of the ferrite or bainite of the maximum phase in volume fraction, the stability per se of the residual austenite is lowered, and also the formability and absorption of impact energy are lowered. Therefore, the residual austenite grains are preferably as fine as possible. Accordingly, the ratio of the mean grain size of the residual austenite with respect to the grain size of the ferrite or bainite having the maximum phase in volume fraction is desirably 0.6 or less. The effects of the present invention can be obtained without particularly determining the lower limit of this ratio, but an extreme fineness of the residual austenite grains stabilizes the austenite more than the required level and reduces the effects of the residual austenite. Therefore, the ratio of the mean grain size of the residual austenite with respect to the grain size of the ferrite or bainite of the maximum phase in volume fraction is preferably 0.05 or more.

The present invention can be applied to all steel sheet from mild steel sheet having a low tensile strength level to high strength steel sheet. If the above limits are satisfied, the bending formability of the steel sheet is remarkably improved. In other words, the X-ray intensity ratio and the r value are basic material indicators related to bending deformation exceeding the restriction of the mechanical strength level of the steel sheet. Other indicators relating to the structure are also important indicator.

The above definitions can be universally applied to all steel sheet, so it is basically unnecessary to particularly limit the type of the steel sheet. However, when viewed from the practical viewpoint, when referring to the type of the steel sheet to which this technique can be applied, the type of the steel sheet covers everything from mild steel sheet up to high strength steel sheet. Further, of course, it is not necessary to differentiate between hot-rolled steel sheet or cold-rolled steel sheet.

The compositions of the steel sheet to which the present invention can be applied include compositions such as ultra low carbon steel sheet, so-called IF (Interstitial Free) steel sheet wherein the solid solution carbon or nitrogen is fixed by Ti or Nb, low carbon steel sheet, solid solution strengthened high strength steel sheet, precipitation strengthened high strength steel sheet, high strength steel sheet strengthened by a transformed structure such as martensite or bainite, and further high strength steel sheet using combinations of these strengthening mechanisms.

The basic components of the thin ferritic steel sheet according to the present invention are, in terms of weight %, C: 0.001 to 0.3%, Si: 0.001 to 3.5%, Mn: less than 3%, P: 0.005 to 0.15%, S: less than 0.03%, Al: 0.01 to 3.0%, N: less than 0.01%, 0: less than 0.01%, and the remainder Fe and unavoidable impurities, in addition to optionally further containing, in terms of weight %, at least one element selected from the group consisting of, in terms of weight %, Ti: less than 0.20%, Nb: less than 0.20%, V: less than 0.20%, Cr: less than 1.5%, B: less than 0.007%, Mo: less than 1%, Cu: less than 3%, Ni: less than 3%, Sn: less than 0.3%, Co: less than 3%, Ca: 0.0005 to 0.005%, and REM: 0.001 to 0.02%.

C contributes to stabilization of the austenite at room temperature and retains a required amount of the volume fraction of the residual austenite, and is concentrated in the untransformed austenite during working and heat treatment and can improve the stability with respect to the working of the residual austenite. Si is an element effective for raising the mechanical strength of the steel sheet and prevents degrading formability and surface defects. Mn is also an element effective for raising the mechanical strength of the steel sheet and is desirably added in an amount satisfying $Mn/S \geqq 20$ to suppress the occurrence of cracks due to S during hot rolling. P and S are added to prevent the deterioration of the workability or cracking during hot rolling and cold rolling. Al is an element that stabilizing the ferrite and has the function of increasing the volume fraction of the ferrite and thereby improving workability of the steel material, and also Al suppresses the generation of the cementite and effectively enables the concentration of C into the austenite and therefore is an essential element for retaining the austenite in an adequate volume fraction at room temperature. N is an element which, like C, stabilizes austenite. O forms oxide and degrades the workability of the steel material, particularly a limit deformability represented by the stretch flangeability, and degrades the fatigue strength and toughness of the steel material.

Ti, Nb, V, and B suppress the re-crystallization of the austenite phase during hot rolling or lower the $\gamma \rightarrow \alpha$ transformation temperature and thereby promote the development of the texture preferred for the shape fixability, particularly the {112}<110> orientation, and contribute to the enhancement of quality through mechanisms such as fixing of C and N, precipitation strengthening, texture control, and strengthening of fine grains. Mo, Cr, Cu, Ni, and Sn have the effect of raising mechanical strength and enhancing quality. The addition of Ca, Mg, and REM is effective for deoxidation and control of the form of the sulfide.

Next, an explanation will be given of several variations of the steel sheet according to the present invention.

Ferritic Steel Sheet

It is preferable to use a material containing, in terms of weight %, C: 0.0001 to 0.25%, Si: 0.001 to 2.5%, Mn: 0.1 to 2.5%, P: 0.005 to 0.2%, S: ≦0.03%, Al: ≦2.0, N: ≦0.01%, and optionally further containing one or more of Ti: 0.005 to 0.20%, Nb: 0.001 to 0.20%, B: 0.0001: to 0.070%. It is possible to add one or more of Mo, Cu, Ni, Sn, Ca, and Mg in accordance with the various purposes of the steel sheet.

In this ferritic steel sheet, the constituent elements are incorporated within a range satisfying the conditions shown in the Equations (1) and (2) to obtain an appropriate texture for shape fixability when finish hot rolling is carried out at a temperature of below $Ar_3$ transformation temperature. If the above mentioned equations are satisfied, the finish hot rolling is performed in the a zone for recrystallization during coiling. When the cold rolling and annealing are further applied, the random texture can be developed.

$$203\sqrt{C}+15.2Ni+44.7Si+104V+31.5Mo+30Mn+11Cr+20Cu+700P+200Al<30 \quad (1)$$

$$44.7Si+700P+200Al>40 \quad (2)$$

High Stretch Flanging Steel Sheet (a)

It is preferable to use a material containing, in terms of weight %, C: 0.0001 to 0.3%, Si: 0.001 to 3.5%, Mn: 0.05 to 3%, P: ≦0.02%, S: ≦0.03%, Al: 0.01 to 3%, N: ≦0.01%, O: ≦0.01%, and optionally further containing one or more of Ti: 0.005 to 1%, Nb: 0.001 to 1%, V: 0.001 to 1%, Cr: 0.01 to 3%, B: 0.001 to 0.01%. It is possible to add one or more of Mo, Cu, Ni, Sn, Ca, and Mg in accordance with the various purposes of the steel sheet.

High Stretch Flanging Steel Sheet (b)

It is preferable to use a material containing, in terms of weight %, C: 0.0001 to 0.15%, Si: 0.001 to 3.5%, Mn: 0.05 to 3%, P: ≦0.02%, S: ≦0.03%, Al: 0.01 to 3% N: ≦0.01%, O: ≦0.01%, and optionally further containing one or more of Ti: 0.01 to 2%, Nb: 0.01 to 2%. It is possible to add one or more of V, Mo, Cr, Cu, Ni, Sn, Ca, and Mg in accordance with the various purposes of the steel sheet.

High Workability High Strength Steel Sheet

It is preferable to use a material containing, in terms of weight %, C: 0.04 to 0.3%, Al+Si: ≦3%, Co: Si: 0.01 to 3%, total amount of Mn, Ni, Cr, Cu, Mo, Sn: ≦3.5%, P: ≦0.2%, S: ≦0.03%, N: ≦0.01%, O: ≦0.01%, B: 0.0002 to 0.01%, total amount of Ti, Nb, V: 0.001 to 0.3%. It is possible to add one or more of Ca, Mg, REM in accordance with the various purposes of the steel sheet.

Low Yield Ratio High Strength Steel Sheet

It is preferable to use a material containing, in terms of weight %, C: 0.02 to 0.3%, Al+Si: 0.05 to 3.0%, total amount of Mn, Ni, Cr, Cu, Mo, Sn, Co: 0.05 to 3.5%, P: 0.005 to 0.2%, S: ≦0.03%, N: ≦0.01%, O: ≦0.01%, B: 0.0005 to 0.01%, total amount of Ti, Nb, V: 0.005 to 0.3%. It is possible to add one or more of Ca, Mg, REM in accordance with the various purposes of the steel sheet.

Next, an explanation will be given of the methods of production of the present invention.

(1) Method of Production (A) of Ferritic Steel Sheet

The method of production of the steel preceding the hot rolling is not particularly limited. Namely, subsequent to the melting and refining by a blast furnace or electric furnace etc., various secondary refining operations may be carried out and then the steel continuously cast by an ordinary method, cast by the ingot method, or cast into thin slabs. In the case of continuous casting, the steel may be once cooled to a low temperature and then heated again and hot rolled or the cast slab may be continuously hot rolled. It is also possible to use scrap as the starting material.

Thin ferritic steel sheet excellent in shape fixability of the present invention may also be obtained by casting steel having the above composition, then hot rolling and then cooling it; hot rolling, then cooling it or pickling it by acid, then heat treating it; hot rolling it, then cooling and acid pickling, cold rolling, then annealing it; or heat treating the hot-rolled steel sheet or cold-rolled steel sheet in a hot dipping line; or by applying separate surface treatment to the steel sheet.

When completing the above (A) hot rolling at $(Ar_3-100)°$ C. determined by the weight of the chemical composition of the steel or more, in the latter half of the hot rolling, the rolling is performed so that the total reduction rate at $(Ar_3-100)°$ C. to $(Ar_3+100)°$ C. becomes 25% or more. When this rolling is not carried out, the texture of the rolled austenite does not sufficiently develop, and even if cooling is applied after the hot rolling, the crystal orientation of the predetermined X-ray intensity level cannot be obtained in the finally obtained hot-rolled steel sheet. Therefore, the lower limit of the sum of reduction rates at $(Ar_3-100)°$ C. to $(Ar_3+100)°$ C. is made 25%.

The higher the total reduction rate at $(Ar_3-100)°$ C. to $(Ar_3+100)°$ C., the sharper the texture that can be expected to be formed, and therefore preferably it is set as 35% or more, but if the sum of the reduction rates exceeds 97.5%, it becomes necessary to excessively raise the rigidity of the rolling machine, so there arises an economical demerit. Therefore, the sum of the reduction rates is desirably controlled to 97.5% or less.

Here, in the above method of production (A), if the friction coefficient of the hot rolling roll and the steel sheet at the time of hot rolling at $(Ar_3-100)°$ C. to $(Ar_3+100)°$ C. exceeds 0.2, a crystal orientation mainly comprised of the {110} plane develops in the vicinity of the surface of the steel sheet and degrades the shape fixability. Therefore, when a better shape fixability is intended, desirably the friction coefficient of the hot rolling roll and the steel sheet is set as 0.2 or less in at least one pass at the time of hot rolling at $(Ar_3-100)°$ C. to $(Ar_3+100)°$ C.

It is preferred that this friction coefficient be as low as possible. When a further better shape fixability is required, the friction coefficient is desirably set as 0.15 or less for all passes of the hot rolling at $(Ar_3-100)°$ C. to $(Ar_3+100)°$ C.

In order to get the final hot-rolled steel sheet to succeed to the texture of the austenite formed in this way, it is necessary to coil it at the To temperature or less. Accordingly, To determined by the mass % of the chemical composition of the steel was set as the upper limit of the coiling. This temperature To is thermodynamically defined as the temperature at which the austenite and the ferrite comprised of identical ingredients to those of the austenite have an identical free energy and can be simply calculated by using the following Equation (1) by taking also the influence of the ingredients other than C into account. The influence of the ingredients other than this defined in the present invention exerted upon the temperature To is not so large, so are ignored here.

$$To=-650.4\times C\ \%+B \quad (1)$$

where B is a value determined by the mass % of the chemical composition of the steel according to the following equation:

$$B=-50.6\times Mneq+894.3$$

$$Mneq=Mn\ \%+0.24\times Ni\ \%+0.13\times Si\ \%+0.38\times Mo\ \%+0.55\times Cr\ \%+0.16\times Cu\ \%-0.50\times Al\ \%-0.45\times Co\ \%+0.90\times V\ \%$$

When the hot-rolled steel sheet obtained in this way (or the heat treated hot-rolled steel sheet) is cold rolled and then annealed to obtain a final steel sheet, cold rolling of less than 80% is applied. Where the total reduction rate of the cold rolling becomes 80% or more, the components of the {111} plane and {554} plane become high in an X-ray diffraction integration plane intensity ratio of the crystal plane parallel to the sheet face of a general cold-rolled recrystallized texture, so the requirement relating to the crystal orientation defined for the ferritic steel sheet in the present invention is no longer satisfied. Therefore, the upper limit of the reduction rate in the cold rolling was set as 80%. In order to raise the shape fixability, desirably the cold rolling reduction rate is restricted to 70% or less. It is preferable to restrict the upper limit of the cold reduction rate of 50%, more preferably 30%.

At the time of annealing the cold-rolled steel sheet cold worked within such a range of reduction rate, if the annealing temperature is less than 600° C., the deformed microstructure remains and the formability is remarkably degraded, so the lower limit of the annealing temperature is set as 600° C. On the other hand, when the annealing temperature is excessively high, the texture of ferrite generated by the recrystallization is randomized by the grain growth of the austenite after the transformation to austenite, and also the finally obtained texture of ferrite is randomized. Particularly, such a tendency becomes conspicuous when the annealing temperature exceeds $(Ac_3+100)°$ C., so the annealing temperature is set as $(Ac_3+100)°$ C. or less.

The microstructure obtained in the present invention is mainly comprised of ferrite, but it is also possible to include pearlite, bainite, martensite and/or austenite as the metal structure other than the ferrite. Further it is also possible if a compound such as a carbonitride is contained. Particularly, the crystal structure of martensite or bainite is equivalent to or resembles the crystal structure of ferrite, so there is no difficulty even if these structures form the main components in place of the ferrite.

Note that the steel sheet according to the present invention can be used not only for bending, but also composite shaping mainly comprised of bending, stretch forming, and deep drawing, and other types of bending work.

(2) Method of Production (B) of Ferritic Steel Sheet

When the hot rolling temperature becomes the $Ar_3$ transformation temperature or less, the ferrite generated before rolling is worked, and a strong rolled structure of {100}<011> as a peak texture is formed. Accordingly, the finish rolling is carried out at the $Ar_3$ transformation temperature or less. The lower limit of the rolling ending temperature is not limited, but if it is lower than 400° C., the load upon the rolling machine becomes large, so desirably the rolling is completed at a temperature over 400° C. If the rolling ending temperature is over the $Ar_3$ transformation temperature, a texture advantageous for the shape fixability is not obtained, so the upper limit of the rolling ending temperature is set as the $Ar_3$ transformation temperature. In order to finally change the ferrite texture worked at a high temperature to a texture advantageous for the shape fixability after cooling, it is necessary to recover and recrystallize the ferrite worked at a high temperature by coiling while coolig or cooling once, then reheating. The reduction rate at the $Ar_3$ transformation or less temperature is not particularly limited, but if it is less than 25%, the development of the texture is insufficient, and if it exceeds 85%, a texture degrading the shape fixability develops, so desirably the reduction rate is controlled to 25 to 85%. Where a better shape fixability is intended, preferably the friction coefficient of the hot rolling roll and the steel sheet is controlled to 0.2 or less in at least one pass in the finish rolling. This friction coefficient is desirably as low as possible. Where a particularly strict shape fixability is required, desirably the friction coefficient is controlled to 0.15 or less in all passes at the finish rolling.

(3) Method of Production of High Stretch Flanging Steel Sheet (a)

The steel sheet excellent in shape fixability of the present invention may be obtained by casting steel having the above composition, then hot rolling and then cooling it; hot rolling, then heat treating it; hot rolling, then cooling and acid pickling, cooling, then annealing it; or plating the hot-rolled steel sheet or cold-rolled steel sheet or heat treating it in a hot dipping line; or by applying separate surface treatment to the steel sheet.

Where rolling of 25% or more in total is not carried out at $Ar_3$ to $(Ar_3+100)°$ C. in the latter half of the hot rolling, the texture of the rolled austenite does not sufficiently develop, therefore, even if cooling is applied, the finally obtained hot-rolled steel sheet, the crystal orientation of the predetermined X-ray intensity level defined in the present invention is not obtained. Accordingly, the lower limit of the sum of the reduction rates at the $Ar_3$ transformation temperature to $(Ar_3+100)°$ C. was set as 25%.

The higher the total reduction rate at the $Ar_3$ transformation temperature to $(Ar_3+100)°$ C., the sharper the texture which can be expected to be formed, so preferably the total reduction rate is controlled to 35% or more, but when the sum of reduction rates exceeds 97.5%, it is necessary to excessively raise the rigidity of the rolling machine, so there is an economical demerit. Therefore, the sum of the reduction rates is desirably controlled to 97.5% or less.

Here, in the hot rolling at $(Ar_3+100)°$ C. or less, where rolling is not carried out at a friction coefficient of the hot rolling roll and the steel sheet of 0.2 or less, that is, where the friction coefficient exceeds 0.2, crystal orientation mainly comprised of the {110} plane develops in the vicinity of the surface of the steel sheet, and the shape fixability is degraded. Therefore, where a better shape fixability is intended, desirably the friction coefficient of the hot rolling roll and the steel sheet is controlled to 0.2 or less for at least one pass at the hot rolling at $(Ar_3+100)°$ C. or less. This friction coefficient is preferably as low as possible. Where a further better shape fixability is required, desirably the friction coefficient is controlled to 0.15 or less for all passes of the hot rolling at the $Ar_3$ transformation temperature to $(Ar_3+100)°$ C.

The finishing temperature of the hot rolling must be set as the $Ar_3$ transformation temperature or more from the viewpoint of the formability. The upper limit of the finishing temperature is not particularly determined, but in order to make the texture excellent in shape fixability sharper, the upper limit is preferably set as $(Ar_3+50)°$ C. or less.

In order to get the final hot-rolled steel sheet to succeed to the texture of the austenite formed in this way, it is necessary to coil it at the To temperature shown in the previous described Equation (1) or less. Accordingly, To determined by the composition of the steel was set as the upper limit of the coiling temperature.

Also, where the hot rolling temperature becomes the $Ar_3$ transformation temperature or less, the ferrite generated before working is worked, and a strong rolled texture is formed. In order to finally change such a texture to a texture advantageous for the shape fixability, it is necessary to recover and recrystallize the phase worked at a high temperature by coiling the sheet at 350° C. to the $Ar_3$ transformation temperature while cooling or once cooling and then heating again to 500° C. to the $Ar_3$ transformation temperature for 10 to 120 minutes.

Where the total reduction rate at the $Ar_3$ transformation temperature or less is less than 25%, even if coiling at the recrystallization temperature or more or if cooling, then reheating for recovery and recrystallization, the crystal orientation of the predetermined X-ray intensity level defined in the present invention is not obtained. Therefore, 25% was set as the lower limit of the total reduction rate at the $Ar_3$ transformation temperature or less. 35% is a more desirable lower limit.

Also, when once cooling, then reheating the steel sheet, if the heating temperature is lower than 500° C., the workability is degraded, while if the heating temperature is higher than the $Ar_3$ transformation temperature, the shape fixability is lowered. Therefore, the heating temperature is limited to the range of 500 to the $Ar_3$ transformation temperature. The hot rolling ending temperature is not particularly prescribed, but if it becomes less than 300° C., the load upon the rolling machine becomes large, so it is desirably set as 300° C. or more.

Here, where the rolling is not carried out so that the friction coefficient of the hot rolling roll and the steel sheet at the time of hot rolling becomes 0.2 or less, that is, the friction coefficient exceeds 0.2, a crystal orientation mainly comprised of the {110} plane develops in the vicinity of the surface of the steel sheet, and the shape fixability is degraded. Therefore, where a better shape fixability is intended, for at least one pass in the hot rolling at $Ar_3$ or less, the friction coefficient between the roll and the steel sheet is preferably controlled to 0.2 or less. This friction coefficient is desirably as low as possible. Where a particularly strict shape fixability is required, desirably the friction coefficient is controlled to 0.15 or less for all passes of the hot rolling at $Ar_3$ or less.

When the hot-rolled steel sheet obtained in this way is cold rolled and then annealed to obtain a final steel sheet, if the total reduction rate of the cold rolling becomes 80% or more, the components of the {111} plane and {554} plane become high in an X-ray diffraction integration plane intensity ratio of the crystal plane parallel to the sheet face of a general cold-rolled recrystallized texture, so the requirement relating to the crystal orientation defined for the ferritic steel sheet in the present invention is no longer satisfied. Therefore, the upper limit of the reduction rate in the cold rolling was set as 80%. In order to raise the shape fixability, desirably the cold rolling reduction rate is restricted to 70% or less, preferably 50% or less, and more preferably 30% or less.

At the time of annealing the cold-rolled steel sheet cold worked within such a range of reduction rate, if the annealing temperature is less than 600° C., the deformed microstructure remains and the formability is remarkably degraded, so the lower limit of the annealing temperature is set as 600° C.

On the other hand, when the annealing temperature is excessively high, the texture of ferrite generated by the recrystallization is randomized by the grain growth of the austenite after the transformation to austenite, and also the finally obtained texture of ferrite is randomized. Particularly, such a tendency becomes conspicuous when the annealing temperature exceeds $(Ac_3+100)°$ C. Therefore, the annealing temperature is set as $(Ac_3+100)°$ C. or less. It is also possible if the skin pass rolling is applied to the cold-rolled steel sheet according to need.

Note that the steel sheet according to the present invention can be used not only for bending, but also composite shaping mainly comprised of bending, stretch forming, and deep drawing, and other types of bending work.

(4) Method of Production of High Stretch Flanging Steel Sheet (b)

The steel sheet may be obtained by casting steel having the above composition, then hot rolling and then cooling it; hot rolling, then heat treating it; hot rolling, then cooling and acid pickling, cooling, then annealing it; or plating the hot-rolled steel sheet or cold-rolled steel sheet or heat treating it in a hot dipping line; or by applying separate surface treatment to the steel sheet.

The heating temperature in the hot rolling is within a temperature range of 1150 to 1350° C. in all cases. If the heating temperature is less than 1150° C., the carbides of Ti or Nb will not go into solid solution again, the effect of sharpening the texture is reduced, and, after the hot rolling, the rough carbides are precipitated and degrade the stretch frangeability. On the other hand, even if the heating temperature is set as over 1350° C., only the effect is saturated and there are large demerits in the cost and equipment, so the upper limit of the heating temperature at the time of hot rolling is set as 1350° C.

In order to obtain the crystal orientation of {112}<110> as a peak texture of the predetermined X-ray intensity level defined in the present invention, it is necessary to perform the hot rolling at the $Ar_3$ transformation temperature or more. In the latter half of the hot rolling, if rolling of 25% or more in total is not carried out at the $Ar_3$ transformation temperature to ($Ar_3$+100)° C., the texture of the rolled austenite does not sufficiently develop, therefore, even if cooling is applied to the finally obtained hot-rolled steel sheet, the crystal orientation of the predetermined X-ray intensity level defined in the present invention is not obtained. Accordingly, the lower limit of the sum of the reduction rate at the $Ar_3$ transformation temperature to ($Ar_3$+100)° C. was set as 25%.

The higher the total reduction rate at the $Ar_3$ transformation temperature to ($Ar_3$+100)° C., the sharper the texture which can be expected to be formed, so preferably the total reduction rate is controlled to 35% or more, but when the sum of reduction rates exceeds 97.5%, it is necessary to excessively raise the rigidity of the rolling machine, so there is an economic demerit. Therefore, the sum of the reduction rates is desirably controlled to 97.5% or less.

If the hot rolling finishing temperature is lower than the $Ar_3$ transformation temperature, a phenomenon where the {112}<110> orientation particularly develops in the group of {100}<011> to {223}<110> orientations no longer is manifested, while if it exceeds ($Ar_3$ transformation temperature+100)° C., the entire texture is randomized and the shape fixability is degraded. Accordingly, the hot rolling ending temperature is limited to the range of the $Ar_3$ transformation temperature to ($Ar_3$ transformation temperature+100)° C. Note that, the upper limit of the hot rolling ending temperature is desirably set as ($Ar_3$ transformation temperature+50)° C.

In the hot rolling at the $Ar_3$ transformation temperature to ($Ar_3$+100)° C., when the friction coefficient of the hot rolling roll and the steel sheet exceeds 0.2, a crystal orientation mainly comprised of the {110} plane develops at the sheet face in the vicinity of the surface of the steel sheet, and the shape fixability is degraded. Therefore, when a better shape fixability is intended, desirably the friction coefficient of the hot rolling roll and the steel sheet is controlled to 0.2 or less for at least one pass in the hot rolling at the $Ar_3$ transformation temperature to ($Ar_3$+100)° C.

This friction coefficient is preferably as low as possible. The lower limit is not determined, but where a further better shape fixability is required, desirably the friction coefficient is controlled to 0.15 or less for all passes of the hot rolling at the $Ar_3$ transformation temperature to ($Ar_3$+100)° C. The method of measurement of the friction coefficient is not particularly defined, but as is generally well known, it is desirably found from the advancing rate and rolling load.

In order to get the final hot-rolled steel sheet to succeed to the texture of the austenite formed in this way, after the ending of the hot rolling, it is necessary to cool the steel sheet to the To temperature shown in the previous described Equation (1) or less at a mean cooling rate of 10° C./s or more.

When the mean cooling rate becomes large, during the coiling, the driving force relating to the precipitation of TiC or NbC increases, so the mean cooling rate is preferably 30° C./s or more and further preferably 50° C./s or more. However, it is difficult to control the mean cooling rate to over 200° C./s in practice, so desirably it is controlled to 200° C./s or less.

The coiling after the cooling is carried out within a temperature range of 450 to 750° C. When the coiling temperature becomes less than 450° C., the fine precipitation of TiC or NbC is reduced, and the iron carbide degrading the stretch frangeability increases. Also, when it exceeds 750° C., TiC or NbC are coarsened at the grain boundaries and degrades the stretch flangeability. From the above viewpoint, the sheet is desirably coiled within a temperature range of 500 to 700° C.

In order to obtain the crystal orientation of {100}<011> as a peak structure of the predetermined X-ray intensity level defined in the present invention, it is necessary to perform rolling of 25% or more in total at ($Ar_3$+50)° C. to ($Ar_3$+150)° C. When this condition is not satisfied, the working of the austenite becomes insufficient, and the texture does not sufficiently develop.

The higher the total reduction rate at ($Ar_3$+50) to ($Ar_3$+150)° C., the sharper the texture which can be expected to be formed, so preferably it is set as 35% or more, but if this sum of reduction rates exceeds 97.5%, it is necessary to excessively raise the rigidity of the rolling machine and there is an economic demerit, so desirably it is controlled to 97.5% or less.

In order to remarkably raise the integration of the texture in the {100}<011> orientation, it is extremely important to continuously apply reduction of 5 to 35% at ($Ar_3$−100) to ($Ar_3$+50)° C. This is because, it is extremely important to further apply an appropriate amount of reduction in a stage where the austenite sufficiently worked in a high temperature zone is at least partially recrystallized and cause the ferrite transformation immediately after that for the development of the {100}<011> orientation.

Accordingly, even if the reduction is made at less than ($Ar_3$−100)° C., the region where the ferrite transformation has been already completed is too large, so {100}<011> does not develop.

When the reduction is applied at over ($Ar_3$+50)° C., the strain introduced until the ferrite transformation ends up recovering, so {100}<011> does not develop.

Also, if the reduction rate is less than 5%, the overall texture containing {100}<011> to {223}<110> is randomized, while if the reduction rate exceeds 35%, the integration to the {100}<011> orientation becomes low, so the reduction rate within a temperature range of ($Ar_3$−100) to ($Ar_3$+50)° C. is controlled to 5 to 35%. Note that, the reduction rate is desirably controlled to 10 to 25%.

The hot rolling is terminated within a temperature range of ($Ar_3$−100) to ($Ar_3$+50)° C. When the hot rolling ending temperature becomes less than ($Ar_3$−100), the workability is remarkably degraded, while when it becomes over ($Ar_3$+50)° C., the integration of the texture becomes insufficient, and the shape fixability is degraded.

When the hot-rolled steel sheet obtained in this way is cold rolled and then annealed to obtain a final steel sheet, if the total reduction rate of the cold rolling becomes 80% or more, the components of the {111} plane and {554} plane become high in an X-ray diffraction integration plane intensity ratio of the crystal plane parallel to the sheet face of a general cold-rolled recrystallized structure, so the requirement relating to the crystal orientation defined for the ferritic steel sheet in the present invention is no longer satisfied. Therefore, the upper limit of the reduction rate in the cold rolling was set as 80%. In order to raise the shape fixability, desirably the cold rolling reduction rate is restricted to 70% or less, preferably 50% or less, and more preferably 30% or less.

At the time of annealing the cold-rolled steel sheet cold worked within such a range of reduction rate, if the annealing temperature is less than 600° C., the deformed microstructure remains and the formability is remarkably degraded, so the lower limit of the annealing temperature is set as 600° C. On the other hand, when the annealing temperature becomes over 800° C., TiC and NbC are coarsened and the expandability is degraded and, at the same time, also the shape fixability is lowered. Therefore, the annealing temperature is set as 800° C. or less, it is also possible if to apply skin pass rolling to the cold-rolled steel sheet according to need.

Note that the steel sheet according to the present invention can be used not only for bending, but also composite shaping mainly comprised of bending, stretch forming, and deep drawing, and other types of bending work.

(5) Method of Production of High Workability High Strength Steel Sheet

First, an explanation will be made of the slab reheating temperature. Steel having the predetermined composition is cast and then hot rolled directly or after being once cooled to the $Ar_3$ transformation temperature or less, then reheated. When the reheating temperature at this time is less than 1000° C., there arises a necessity of maintaining the hot rolling ending temperature within the range of the present invention by using some sort of heating device until the hot rolling is completed, so 1000° C. was set as the lower limit of the slab reheating temperature. Also, when the re-heating temperature exceeds 1300° C., scale is generated at the time of heating and induces the deterioration of yield and simultaneously induces a rise of the production cost, so 1300° C. was set as the upper limit of the reheating temperature.

By the hot rolling and the cooling after that, the formation of the predetermined microstructure and structure is controlled. The finally obtained texture of the steel sheet largely varies according to the temperature region of the hot rolling. Where the hot rolling becomes less than $(Ar_3-50)$° C., the amount of austenite remaining after the completion of hot rolling is not sufficient, the microstructure after that cannot be controlled, and a large amount of the deformed ferrite remains, so $(Ar_3-50)$° C. was set as the lower limit of the hot rolling ending temperature. The effects of the present invention can be obtained without particularly determining the upper limit of the hot rolling ending temperature so far as it is the reheating temperature or less, but the development of the texture of the steel sheet becomes more conspicuous in the rolling at a lower temperature and further the ductility is enhanced by the refining of the microstructure, so the hot rolling ending temperature is preferably set as $(Ar_3+150)$° C. or less.

Also, in the hot rolling, the reduction rate within a temperature range of $(Ar_3-50)$° C. to $(Ar_3+100)$° C. exerts a large influence upon the formation of the texture of the final steel sheet. Where the rolling rate in this temperature range is less than 25%, the development of the texture is not sufficient, and the finally obtained steel sheet does not manifest good shape fixability, so 25% was set as the lower limit of the reduction rate within a temperature range of $(Ar_3-50)$° C. to $(Ar_3+100)$° C. The higher the reduction rate, the more the intended texture develops, so the reduction rate within the above temperature range is preferably 50% or more and further preferably 75% or more.

Note that, $$Ar_3=901-325\times C\ \%+33\times Si\ \%+287\times P\ \%+40\times Al\ \%-92\times(Mn\ \%+Mo\ \%+Cu\ \%)-46\times(Cr\ \%+Ni\ \%)$$

is set.

Even if hot rolling within the above temperature range is carried out under the usual hot rolling conditions, the shape fixability of the final steel sheet is high, but when controlled so that the friction coefficient thereof becomes 0.2 or less in at least one pass of the hot rolling performed within the above temperature range, the shape fixability of the final steel sheet further becomes high.

Also, the working, hydraulic spraying, grit blasting, and the like performed for the purpose of removing the scale before the finish hot rolling have an effect of raising the surface quality of the final steel sheet, so are preferred.

In the cooling after the hot rolling, it is most important to control the coiling temperature, but the mean cooling rate is preferably 15° C./second or more. The cooling is desirably smoothly started after the hot rolling. Also, provision of air cooling in the middle of the cooling does not degrade the properties of the final steel sheet.

In order to get the final hot-rolled steel sheet to succeed to the texture of the austenite formed in this way, it is necessary to coil the steel sheet at the To temperature shown in the previous described Equation (1) or less. Accordingly, To determined by the ingredients of the steel was set as the upper limit of the coiling temperature.

Where the cooling is completed at the temperature To determined by the chemical composition of the steel sheet or more and the sheet is coiled as it is, even in if the above hot rolling conditions are satisfied, the intended texture does not sufficiently develop in the finally obtained steel sheet, and the shape fixability of the steel sheet does not become high.

Also, where the coiling temperature is over 480° C., a sufficient amount of austenite does not remain in the steel sheet, so 480° C. was set as the upper limit of the coiling temperature. On the other hand, when the coiling temperature becomes less than 300° C., the residual austenite in the steel sheet becomes unstable, and the workability of the steel sheet is largely degraded, so 300° C. was set as the lower limit of the coiling temperature.

When the steel sheet of the present invention is produced by cold rolling and annealing, it is necessary to cause the intended texture to sufficiently develop after the hot rolling. For this purpose, for the above reason, it is necessary to determine the heating temperature as 1000° C. to 1300° C., terminate the hot rolling at $(Ar_3-50)$° C. or more, and control the lower limit of the reduction rate within a temperature range of $(Ar_3-50)$° C. to $(Ar_3+100)$° C. at this time to 25%.

In the hot rolling within this temperature range, when controlling it so that the friction coefficient in at least one pass becomes 0.2 or less, the shape fixability of the final steel sheet further becomes higher. After the hot rolling, when the coiling temperature after the cooling becomes over above To, the intended structure cannot be developed by the cold rolling and annealing after that, so a good shape fixability cannot be achieved. Accordingly, To shown in the previous described Equation (1) was set as the upper limit of the coiling temperature.

The coiling temperature may be To or less, but if it is less than 300° C., the deformation resistance at the time of cold rolling becomes large, so desirably the sheet is coiled at 300° C. or more. Also, working, hydraulic spraying, grit blasting, and the like performed for the purpose of removing the scale before the start of the finish hot rolling have the effect of raising the surface quality of the final steel sheet, so are preferred.

When acid pickling the hot-rolled steel sheet produced by the above method and then cold rolling it, if the cold rolling reduction rate exceeds 95%, the load of the cold rolling increases too much, so desirably the cold rolling is carried out with a reduction rate of 95% or less. For increasing shape fixability, the cold rolling reduction rate is preferably 70% or less, more preferably 50% or less.

The annealing after the cold rolling is carried out in the continuous annealing line. If the annealing temperature is less than the $Ac_1$ temperature determined by the composition of the steel, this means that the residual austenite is not contained in the microstructure of the final steel sheet, so the $Ac_1$ temperature is set as the lower limit of the annealing temperature. Also, when the annealing temperature is over the $Ac_3$ temperature determined by the composition of the steel, many of the texture formed inside the steel by the hot rolling are destroyed, and the shape fixability of the finally obtained steel sheet is degraded. Therefore, the $Ac_3$ temperature was set as the upper limit of the annealing temperature. In order to achieve both the shape fixability and workability of the finally obtained steel sheet, the annealing temperature is desirably $(Ac_1+2\times Ac_3)/3$ or less.

Note, $$Ac_1(^\circ\text{ C.})=723-10.7\times Mn\ \%-16.9\times Ni\ \%+29.1\times Si\ \%+16.9\times Cr\ \%$$

$$Ac_3(^\circ\text{ C.})=910-203\times(C\ \%)^{1/2}-15.2\times Ni\ \%+44.7\times Si\ \%+31.5\times Mo\ \%+13.1\times W\ \%-30\times Mn\ \%-11\times Cr\ \%-20\times Cu\ \%+70\times P\ \%+40\times Al\ \%.$$

are set.

Where the mean cooling rate of the cooling after annealing is less than 1° C./second, the development of the texture of the finally obtained steel sheet is not sufficient, and a good shape fixability is not obtained. Therefore, 1° C./second was set as the lower limit of a cooling rate. Also, control of the mean cooling rate to over 250° C./second with respect to the overall sheet thickness range of 0.4 mm to 3.2 mm significant in practical use requires excessive capital investment, so 250° C./second was set as the lower limit of the cooling rate. In this cooling, it is also possible to combine cooling at a low cooling rate of 10° C./second or less after annealing and at a high cooling rate of 20° C./second or more.

After the cooling, when the sum of resident times in the temperature region of 300° C. to 480° C. is less than 15 seconds, the stability of the residual austenite in the finally obtained steel sheet is low, and a high workability is not obtained, so 15 seconds was set as the lower limit of the total resident time in the temperature region of 300° C. to 480° C. Also, where this resident time exceeds 30 minutes, a furnace having an excess length becomes necessary, which causes a large demerit in economy, so 30 minutes was set as the upper limit of the total resident time in the temperature region of 300° C. to 480° C. It is also possible, before residence in the temperature region of 300° C. to 480° C. after cooling, to cool the steel sheet once to 200° C. to 300° C., then reheat it and hold it in the temperature region of 300° C. to 480° C.

Next, an explanation will be made of the skin pass rolling.

The application of skin pass rolling to the steel sheet of the present invention produced by the above method before shipping not only enhances the shape of the steel sheet, but also raises the absorption of impact energy of the steel sheet. At this time, if the skin pass reduction rate is less than 0.4%, this effect is small, so 0.4% was set as the lower limit of the skin pass reduction rate. Also, in order to perform the skin pass rolling over 5%, it becomes necessary to rebuild the usual skin pass rolling machine, which causes an economic demerit, and remarkably degrades the workability, so 5% was set as the upper limit of the skin pass reduction rate.

For good workability of the obtained steel sheet, desirably the product of the tensile strength (TS/MPa) obtained in the usual JIS No. 5 tensile test and the overall elongation (El/%) (TS×El/Mpa %) is 19000 or more. Also, in order to manifest a good absorption of impact energy after the steel sheet is shaped to the member by the press forming and bending or hydraulic forming, desirably the ratio of volume fractions of the residual austenite before and after the addition of pre-strain of 10% in equivalent strain is 0.35 or more and a work hardening indicator of 5 to 10% after the pre-strain of 10% in equivalent strain is added is 0.130 or more.

The type of plating is not particularly limited. The effects of the present invention are obtained also by any of electrogalvanizing, hot dipping, vapor deposition plating, etc.

The steel sheet excellent in shape fixability of the present invention can be used not only for bending, but also composite shaping mainly comprised of bending, stretch forming, and deep drawing, and other types of bending work.

(6) Method of Production of Low Yield Ratio High Strength Steel Sheet

First, an explanation will be made of the slab reheating temperature. A steel slab (cast slab) adjusted to the required ingredients is cast, then hot rolled directly or after being cooled once to the $Ar_3$ transformation temperature or less, then reheated.

When the reheating temperature at this time is less than 1000° C., the hot rolling ending temperature cannot be controlled to within the temperature range of the present invention unless some sort of heating device is installed until the hot rolling is completed, so 1000° C. was set as the lower limit of the reheating temperature. Also, where the reheating temperature exceeds 1300° C., a deterioration of the yield is induced due to the generation of scale at the heating and simultaneously a rise of the production cost is induced, so 1300° C. was set as the upper limit of the reheating temperature.

Next, an explanation will be made of the hot rolling conditions.

By the hot rolling and the cooling after that, the steel sheet is controlled to the predetermined microstructure and texture. The texture of the finally obtained steel sheet largely varies according to the temperature region of the hot rolling.

When the hot rolling ending temperature becomes less than $(Ar_3-50)$° C., the amount of austenite remaining after the completion of the hot rolling is not sufficient, the microstructure control after that cannot be carried out, and a large amount of the deformed ferrite remains, so $(Ar_3-50)$° C. was set as the lower limit of the hot rolling ending temperature.

Also, the hot rolling ending temperature must be controlled to $(Ar_3+100)$° C. or less in order to obtain the intended texture.

Also, in the hot rolling, the reduction rate within a temperature range of $(Ar_3-50)$° C. to $(Ar_3+100)$° C. exerts a large influence upon the formation of the texture of the final steel sheet. When the sum of the reduction rates within this temperature range is less than 25%, the development of the texture is not sufficient, and the finally obtained steel sheet does not manifest a good shape fixability, so 25% was set as the lower limit value of the reduction rate within a temperature range of $(Ar_3-50)$° C. to $(Ar_3+100)$° C.

The intended texture develops more the higher the reduction rate, so the reduction rate is preferably 50% or more and further preferably 75% or more.

Also, the cumulative effect of the strain added in the multiple-stages of the rolling stands is important in the continuous hot rolling step. However, the higher the working temperature and the longer the traveling time between stands, the lower this cumulative effect of strain.

Where the finish hot rolling is carried out in n number of stands, when defining the rolling temperature in the i-th stand as $T_i$(K), the working strain as $\epsilon_i$ (true strain with a relationship of $\epsilon_i$=In {1/(1−ri)} with the i-th reduction rate $r_i$), and the traveling time (time between passes: second) between the i-th and i+1-th stands as $t_i$, the strain taking the cumulative effect (effective strain $\epsilon^+$) into account can be expressed by the following Equation (2):

$$\varepsilon^* = \sum_{j=1}^{n-1} \varepsilon_j \exp\left[-\sum_{i=j}^{n-1}\left(\frac{t_i}{\tau_i}\right)^{2/3}\right] + \varepsilon_n \tag{2}$$

where, $\tau_i$ can be calculated by the following equation by the gas constant R (R=1.987) and the rolling temperature Ti.

$$\tau i = 8.46\times10^{-9}\cdot\exp\{43800/R/Ti\}$$

When this effective strain $\epsilon^+$ is less than 0.4, even if the sum of the reduction rates within a temperature range of ($Ar_3$−50)° C. to ($Ar_3$+100)° C. is 25% or more, sufficient development of the texture can not be obtained. Therefore, 0.4 was set as the lower limit of the effective strain.

Where the calculation of above Equation (1) is carried out by an actual continuous hot rolling process, as Ti, use may be made of a value calculated according to:

$$Ti = FTo - (FTo - FTn)/(n+1)\times(i+1)$$

by using a finish hot rolling entry side temperature FTo and a finish rolling exit side temperature FTn.

The texture develops more the higher the effective strain, so the effective strain is more preferably 0.45 or more. Also, it is further preferred if the effective strain is 0.9 or more.

Even if the hot rolling within the temperature range of the present invention is carried out under the usual hot rolling conditions, the shape fixability of the finally obtained steel sheet is high, but when controlled so that the friction coefficient becomes 0.2 or less in at least one pass of the hot rolling performed within this temperature range, the shape fixability of the finally obtained steel sheet becomes further higher.

Also, the working, hydraulic spraying, grit blasting, and the like performed for the purpose of removing the scale before the finish hot rolling have the effect of raising the surface quality of the final steel sheet, so are preferred.

In the cooling after the hot rolling, it is most important to control the coiling temperature, but the mean cooling rate is preferably 15° C./second or more. The cooling is desirably smoothly started after the hot rolling. Also provision of air cooling in the middle of the cooling does not degrade the properties of the final steel sheet.

When the cooling is completed at the temperature To (° C.) shown in the previous described Equation (1) determined by the composition of the steel material or higher and the sheet is coiled as it is, even if the hot rolling satisfies the above hot rolling conditions, the intended texture of steel sheet does not sufficiently develop in the finally obtained steel sheet, and the shape fixability of the steel sheet is not improved. Therefore, the steel sheet is coiled at To (° C.) or less.

Also, where the coiling temperature is over 300° C., martensite is not obtained or the generated martensite is reversed and therefore the yield ratio rises and the workability of the steel sheet is degraded, so the upper limit of the coiling temperature was set as 300° C.

The lower limit of the coiling temperature is not particularly prescribed, but the lower the temperature, the better the quality. Note that setting the coiling temperature at room temperature or less induces a rise of the cost, so the coiling temperature is desirably room temperature or more.

When the steel sheet of the present invention is produced by the cold rolling and annealing, it is necessary to cause the intended texture to sufficiently develop after the hot rolling. For this purpose, it is necessary to set the heating temperature at 1000° C. to 1300° C., terminate the hot rolling at ($Ar_3$−250)° C. or more, control the effective strain $\epsilon_i$ calculated by above Equation (2) to 0.4 or more, and set the lower limit of the reduction rate within a temperature range of ($Ar_3$−250)° C. to ($Ar_3$+100)° C. at this time at 25%. The intended texture develops more the higher the reduction rate, so the reduction rate is preferably 50% or more and further preferably 75% or more.

When the total reduction rate at ($Ar_3$−250)° C. to ($Ar_3$+100)° C. exceeds 97.5%, it becomes necessary to excessively raise the rigidity of the rolling machine, which causes an economic demerit, so desirably the reduction rate is controlled to 97.5% or less.

In the hot rolling within the above temperature range, when controlled so that the friction coefficient in at least one pass becomes 0.2 or less, the shape fixability of the final steel sheet further becomes higher.

When the hot rolling ending temperature becomes less than ($Ar_3$−250)° C., due to the change of the texture after the hot rolling, finally the intended texture is not obtained. Therefore, ($Ar_3$−250)° C. was set as the lower limit of the hot rolling ending temperature. The upper limit of the hot rolling ending temperature must be set as ($Ar_3$+100)° C. in order to obtain the intended texture.

After the hot rolling, where the coiling temperature after cooling becomes over the above To (° C.), the intended texture cannot be developed by the cold rolling and annealing after that, so a good shape fixability cannot be obtained. Therefore, To (° C.) was set as the upper limit of the coiling temperature. The coiling temperature may be To (° C.) or less, but if it is less than 300° C., the deformation resistance at the time of cold rolling becomes large, so desirably the steel sheet is coiled at 300° C. or more. The working, hydraulic spraying, grit blasting, and the like performed for the purpose of removing the scale before the start of the finish hot rolling have the effect of raising the surface quality of the final steel sheet, so are preferred.

When the hot-rolled steel sheet produced by the above method is pickled by acid and then cold rolled, if the cold rolling reduction rate exceeds 95%, the load of the cold rolling increases too much, so the cold rolling is desirably carried out with a reduction rate of 95% or less. For increasing shape fixability, the cold rolling reduction rate is preferably 70% or less, and more preferably 50% or less.

The annealing after the cold rolling is carried out in the continuous annealing line. Where the annealing temperature is lower than the $Ac_1$ transformation temperature determined by the composition of the steel, martensite will not be contained in the microstructure of the final steel sheet. Therefore, the $Ac_1$ transformation temperature is set as the lower limit of the annealing temperature.

Also, when the annealing temperature exceeds the $Ac_3$ transformation temperature determined by the composition of the steel, many of the texture formed inside the steel by the hot rolling are destroyed, and the shape fixability is degraded in the finally obtained steel sheet. Therefore, the $Ac_3$ transformation temperature is set as the upper limit of the annealing temperature.

In order to achieve both the shape fixability and workability of the finally obtained steel sheet, desirably the annealing temperature is $(Ac_1+2\times Ac_3)/3$ or less.

At the cooling after annealing, where the mean cooling rate up to 500° C. is less than 1° C./second, the development of the texture of the finally obtained steel sheet is not sufficient, good shape fixability is not obtained, and martensite is not obtained, so 1° C./second was set as the lower limit of the cooling rate.

Also, setting the mean cooling rate at over 250° C./second with respect to overall sheet thickness range of 0.4 mm to 3.2 mm significant in practical use requires excessive capital investment, so 250° C./second was set as the upper limit of the cooling rate.

In this cooling, it is also possible to combine cooling at a low cooling rate of 10° C./second or less after annealing and a high cooling rate of 20° C./second or more.

The cooling stop temperature after the annealing is set as 500° C. or less in order to suppress the generation of the pearlite. The lower limit of the cooling stop temperature is not particularly determined, but is preferably set as room temperature or more from an economical viewpoint.

A faster cooling rate to 500° C. or less improves the quality of material, but after cooling to 500° C. or less, it is also possible to employ a step of gradual cooling or holding of equivalent temperature corresponding to the temperature log at the continuous annealing line or continuous hot-dipgalvanizing line or a step of reheating in the alloying line in the continuous hot-dipgalvanizing line.

The application of skin pass rolling to the steel sheet of the present invention produced by the above method before shipping not only enhances the shape of the steel sheet, but also raises the absorption of impact energy of the steel sheet. At this time, if the reduction rate in the skin pass rolling is less than 0.4%, this effect is small, so 0.4% was set as the lower limit of the reduction rate. Also, in order to perform the skin pass rolling with a reduction rate over 5%, rebuilding the usual skin pass rolling machine becomes necessary, which causes an economic demerit, and remarkably degrades the workability of the steel sheet, so 5% is set as the upper limit of the reduction rate in the skin pass rolling.

For good workability of the obtained steel sheet, the yield ratio (YS/TS×100), that is, the ratio of the tension strength (TS/MPa) obtained by the usual JIS No. 5 tensile test and the yield strength (0.2% yield strength YS), is desirably 70% or less. Also, a yield ratio of 65% or less is desirable since the shape fixability can be further improved.

The type and method of plating are not particularly limited. The effects of the present invention are obtained by using any of electrogalvanizing, hot dipping, and vapor deposition plating.

The steel sheet of the present invention can be used not only for bending, but also composite shaping mainly comprised of bending, stretch forming, and deep drawing, and other types of bending work.

(7) Method of Production of Ferritic Steel Sheet (C)

A method of production of ferritic steel sheet having the crystal orientation of {112}<110> as a peak texture of the predetermined X-ray intensity level defined in the present invention is as follows.

The method of production of the steel preceding the hot rolling is not particularly limited. Namely, subsequent to the melting and refining by a blast furnace or electric furnace etc., various secondary refining operations may be carried out and then the steel continuously cast by an ordinary method, cast by the ingot method, or cast into thin slabs. In the case of continuous casting, the steel may be once cooled to a low temperature and then heated again and hot rolled or the cast slab may be continuously hot rolled. It is also possible to use scrap as the starting material.

In the latter half of the hot rolling, if rolling with a total reduction rate of 25% or more is not carried out at the $Ar_3$ transformation temperature to $(Ar_3+100)$° C., the texture of the rolled austenite does not sufficiently develop, and even if cooling is applied, the crystal orientation of the predetermined X-ray intensity level defined in the present invention cannot be obtained the finally obtained steel sheet.

Accordingly, the lower limit of the sum of reduction rates at the $Ar_3$ transformation temperature to $(Ar_3+100)$° C. was set as 25%.

The higher the total reduction rate at the $Ar_3$ transformation temperature to $(Ar_3+100)$° C., the sharper the texture that can be expected to be formed, so preferably it is controlled to 35% or more, but if the sum of the reduction rates exceeds 97.5%, it is necessary to excessively raise the rigidity of the rolling machine, which causes an economic demerit, so it is desirably controlled to 97.5% or less.

If the hot rolling ending temperature is lower than the $Ar_3$ transformation temperature, the phenomenon where the {112}<110> orientation particularly develops in the group of {100}<011> to {223}<110> orientations is no longer manifested, while if it exceeds ($Ar_3$ transformation temperature+100)° C., the overall texture is randomized and the shape fixability is degraded. Therefore, the hot rolling ending temperature is limited to $Ar_3$ transformation temperature to ($Ac_3$ transformation temperature+100)° C.

In the hot rolling at the $Ac_3$ transformation temperature to $(Ar_3+100)$° C., when the friction coefficient of the hot rolling roll and the steel sheet exceeds 0.2, a crystal orientation mainly comprised of the {110} plane develops at the sheet face in the vicinity of the surface of the steel sheet, and the shape fixability is degraded. Therefore, when a better shape fixability is intended, desirably the friction coefficient of the hot rolling roll and the steel sheet is controlled to 0.2 or less for at least one pass in the hot rolling at the $Ar_3$ transformation temperature to $(Ar_3+100)$° C.

This friction coefficient is preferably as low as possible. The lower limit is not determined, but where a further better shape fixability is required, desirably the friction coefficient is controlled to 0.15 or less for all passes of the hot rolling at the $Ar_3$ transformation temperature to $(Ar_3+100)$° C. The friction coefficient is found from the advancing rate and the rolling load as conventionally well known.

In order to get the final hot-rolled steel sheet to succeed to the texture of the austenite formed in this way, it is necessary to cool the steel sheet from the hot rolling ending temperature to To (° C.) at a mean cooling rate of 10° C./s or more and coil it at To (° C.) or less.

This To (° C.) is thermodynamically defined as the temperature at which austenite and ferrite comprised of identical ingredients to those of the austenite have the identical free energy and can be simply calculated by the composition (weight %) of the steel sheet by using the previous described Equation (1) while taking also the influence of the ingredients other than C into account.

After the end of the hot rolling, the steel sheet is cooled to the critical temperature To and coiled. The lower limit of the mean cooling rate is set as 10° C./s or more. Preferably, it is 30° C./s or more, and further preferably 50° C./s or more. On the other hand, it is difficult to control the mean cooling rate to over 200° C./s in practical use, so the mean cooling rate is set as 10 to 200° C./s. Also, the lower limit of the coiling temperature is not particularly limited, but even if it is made lower than 250° C., only the workability is degraded and no special effect is obtained, so the steel sheet is desirably coiled at 250° C. or more.

In the hot rolling, it is also possible to perform rough rolling, then connect sheet bars and continuously perform the finish rolling. At that time, it is also possible to coil the rough bars once into coil shapes, store them in covers having a heat insulation function according to need, and, then uncoiled and connect them. It is also possible to perform skin pass rolling on the hot rolled steel sheet according to need. The skin pass rolling has the effects of preventing stretcher strain occurring at the time of working and shaping and correction of the shape.

When the hot-rolled steel sheet obtained in this way is cold rolled and then annealed to obtain a final steel sheet, if the total reduction rate of the cold rolling becomes 80% or more, the components of the {111} plane and {554} plane become high in an X-ray diffraction integration plane intensity ratio of the crystal plane parallel to the sheet face of a general cold-rolled recrystallized texture, so the requirement relating to the crystal orientation defined in the present invention is no longer satisfied. Therefore, the upper limit of the reduction rate in the cold rolling was set as 80%. In order to raise the shape fixability, desirably the cold rolling reduction rate is restricted to 70% or less, preferably 50% or less, and more preferably 30% or less.

At the time of annealing the cold-rolled steel sheet cold worked within such a range of reduction rate, if the annealing temperature is less than 600° C., the deformed microstructure remains and the formability is remarkably degraded, so the lower limit of the annealing temperature is set as 600° C. On the other hand, when the annealing temperature is excessively high, the texture of ferrite generated by the recrystallization is randomized by the grain growth of the austenite after the transformation to austenite, and also the finally obtained texture of ferrite is randomized. Particularly, such a tendency becomes conspicuous when the annealing temperature exceeds $(Ac_3+100)$° C., so the annealing temperature is set as $(Ac_3+100)$° C. or less. It is also possible if the skin pass rolling is applied to the cold-rolled steel sheet according to need.

The microstructure obtained in the present invention is mainly comprised of ferrite, but it is also possible to include pearlite, bainite, martensite and/or austenite as the microstructure other than the ferrite. Further it is also possible if a compound such as a carbonitride is contained. Particularly, the crystal structure of martensite or bainite is equivalent to or resembles the crystal texture of ferrite, so there is no difficulty even if these phases form the main components in place of the ferrite.

Note that the steel sheet according to the present invention can be used not only for bending, but also composite shaping mainly comprised of bending, stretch forming, and deep drawing, and other types of bending work.

(8) Method of Production of Ferritic Steel Sheet (D)

A method of production of ferritic steel sheet having the crystal orientation of {100}<011> as a peak texture of the predetermined X-ray intensity level defined in the present invention is as follows.

The method of production of the steel preceding the hot rolling is not particularly limited. Namely, subsequent to the melting and refining by a blast furnace or electric furnace etc., various secondary refining operations may be carried out and then the steel continuously cast by an ordinary method, cast by the ingot method, or cast into thin slabs. In the case of continuous casting, the steel may be once cooled to a low temperature and then heated again and hot rolled or the cast slab may be continuously hot rolled. It is also possible to use scrap as the starting material.

The ferritic steel sheet excellent in shape fixability of the present invention may also be obtained by casting steel having the above composition, then hot rolling and then cooling it; hot rolling, then cooling it or pickling it by acid, then heat treating it; hot rolling it, then cooling and acid pickling, cold rolling, then annealing it; or heat treating the hot-rolled steel sheet or cold-rolled steel sheet in a hot dipping line; or by applying separate surface treatment to the steel sheet.

In the latter half of the hot rolling, where roiling with a total reduction rate of 25% or more is not carried out at $(Ar_3+50)$° C. to $(Ar_3+150)$° C., the working of the austenite becomes insufficient, and the texture does not sufficiently develop, therefore, even if cooling is applied, the crystal orientation of the predetermined X-ray intensity level prescribed in the present invention cannot be obtained the finally obtained hot-rolled steel sheet. Therefore, the lower limit of the sum of reduction rates at $(Ar_3+50)$° C. to $(Ar_3+150)$° C. was set as 25%.

The higher the total reduction rate at $(Ar_3+50)$° C. to $(Ar_3+150)$° C., the sharper the texture that can be expected to be formed, so preferably the above reduction rate is controlled to 35% or more, but if the sum of the reduction rates exceeds 97.5%, it is necessary to excessively raise the rigidity of the rolling machine, which causes an economic demerit, so it is desirably controlled to 97.5% or less.

In order to remarkably raise the integration of the texture to the {100}<011> orientation, it is extremely important to further apply reduction of 5 to 35% at $(Ar_3-100)$ to $(Ar_3+50)$° C.

This is because, it is extremely important for the development of the {100}<011> orientation to apply an appropriate amount of reduction with respect to the austenite sufficiently worked in the high temperature zone in a state where it is at least partially recrystallized and achieve the ferrite transformation immediately after that. Then, even if the reduction is performed at less than $(Ar_3-100)$° C., the region where the ferrite transformation has been already completed is too large, so the {100}<011> orientation does not develop.

When the reduction is applied at over $(Ar_3+50)$° C., the strain introduced until the ferrite transformation ends up reverting, therefore the {100}<011> orientation does not develop. Also, if the reduction rate is less than 5%, the overall texture containing {100}<011> to {223}<110> is randomized, while if it exceeds 35%, the degree of integration to the {100}<011> orientation becomes low, so the reduction rate within a temperature range of $(Ar_3-100)$ to $(Ar_3+50)$° C. is controlled to 5 to 35%. Note that the reduction rate is desirably controlled to 10 to 25%.

The hot rolling is terminated within a temperature range of $(Ar_3-100)$ to $(Ar_3+50)$° C. When the hot rolling ending temperature becomes less than $(Ar_3-100)$° C., the workability is remarkably degraded, while when it becomes over $(Ar_3+50)$° C., the integration of the texture becomes insufficient, and the shape fixability is degraded.

Here, in the hot rolling within a temperature range of $(Ar_3-100)$ to $(Ar_3+150)$° C., where the friction coefficient of the hot rolling roll and the steel sheet exceeds 0.2, a crystal orientation mainly comprised of the {110} plane develops at the sheet face in the vicinity of the surface of the steel sheet, and the shape fixability is degraded. Therefore, when a better shape fixability is intended, desirably the friction coefficient of the hot rolling roll and the steel sheet is controlled to 0.2 or less for at least one pass in the hot rolling.

This friction coefficient is preferably as low as possible. The lower limit is not determined, but where a further better shape fixability is required, desirably the friction coefficient is controlled to 0.15 or less. The friction coefficient is found from the rate of advance and the rolling load as is conventionally well known.

In order to get the final hot-rolled steel sheet to succeed to the texture of the austenite formed in this way, it is necessary to cool the steel sheet from the hot rolling finishing temperature to To (° C.), as previous described Equation (1), at a mean cooling rate of 10° C./s or more and coil it at To (° C.) or less.

Also, the lower limit of the coiling temperature or the cooling stop temperature is not particularly limited, but even if it is made lower than 250° C., only the workability is degraded and no special effect is obtained, so desirably the sheet is coiled at 250° C. or more or the cooling is stopped at 250° C. or more.

Where the cooling is carried out, the larger the cooling rate, the sharper the texture, so desirably the cooling rate is controlled to 10° C./s or more.

After cooling, if the deformed ferrite as it is remains, the mechanical properties are degraded. Accordingly, preferably additional heat treatment for the purpose of recovery and recrystallization is carried out. The temperature range thereof is set as 300° C. to the $Ac_1$ transformation temperature. If the heat treatment temperature is less than 300° C., the recovery and recrystallization do not proceed, and the mechanical properties are degraded. Also, when the heat treatment temperature becomes over the $Ac_1$ transformation temperature, the texture formed during the hot rolling breaks, and the shape fixability is degraded.

When the hot-rolled steel sheet obtained in this way (or the heat treated hot-rolled steel sheet) is cold rolled and then annealed to obtain a final steel sheet, if the total reduction rate of the cold rolling becomes 80% or more, the components of the {111} plane and {554} plane become high in an X-ray diffraction integration plane intensity ratio of the crystal plane parallel to the sheet face of a general cold-rolled recrystallized texture, so the requirement relating to the crystal orientation defined in the present invention is no longer satisfied. Therefore, the upper limit of the reduction rate in the cold rolling was set as 80%.

In order to raise the shape fixability, desirably the cold rolling reduction rate is restricted to 70% or less, preferably 50% or less, and more preferably 30% or less.

At the time of annealing the cold-rolled steel sheet cold worked within such a range of reduction rate, if the annealing temperature is less than 600° C., the worked microstructure remains and the formability is remarkably degraded, so the lower limit of the annealing temperature is set as 600° C. On the other hand, when the annealing temperature is excessively high, the texture of ferrite generated by the recrystallization is randomized by the grain growth of the austenite after the transformation to austenite, and also the finally obtained texture of ferrite is randomized.

Particularly, such a tendency becomes conspicuous when the annealing temperature exceeds $(Ac_3+100)$° C., so the annealing temperature is set as $(Ac_3+100)$° C. or less. It is also possible if the skin pass rolling is applied to the cold-rolled steel sheet according to need.

The structure obtained in the present invention is mainly comprised of ferrite, but it is also possible to include pearlite, bainite, martensite and/or austenite as the microstructure other than the ferrite. Further it is also possible if a compound such as a carbonitride is contained. Particularly, the crystal structure of martensite or bainite is equivalent to or resembles the crystal structure of ferrite, so there is no difficulty even if these phases form the main components in place of the ferrite.

Note that the steel sheet according to the present invention can be used not only for bending, but also composite shaping mainly comprised of bending, stretch forming, and deep drawing, and other types of bending work.

Also, the cumulative effect of the strain added in the multiple-stages of the rolling stands is important in the continuous hot rolling step. However, the higher the working temperature and the longer the traveling time between stands, the lower this cumulative effect of strain.

Where the finish hot rolling is carried out in n number of stands, when defining the rolling temperature in the i-th stand as $T_i$(K), the working strain as $\epsilon_i$ (true strain with a relationship of $\epsilon_i$=In {1/(1−ri)} with the i-th reduction rate $r_i$), and the traveling time (time between passes: second) between the i-th and i+1-th stands as $t_i$, the strain taking the cumulative effect (effective strain $\epsilon^+$) into account can be expressed by the following Equation (2):

$$\varepsilon^* = \sum_{j=1}^{n-1} \varepsilon_j \exp\left[-\sum_{i=j}^{n-1}\left(\frac{t_i}{\tau_i}\right)^{2/3}\right] + \varepsilon_n \tag{2}$$

where, $\tau_i$ can be calculated by the following equation by the gas constant R (R=1.987) and the rolling temperature Ti.

$$\tau i = 8.46\times10^{-9}\cdot\exp\{43800/R/Ti\}$$

When this effective strain $\epsilon^+$ is less than 0.4, even if the sum of the reduction rates within a temperature range of $(Ar_3-100)$° C. to $(Ar_3+100)$° C. is 25% or more, sufficient development of the texture can not be obtained. Therefore, 0.4 was set as the lower limit of the effective strain.

Where the calculation of above Equation (1) is carried out by an actual continuous hot rolling process, as Ti, use may be made of a value calculated according to:

$$Ti = FTo-(FTo-FTn)/(n+1)\times(i+1)$$

by using a finish hot rolling entry side temperature FTo and a finish rolling exit side temperature FTn.

The texture develops more the higher the effective strain, so the effective strain is more preferably 0.45 or more. Also, it is further preferred if the effective strain is 0.9 or more.

The type and method of plating are not particularly limited. The effects of the present invention are obtained by using any of electrogalvanizing, hot dipping, and vapor deposition plating.

Below, an explanation will be made of examples of the present invention.

EXAMPLE 1

Next, an explanation will be made of results of a study using steels of A to L having compositions shown in Table 1. These steels were cast, then hot rolled as they were, or else after being cooled once to room temperature and then reheated to a temperature range of 900° C. to 1300° C., to be finally rolled to 1.4 mm thick, 3.0 mm thick, or 8.0 mm thick hot-rolled steel sheets. The 3.0 mm thick and 8.0 mm thick hot-rolled steel sheets were cold rolled to obtain 1.4 mm thick cold-rolled steel sheets, then were annealed in a continuous annealing step.

A 90 degrees bending test was carried out on these 1.4 mm thick test pieces according to the U-bending test method disclosed in Seita Yoshida sup., *Press Forming Handbook* (published by Nikkan Kogyo Shimbunsha, 1987), pages 417 to 418. The shape fixability was evaluated according to the opening angle minus the 90 degrees (springback). Note that the bending was carried out so the fold was vertical to the direction where the r value is low. The production conditions relating to the steel sheets (test pieces) are shown in Table 2.

In Table 2, whether or not the production conditions of the steel sheets are within the range of the production conditions of the present invention is shown in the column "Class of invention".

TABLE 1

| Steel type | C | Si | Mn | P | S | Al | Ti | Nb | V | Cr | B | N | O | Sn | Class |
|---|---|---|---|---|---|---|---|---|---|---|---|---|---|---|---|
| A | 0.0018 | 0.01 | 0.11 | 0.011 | 0.007 | 0.044 | 0.057 | — | — | — | 0.0004 | 0.0022 | 0.002 | — | Steel of invention |
| B | 0.041 | 0.02 | 0.29 | 0.012 | 0.004 | 0.012 | — | — | — | — | 0.0019 | 0.0020 | 0.004 | — | Steel of invention |
| C | 0.088 | 0.03 | 0.82 | 0.022 | 0.003 | 0.050 | — | — | — | — | — | 0.0026 | 0.002 | — | Steel of invention |
| D | 0.068 | 0.04 | 1.70 | 0.015 | 0.006 | 0.055 | — | — | — | — | — | 0.0023 | 0.002 | — | Steel of invention |
| E | 0.154 | 0.33 | 2.21 | 0.025 | 0.012 | 0.034 | — | — | — | — | — | 0.0018 | 0.002 | — | Steel of invention |
| F | 0.161 | 0.60 | 2.84 | 0.007 | 0.009 | 0.022 | 0.058 | 0.010 | — | — | — | 0.0022 | 0.003 | — | Comparative steel |
| G | 0.028 | 0.02 | 0.25 | 0.071 | 0.006 | 0.020 | — | — | — | — | 0.0024 | 0.0021 | 0.004 | — | Steel of invention |
| H | 0.0023 | 0.02 | 0.83 | 0.079 | 0.008 | 0.043 | 0.031 | 0.009 | — | — | — | 0.0024 | 0.003 | — | Steel of invention |
| I | 0.18 | 1.72 | 1.99 | 0.015 | 0.002 | 0.044 | — | — | — | — | — | 0.0028 | 0.002 | — | Steel of invention |
| J | 0.12 | 1.16 | 1.52 | 0.018 | 0.006 | 0.037 | 0.026 | — | — | — | — | 0.0024 | 0.001 | — | Steel of invention |
| K | 0.11 | 1.50 | 1.06 | 0.006 | 0.009 | 0.056 | — | — | — | 0.22 | — | 0.0033 | 0.002 | — | Steel of invention |
| L | 0.14 | 1.30 | 1.15 | 0.022 | 0.015 | 0.023 | — | 0.035 | — | — | — | 0.0026 | 0.002 | 0.02 | Steel of invention |

TABLE 2

| | | Hot rolling conditions | | | Presence of additional | Cold rolling and annealing conditions | | |
|---|---|---|---|---|---|---|---|---|
| Steel type | Class of steel sheet | Hot rolling temperature 1 | Hot rolling temperature 2 | Lubrication | heat treatment after hot rolling | Cold rolling reduction rate | Annealing temperature | Class of invention |
| A | −1 Cold rolled | ○ | — | Δ | No | x | ○ | Outside invention |
| | −2 Cold rolled | ○ | — | Δ | No | ○ | ○ | Present invention |
| | −3 Hot rolled | ○ | — | Δ | No | — | — | Present invention |
| | −4 Hot rolled | x | — | Δ | No | — | — | Outside invention |
| B | −1 Cold rolled | ○ | — | Δ | No | x | ○ | Outside invention |
| | −2 Cold rolled | ○ | — | Δ | No | ○ | ○ | Present invention |
| | −3 Hot rolled | ○ | — | Δ | No | — | — | Present invention |
| | −4 Hot rolled | x | — | Δ | No | — | — | Outside invention |
| C | −1 Cold rolled | — | x | Δ | Yes | ○ | x | Outside invention |
| | −2 Cold rolled | — | ○ | Δ | Yes | ○ | ○ | Present invention |
| | −3 Hot rolled | — | ○ | Δ | Yes | — | — | Present invention |
| | −4 Hot rolled | — | x | Δ | Yes | — | — | Outside invention |
| D | −1 Cold rolled | x | — | Δ | No | x | ○ | Outside invention |
| | −2 Cold rolled | ○ | — | ○ | No | ○ | ○ | Present invention |
| | −3 Hot rolled | — | ○ | ○ | No | — | — | Present invention |
| | −4 Hot rolled | — | x | Δ | No | — | — | Outside invention |
| E | −1 Cold rolled | ○ | — | ○ | No | ○ | x | Outside invention |
| | −2 Cold rolled | ○ | — | ○ | No | ○ | ○ | Present invention |
| | −3 Hot rolled | ○ | — | ○ | No | — | — | Present invention |
| | −4 Hot rolled | x | — | Δ | No | — | — | Outside invention |
| F | −1 Cold rolled | ○ | — | Δ | No | x | x | Outside invention |
| | −2 Cold rolled | ○ | — | Δ | No | ○ | ○ | Outside invention |
| | −3 Hot rolled | ○ | — | Δ | No | — | — | Outside invention |
| | −4 Hot rolled | x | — | Δ | No | — | — | Outside invention |
| G | −1 Cold rolled | — | x | Δ | No | ○ | x | Outside invention |
| | −2 Cold rolled | — | ○ | ○ | No | ○ | ○ | Present invention |
| | −3 Hot rolled | ○ | — | ○ | No | — | — | Present invention |
| | −4 Hot rolled | x | — | Δ | No | — | — | Outside invention |
| H | −1 Cold rolled | — | x | ○ | No | ○ | x | Outside invention |
| | −2 Cold rolled | — | ○ | ○ | No | ○ | ○ | Present invention |
| | −3 Hot rolled | — | ○ | ○ | No | — | — | Present invention |
| | −4 Hot rolled | — | x | ○ | No | — | — | Outside invention |
| I | −1 Cold rolled | — | x | ○ | Yes | ○ | ○ | Outside invention |
| | −2 Cold rolled | — | ○ | ○ | Yes | ○ | ○ | Present invention |
| | −3 Hot rolled | — | ○ | ○ | Yes | — | — | Present invention |
| | −4 Hot rolled | — | x | ○ | Yes | — | — | Outside invention |
| J | −1 Cold rolled | ○ | — | ○ | No | x | ○ | Outside invention |
| | −2 Cold rolled | ○ | — | ○ | No | ○ | ○ | Present invention |
| | −3 Hot rolled | ○ | — | ○ | No | — | — | Present invention |
| | −4 Hot rolled | x | — | Δ | No | — | — | Outside invention |

TABLE 2-continued

| Steel type | Class of steel sheet | Hot rolling conditions: Hot rolling temperature 1 | Hot rolling temperature 2 | Lubrication | Presence of additional heat treatment after hot rolling | Cold rolling and annealing conditions: Cold rolling reduction rate | Annealing temperature | Class of invention |
|---|---|---|---|---|---|---|---|---|
| K | −1 Cold rolled | ○ | — | ○ | No | x | ○ | Outside invention |
| | −2 Cold rolled | ○ | — | ○ | No | ○ | ○ | Present invention |
| | −3 Hot rolled | ○ | — | ○ | No | — | — | Present invention |
| | −4 Hot rolled | x | — | Δ | No | — | — | Outside invention |
| L | −1 Cold rolled | x | — | Δ | Yes | ○ | x | Outside invention |
| | −2 Cold rolled | ○ | — | ○ | Yes | ○ | ○ | Present invention |
| | −3 Hot rolled | — | ○ | ○ | Yes | — | — | Present invention |
| | −4 Hot rolled | — | x | Δ | Yes | — | — | Outside invention |

For the "Hot rolling temperature 1", when the hot rolling was completed at the $Ar_3$ transformation temperature or more, a case where the sum of the reduction rates at $(Ar_3+100)°$ C. toi $Ar_3$ temperature was 25% or more was evaluated as "O" ("good") and a case where it was less than 25% was evaluated as "X" ("poor"). For the "Hot rolling temperature 2". when the hot rolling was performed at the $Ar_3$ transformation temperature or less, a case where the sum of the reduction rates at the $Ar_3$ temperature or less was 25% or more was evaluated as "O" ("good") and a case where it was less than 25% was evaluated as "X" ("poor"). In any case, when the friction coefficient for at least one pass within each temperature range was 0.2 or less, "O" ("good") was entered in the column of "Lubrication", while when the friction coefficient in all passes exceeded 0.2, "Δ" ("fair") was entered. The coiling after the hot rolling was performed at the To temperature found by the above Equation (1) or less for all. When such a hot-rolled steel sheet was cold rolled to 1.4 mm thickness, when the cold rolling reduction rate was 80% or more, the "Cold rolling reduction rate" was evaluated as "X" ("poor"), while the case of "Less than 80%" was evaluated as "O" ("good"). Also, where the annealing temperature was 600° C. to $(Ac_3+100)°$ C., the "Annealing temperature" was evaluated as "O" ("good"), while cases other than the former were evaluated as "X" ("poor"). Items not related as production conditions were indicated by "-".

Skin pass rolling was applied to both the hot-rolled steel sheets and the cold-rolled steel sheets within a range of 0.5 to 1.5%.

The X-ray measurement was performed by preparing a sample parallel to the sheet face at a position of 7/16 sheet thickness as a representative value of the steel sheet.

The mechanical properties and springbacks of the 1.4 mm thick hot-rolled steel sheet and the cold-rolled steel sheet produced by the above method are shown in Table 4 and Table 5 (continuation of Table 4). In Table 4 and Table 5, in all steel types except the steel type L, examples according to the steel types of numbers "-2", and "-3" correspond to the present invention. In them, the springback becomes small in comparison with those of numbers "-1" and "-4" outside the invention. Namely, in ferritic steel sheet, good shape fixability is achieved first by obtaining the X-ray random intensity ratios and r values of the crystal orientations limited in the present invention.

The mechanism behind the importance of the X-ray random intensity ratio and r value of the crystal orientation in the shape fixability is not clear at the present. Probably, the springback at the time of bending deformation becomes small since the progress of slip deformation becomes easy at the time of bending deformation.

TABLE 3

| Steel type | Class of steel sheet | Tensile properties: Yield strength (MPa) | Tensile strength (MPa) | Elongation (%) | rL | rC | X-ray mean intensity ratio of {001}<110> to {223}<110> orientation group | X-ray mean intensity ratio of {554}<225>, {111}<112>, {111}<110> | Springback (°) | Class of invention |
|---|---|---|---|---|---|---|---|---|---|---|
| A | −1 Cold rolled | 146 | 288 | 57 | 2.21 | 2.73 | 1.2 | 9.3 | 7.0 | Outside invention |
| | −2 Cold rolled | 161 | 294 | 54 | 0.62 | 1.39 | 4.2 | 2.9 | 3.8 | Present invention |
| | −3 Hot rolled | 155 | 290 | 55 | 0.54 | 0.67 | 5.0 | 2.7 | 3.1 | Present invention |
| | −4 Hot rolled | 164 | 299 | 58 | 0.84 | 0.77 | 2.4 | 1.9 | 6.2 | Outside invention |
| B | −1 Cold rolled | 170 | 325 | 46 | 0.95 | 1.13 | 1.3 | 1.7 | 8.7 | Outside invention |
| | −2 Cold rolled | 165 | 319 | 48 | 0.63 | 1.23 | 3.4 | 2.4 | 5.0 | Present invention |
| | −3 Hot rolled | 176 | 330 | 45 | 0.56 | 0.63 | 5.6 | 1.4 | 4.6 | Present invention |
| | −4 Hot rolled | 175 | 331 | 45 | 0.78 | 0.90 | 2.0 | 1.6 | 8.5 | Outside invention |
| C | −1 Cold rolled | 487 | 554 | 14 | 0.88 | 0.95 | 3.1 | 2.6 | 15.2 | Outside invention |
| | −2 Cold rolled | 364 | 515 | 33 | 0.60 | 0.65 | 5.0 | 2.9 | 7.7 | Present invention |
| | −3 Hot rolled | 348 | 500 | 35 | 0.51 | 0.55 | 7.8 | 1.1 | 6.6 | Present invention |
| | −4 Hot rolled | 365 | 520 | 32 | 0.78 | 0.99 | 2.6 | 1.7 | 11.3 | Outside invention |
| D | −1 Cold rolled | 376 | 625 | 31 | 1.05 | 1.15 | 2.4 | 2.8 | 12.7 | Outside invention |
| | −2 Cold rolled | 335 | 634 | 32 | 0.69 | 0.76 | 4.0 | 2.3 | 7.7 | Present invention |
| | −3 Hot rolled | 340 | 631 | 32 | 0.40 | 0.52 | 8.1 | 1.8 | 7.1 | Present invention |
| | −4 Hot rolled | 344 | 632 | 32 | 0.79 | 0.90 | 3.1 | 1.6 | 11.8 | Outside invention |

TABLE 3-continued

| Steel type | Class of steel sheet | Tensile properties: Yield strength (MPa) | Tensile strength (MPa) | Elongation (%) | rL | rC | X-ray mean intensity: ratio of {001}<110> to {223}<110> orientation group | X-ray mean intensity: ratio of {554}<225>, {111}<112>, {111}<110> | Springback (°) | Class of invention |
|---|---|---|---|---|---|---|---|---|---|---|
| E −1 | Cold rolled | 910 | 1032 | 6 | * | * | 4.8 | 3.6 | 27.1 | Outside invention |
| −2 | Cold rolled | 735 | 1084 | 16 | 0.66 | 0.74 | 4.2 | 2.2 | 22.0 | Present invention |
| −3 | Hot rolled | 740 | 1111 | 15 | 0.26 | 0.42 | 8.7 | 0.9 | 20.4 | Present invention |
| −4 | Hot rolled | 726 | 1084 | 16 | 0.69 | 0.82 | 2.9 | 2.6 | 24.3 | Outside invention |
| F −1 | Cold rolled | 1150 | 1241 | 3 | * | * | 4.0 | 3.3 | # | Outside invention |
| −2 | Cold rolled | 1063 | 1205 | 6 | * | * | 5.6 | 2.8 | 28.1 | Outside invention |
| −3 | Hot rolled | 1130 | 1269 | 5 | * | * | 7.0 | 1.9 | 27.9 | Outside invention |
| −4 | Hot rolled | 1118 | 1213 | 5 | * | * | 3.8 | 2.3 | 28.3 | Outside invention |
| G −1 | Cold rolled | 287 | 364 | 13 | 0.85 | 1.21 | 6.5 | 3.6 | 8.8 | Outside invention |
| −2 | Cold rolled | 245 | 360 | 41 | 0.34 | 0.47 | 10.1 | 0.4 | 4.7 | Present invention |
| −3 | Hot rolled | 260 | 377 | 40 | 0.59 | 0.64 | 7.6 | 1.5 | 5.2 | Present invention |
| −4 | Hot rolled | 265 | 381 | 39 | 0.88 | 0.84 | 1.2 | 0.8 | 7.0 | Outside invention |
| H −1 | Cold rolled | 356 | 404 | 8 | * | * | 6.4 | 4.2 | 13.6 | Outside invention |
| −2 | Cold rolled | 236 | 388 | 40 | 0.70 | 1.38 | 3.4 | 3.3 | 7.6 | Present invention |
| −3 | Hot rolled | 283 | 410 | 33 | 0.65 | 0.89 | 5.1 | 3.2 | 8.0 | Present invention |
| −4 | Hot rolled | 249 | 402 | 38 | 0.85 | 1.03 | 2.4 | 1.9 | 11.2 | Outside invention |
| I −1 | Cold rolled | 543 | 821 | 32 | 0.79 | 0.80 | 2.4 | 1.5 | 17.8 | Outside invention |
| −2 | Cold rolled | 539 | 815 | 33 | 0.65 | 0.61 | 4.0 | 2.0 | 14.8 | Present invention |
| −3 | Hot rolled | 515 | 799 | 34 | 0.64 | 0.77 | 4.4 | 2.3 | 13.5 | Present invention |
| −4 | Hot rolled | 532 | 820 | 32 | 0.80 | 0.91 | 2.7 | 2.2 | 19.6 | Outside invention |
| J −1 | Cold rolled | 442 | 629 | 35 | 0.91 | 0.95 | 2.5 | 3.1 | 14.6 | Outside invention |
| −2 | Cold rolled | 430 | 618 | 36 | 0.65 | 0.79 | 3.3 | 2.5 | 11.0 | Present invention |
| −3 | Hot rolled | 456 | 630 | 34 | 0.59 | 0.64 | 4.4 | 1.9 | 10.2 | Present invention |
| −4 | Hot rolled | 460 | 634 | 34 | 0.76 | 0.81 | 2.7 | 1.8 | 15.2 | Outside invention |
| K −1 | Cold rolled | 487 | 598 | 36 | 1.01 | 0.97 | 2.8 | 3.6 | 13.7 | Outside invention |
| −2 | Cold rolled | 471 | 590 | 37 | 0.67 | 0.76 | 3.8 | 2.0 | 10.6 | Present invention |
| −3 | Hot rolled | 494 | 601 | 35 | 0.40 | 0.59 | 5.0 | 0.8 | 9.1 | Present invention |
| −4 | Hot rolled | 485 | 604 | 35 | 0.72 | 0.81 | 1.8 | 1.5 | 14.0 | Outside invention |
| L −1 | Cold rolled | 581 | 655 | 7 | * | * | 4.6 | 2.5 | # | Outside invention |
| −2 | Cold rolled | 471 | 630 | 36 | 0.70 | 0.72 | 3.9 | 3.0 | 11.4 | Present invention |
| −3 | Hot rolled | 467 | 625 | 37 | 0.56 | 0.65 | 6.1 | 1.2 | 8.9 | Present invention |
| −4 | Hot rolled | 459 | 631 | 38 | 0.75 | 1.02 | 2.7 | 3.0 | 13.5 | Outside invention |

*: Uniform elongation was small and r value could not be measure
#: Cracked

EXAMPLE 2

An explanation will be made of results of a study using steels of A to G having compositions shown in Table 4. These steels were cast, then hot rolled as they were or after once cooling to room temperature, then reheating to a temperature range of 1100° C. to 1300° C., to be finally rolled to 1.4 mm thick, 3.0 mm thick, or 8.0 mm thick hot-rolled steel sheets. The 3.0 mm thick and 8.0 mm thick hot-rolled steel sheets were cold rolled to obtain 1.4 mm thick cold-rolled steel sheets, then were annealed in a continuous annealing step. Test pieces having a width of 50 mm and a length of 270 mm were prepared from these 1.4 mm thick steel sheets, and a hat bending test was carried out by using a die having a punch width of 78 mm, punch shoulder R5, and die shoulder R5. For the test pieces subjected to the bending test, the shapes at the center of the sheet width were measured by a three-dimensional shape measurement device. As shown in FIG. 1, the shape fixability was evaluated by defining mean values at the left and right of the value obtained by subtracting 90° from the angle of the intersecting point of a tangent of a point (1) and a point (2) and the tangent of a point (3) and a point (4) as the springback, a value obtained by averaging reciprocals of the curvature between the point (3) and a point (5) on the left and right as the wall camber, and a value obtained by subtracting the punch width from the length between left and right points (5) as the dimensional accuracy. Note that the bending was carried out so-that the fold was vertical to the direction where the r value is low.

Figure 2:
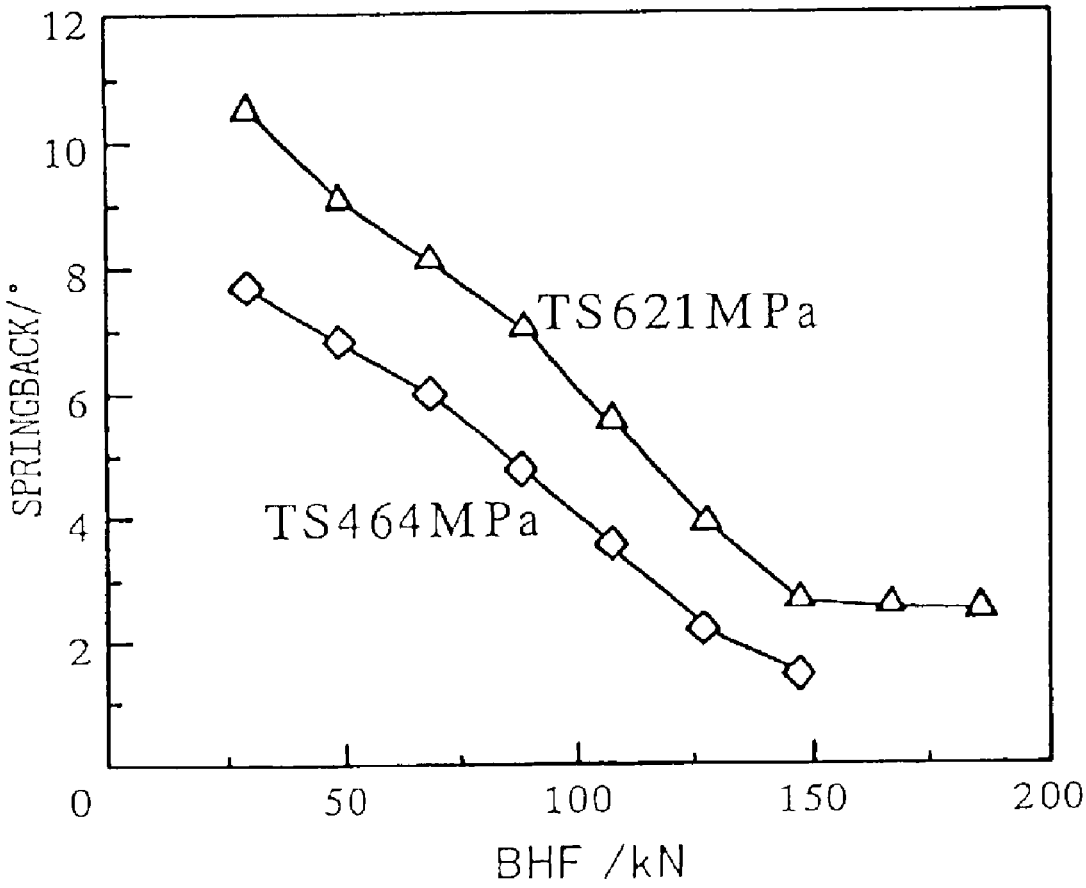
FIG. 2 is a graph showing a relationship between a springback and BHF (blanking holding force).
Figure 3:
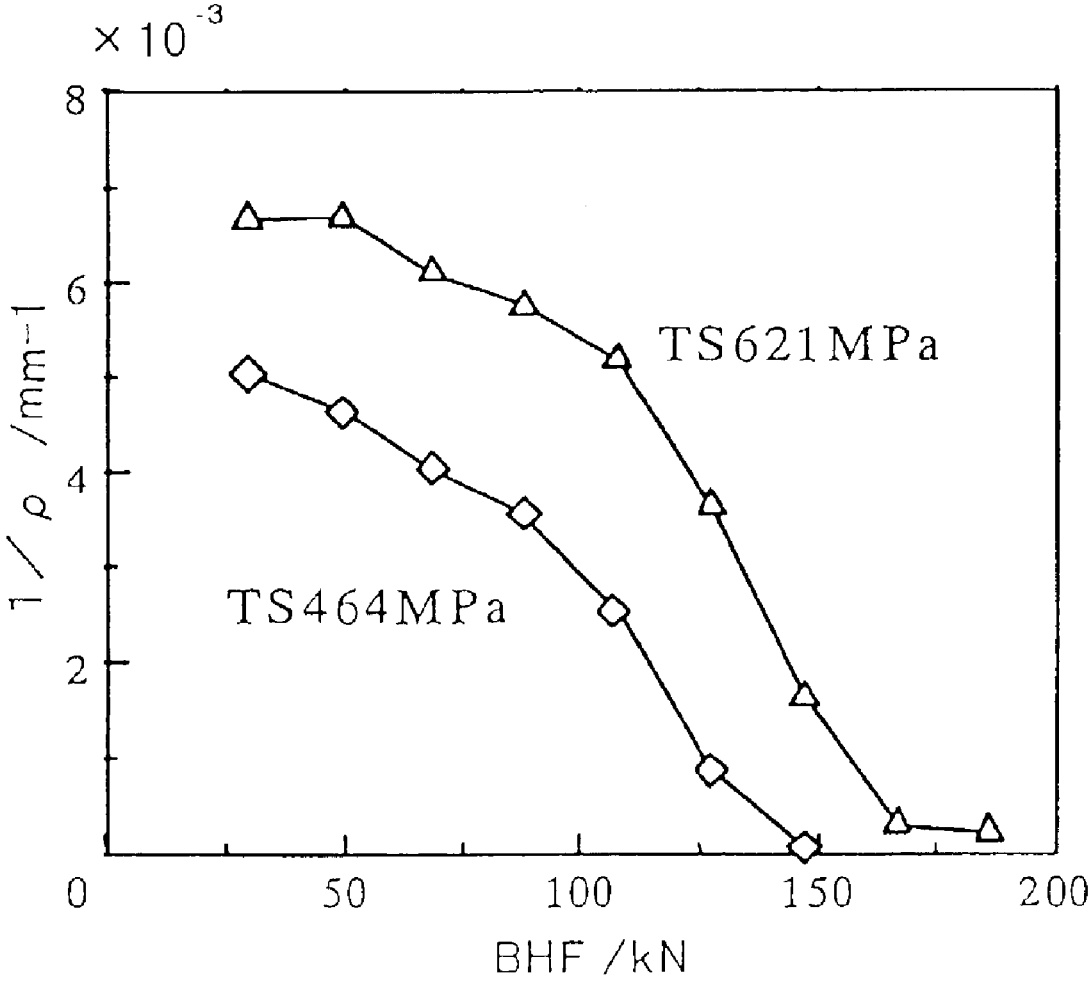
FIG. 3 is a graph showing the relationship between a wall camber and BHF (blanking holding force).

As shown in FIG. 2 and FIG. 3, the springback and the wall camber vary also according to the BHF (blanking holding force). The effect of the present invention does not change in tendency no matter which BHF the evaluation is carried out for, but too high a BHF cannot be applied when pressing an actual member by an actual machine, so the hat bending test of various types of steels was carried out with 29 kN of BHF this time.

In Table 7 and Table 8 (continuation of Table 7), whether or not the production conditions of the steel sheets were within the range of the production conditions of the present invention is shown in the column "Class of invention".

The "Hot rolling temperature" was evaluated as "O" ("good") when the rolling was carried out at the $Ar_3$ transformation temperature or less, while was evaluated as "X" ("poor") when the temperature zone of the finish rolling contained the $Ar_3$ transformation temperature or more. In these cases, when the friction coefficient in at least one pass of the finish rolling was 0.2 or less, "O" ("good") was entered in the column of "Lubrication", while when the friction coefficient in all passes exceeded 0.2, "Δ" ("fair") was entered. The coiling temperature was evaluated as "O" ("good") when the steel sheet was coiled at 600 to 900° C., while evaluated as "X" ("poor") when it was coiled at less than 600° C. In all types of steels except the steel types L and M in Table 8, examples according to the steel type of numbers "-2" and "-3" satisfy the production conditions of the present invention.

The steel types L and M cannot secure the "Coiling temperature" when satisfying the conditions of the "Rolling temperature", while can not satisfy the conditions of the "Rolling temperature" when securing the "Coiling temperature". Accordingly, the steel types L and M do not satisfy the production conditions of the present invention.

Where such hot-rolled steel sheets are cold rolled to 1.4 mm thickness, when the cold rolling reduction rate was 80% or more, the "Cold rolling reduction rate" was evaluated as "X" ("poor"), when when it was "Less than 80%", was evaluated as "O" ("good"). Also, when the annealing temperature was 650° C. to ($Ar_3$+100)° C., the "Annealing temperature" was evaluated as "O" ("good"), while in cases other than the former case, it was evaluated as "X" ("poor").

Items not related as the production conditions were indicated by "-". The skin pass rolling was applied to both of the hot-rolled steel sheet and cold-rolled steel sheet within the range of 0.5 to 1.5%.

The X-ray measurement was performed by preparing a sample parallel to the sheet face at a position of 7/16 sheet thickness as a representative value of the steel sheet.

In Table 6, the mechanical properties, springbacks, and wall camber in the 1.4 mm thick hot-rolled steel sheets and cold-rolled steel sheets produced by the above method are shown. In all steel types except the steel types L and M in Table 10, examples according to the steel types given numbers of "-2" and "-3" are examples of the present invention.

In these examples, it is seen that the springback and the wall camber become small in comparison with the examples (out of the invention) according to the steel types of numbers "-1" and "-4" and as a result, the dimensional accuracy is improved. Namely, by simultaneously satisfying the X-ray random intensity ratios and r values of the crystal orientations limited in the present invention, good shape fixability is first achieved in the steel sheet.

The mechanism of how the X-ray random intensity ratio and r value of the crystal orientation are related to the improvement of the shape fixability is not clear at present. Probably, the springback at the time of bending deformation is reduced by facilitating the progress of the slip deformation at the time of bending deformation.

TABLE 4

| steel type | C | Si | Mn | P | S | Al | Ti | Nb | V | Cr | B | N | O | Cu | Ni | Mo | Sn | A | B | Class |
|---|---|---|---|---|---|---|---|---|---|---|---|---|---|---|---|---|---|---|---|---|
| A | 0.0025 | 0.02 | 0.49 | 0.048 | 0.007 | 0.068 | | | | | 0.0007 | 0.0019 | 0.002 | | | | 0.04 | −29.2 | 48.1 | Steel of invention |
| B | 0.048 | 0.03 | 0.69 | 0.089 | 0.008 | 0.051 | | | | | | 0.0025 | 0.002 | | | | | −8.7 | 73.8 | Steel of invention |
| C | 0.12 | 1.19 | 1.49 | 0.030 | 0.007 | 0.086 | | | | | | 0.0025 | 0.001 | | | | | 23.6 | 91.4 | Steel of invention |
| D | 0.13 | 1.28 | 1.09 | 0.019 | 0.013 | 0.045 | | 0.042 | 0.016 | | | 0.0022 | 0.003 | | | | 0.02 | 24.7 | 79.5 | Steel of invention |
| E | 0.14 | 1.19 | 1.43 | 0.028 | 0.009 | 0.092 | | 0.066 | 0.023 | 0.31 | | 0.0026 | 0.002 | | | | | 28.7 | 91.2 | Steel of invention |
| F | 0.16 | 1.89 | 1.50 | 0.047 | 0.004 | 0.089 | | 0.038 | | | | 0.0029 | 0.003 | | | 0.02 | | 27.2 | 135.2 | Steel of invention |
| G | 0.12 | 0.40 | 1.53 | 0.021 | 0.006 | 0.036 | | | | 0.29 | | 0.0028 | 0.002 | | | | | 81.5 | 39.8 | Comparative invention |

TABLE 5

| Steel type | Class of steel sheet | Hot rolling conditions: Rolling temprature | Hot rolling conditions: Lubrication | Hot rolling conditions: Coiling temperature | Cold rolling and annealing conditions: Cold rolling reduction rate | Cold rolling and annealing conditions: Annealing temperature | Class of invention |
|---|---|---|---|---|---|---|---|
| A | −1 Cold rolled | ○ | Δ | ○ | x | ○ | Outside invention |
| | −2 Cold rolled | ○ | ○ | ○ | ○ | ○ | Present invention |
| | −3 Hot rolled | ○ | ○ | ○ | — | — | Present invention |
| | −4 Hot rolled | x | Δ | ○ | — | — | Outside invention |
| B | −1 Cold rolled | x | Δ | ○ | ○ | ○ | Outside invention |
| | −2 Cold rolled | ○ | ○ | ○ | ○ | ○ | Present invention |
| | −3 Hot rolled | ○ | ○ | ○ | — | — | Present invention |
| | −4 Hot rolled | x | Δ | x | — | — | Outside invention |
| C | −1 Cold rolled | x | ○ | ○ | ○ | ○ | Outside invention |
| | −2 Cold rolled | ○ | ○ | ○ | ○ | ○ | Present invention |
| | −3 Hot rolled | ○ | ○ | ○ | — | — | Present invention |
| | −4 Hot rolled | x | Δ | ○ | — | — | Outside invention |
| D | −1 Cold rolled | x | ○ | x | x | ○ | Outside invention |
| | −2 Cold rolled | ○ | ○ | ○ | ○ | ○ | Present invention |
| | −3 Hot rolled | ○ | ○ | ○ | — | — | Present invention |
| | −4 Hot rolled | x | Δ | ○ | — | — | Outside invention |
| E | −1 Cold rolled | x | ○ | ○ | ○ | ○ | Outside invention |
| | −2 Cold rolled | ○ | ○ | ○ | ○ | ○ | Present invention |
| | −3 Hot rolled | ○ | ○ | ○ | — | — | Present invention |
| | −4 Hot rolled | x | Δ | x | — | — | Outside invention |
| F | −1 Cold rolled | x | ○ | ○ | x | ○ | Outside invention |
| | −2 Cold rolled | ○ | ○ | ○ | ○ | ○ | Present invention |
| | −3 Hot rolled | ○ | ○ | ○ | — | — | Present invention |
| | −4 Hot rolled | x | Δ | ○ | — | — | Outside invention |
| G | −1 Cold rolled | x | ○ | ○ | ○ | ○ | Outside invention |
| | −2 Cold rolled | ○ | ○ | x | ○ | ○ | Outside invention |
| | −3 Hot rolled | ○ | ○ | x | — | — | Outside invention |
| | −4 Hot rolled | x | ○ | ○ | — | — | Outside invention |

TABLE 6

| Steel type | Class of steel sheet | Tensile properties: Yield strength (MPa) | Tensile properties: Tensile strength (MPa) | Tensile properties: Elongation (%) | Tensile properties: rL | Tensile properties: rC | X-ray mean intensity ratio of {100}<011>–{223}<110> orientation group | X-ray mean intensity ratio of {554}<225>, {111}<112>, {111}<110> orientation group | Springbacks (°) | Wall camber $1/\rho \times 10^3$ ($mm^{-1}$) | Dimensional accuracy (mm) | Class of invention |
|---|---|---|---|---|---|---|---|---|---|---|---|---|
| A | −1 Cold rolled | 227 | 379 | 45 | 2.32 | 2.86 | 2.2 | 9.8 | 9.0 | 3.5 | 24.3 | Outside invention |
| | −2 Cold rolled | 236 | 387 | 45 | 0.66 | 1.62 | 4.4 | 2.2 | 3.4 | 2.1 | 16.9 | Present invention |
| | −3 Hot rolled | 228 | 383 | 44 | 0.56 | 0.76 | 4.9 | 2.3 | 5.0 | 1.8 | 13.9 | Present invention |
| | −4 Hot rolled | 226 | 379 | 45 | 0.79 | 0.83 | 2.1 | 2.5 | 10.0 | 3.8 | 25.3 | Outside invention |
| B | −1 Cold rolled | 274 | 417 | 42 | 0.85 | 1.23 | 2.3 | 2.9 | 10.0 | 3.8 | 25.2 | Outside invention |
| | −2 Cold rolled | 260 | 409 | 44 | 0.34 | 0.52 | 5.0 | 2.6 | 6.3 | 2.1 | 15.9 | Present invention |
| | −3 Hot rolled | 266 | 415 | 41 | 0.56 | 0.62 | 5.0 | 1.8 | 5.7 | 2.2 | 16.6 | Present invention |
| | −4 Hot rolled | 381 | 462 | 16 | 0.78 | 0.82 | 2.3 | 2.3 | 12.3 | 4.5 | 28.7 | Outside invention |
| C | −1 Cold rolled | 399 | 554 | 30 | 0.71 | 0.82 | 3.6 | 2.8 | 13.2 | 6.3 | 38.0 | Outside invention |
| | −2 Cold rolled | 415 | 560 | 33 | 0.62 | 0.72 | 7.9 | 1.9 | 8.3 | 2.6 | 18.8 | Present invention |
| | −3 Hot rolled | 396 | 552 | 33 | 0.23 | 0.40 | 5.1 | 2.3 | 9.9 | 3.9 | 25.8 | Present invention |
| | −4 Hot rolled | 401 | 550 | 35 | 0.71 | 0.73 | 2.9 | 2.8 | 12.6 | 5.7 | 35.2 | Outside invention |
| D | −1 Cold rolled | 388 | 552 | 24 | 1.01 | 0.92 | 2.2 | 3.7 | 15.4 | 6.1 | 36.5 | Outside invention |
| | −2 Cold rolled | 393 | 541 | 25 | 0.68 | 0.71 | 3.8 | 2.0 | 10.1 | 4.4 | 28.8 | Present invention |
| | −3 Hot rolled | 372 | 538 | 28 | 0.56 | 0.49 | 5.5 | 1.9 | 10.4 | 3.5 | 23.9 | Present invention |
| | −4 Hot rolled | 382 | 535 | 28 | 0.78 | 0.81 | 2.3 | 2.3 | 13.4 | 6.1 | 37.7 | Outside invention |
| E | −1 Cold rolled | 425 | 561 | 30 | 0.92 | 1.10 | 2.2 | 3.6 | 13.4 | 6.5 | 38.9 | Outside invention |
| | −2 Cold rolled | 425 | 558 | 28 | 0.59 | 0.72 | 4.0 | 2.8 | 12.0 | 4.5 | 28.3 | Present invention |
| | −3 Hot rolled | 433 | 567 | 28 | 0.43 | 0.29 | 9.1 | 1.1 | 8.8 | 2.0 | 15.9 | Present invention |
| | −4 Hot rolled | 581 | 642 | 7 | * | * | 2.1 | 1.4 | 17.2 | 7.6 | 45.7 | Outside invention |
| F | −1 Cold rolled | 500 | 656 | 25 | 0.92 | 0.87 | 2.3 | 2.6 | 15.6 | 7.3 | 44.8 | Outside invention |
| | −2 Cold rolled | 512 | 662 | 27 | 0.60 | 0.72 | 2.9 | 2.3 | 11.1 | 6.3 | 39.5 | Present invention |
| | −3 Hot rolled | 508 | 660 | 28 | 0.50 | 0.59 | 3.7 | 1.8 | 11.5 | 5.9 | 36.4 | Present invention |
| | −4 Hot rolled | 497 | 642 | 24 | 0.77 | 0.92 | 2.3 | 2.1 | 15.2 | 7.7 | 46.1 | Outside invention |

TABLE 6-continued

| Steel type | Class of steel sheet | Tensile properties: Yield strength (MPa) | Tensile strength (MPa) | Elongation (%) | rL | rC | X-ray mean intensity ratio of {100}<011>–{223}<110> orientation group | X-ray mean intensity ratio of {554}<225>, {111}<112>, {111}<110> orientation group | Springbacks (°) | Wall camber $1/\rho \times 10^3$ ($mm^{-1}$) | Dimensional accuracy (mm) | Class of invention |
|---|---|---|---|---|---|---|---|---|---|---|---|---|
| G | −1 Cold rolled | 440 | 593 | 18 | 0.78 | 0.72 | 2.5 | 1.9 | 16.7 | 6.2 | 37.7 | Outside invention |
| | −2 Cold rolled | 424 | 567 | 19 | 0.88 | 0.78 | 2.7 | 1.5 | 14.9 | 6.5 | 39.1 | Outside invention |
| | −3 Hot rolled | 629 | 681 | _4 | * | * | 2.9 | 1.8 | # | # | # | Outside invention |
| | −4 Hot rolled | 436 | 582 | 18 | 0.73 | 0.82 | 2.8 | 1.3 | 15.0 | 6.4 | 39.1 | Outside invention |

*: Uniform elongation was small and r value could not be measure
#: Cracked

EXAMPLE 3

An explanation will be made of results of a study using steels of A to H having compositions shown in Table 7. These steels were cast and then hot rolled as they were or after once cooling to room temperature and then reheating to a temperature range of 900° C. to 1300° C. to finally roll them to 1.4 mm thick, 3.0 mm thick, or 8.0 mm thick hot-rolled steel sheets. The 3.0 mm thick and 8.0 mm thick hot-rolled steel sheets were cold rolled to obtain 1.4 mm thick cold-rolled steel sheets, then were annealed in the continuous annealing step. Test pieces having a width of 50 mm and a length of 270 mm were prepared from these 1.4 mm thick steel sheets, and shape fixability is evaluated for these pieces as same way as described in Example 2.

In Table 8, whether or not the production conditions of the steel sheets are within the range of the production conditions of the present invention is shown in the column "Class of invention". The "Hot rolling temperature 1", was evaluated as "O" ("good") in the case where the sum of the reduction rates at the $Ar_3$ transformation temperature to ($Ar_3$+100)° C. was 25% or more when the hot rolling was completed at the $Ar_3$ transformation temperature or more, while was evaluated as "X" ("poor") in the case where it was less than 25%.

The "Hot rolling temperature 2" was evaluated as "O" ("good") in the case where the sum of the reduction rates at the $Ar_3$ transformation temperature or less was 25% or more when the hot rolling was performed at the $Ar_3$ transformation temperature or less, while was evaluated as "X" ("poor") in case where it was less than 25%. In any case, within each temperature range, where the friction coefficient for at least one pass was 0.2 or less, "O" ("good") was entered in the column "Lubrication", while "Δ" ("fair") was entered when the friction coefficient in all passes was over 0.2.

The hot rolling and coiling were performed at the To temperature found by above Equation (1) or less in all cases. Where such a hot-rolled steel sheet was cold rolled to 1.4 mm thickness, the "Cold rolling reduction rate" was evaluated as "X" ("poor") when the cold rolling reduction rate was 80% or more, while was evaluated as "O" ("good") in the case of "Less than 80%". Also, when the annealing temperature was 600° C. to ($Ac_3$+100)° C., the "Annealing temperature" was evaluated as "O" ("good", while in cases other than this, was evaluated as "X" ("poor"). "-" was entered for items not related as conditions of production. The skin pass rolling was applied to both of the hot-rolled steel sheet and cold-rolled steel sheet within the range of the reduction rate of 0.5 to 1.5%.

The X-ray measurement was performed preparing a sample parallel to the sheet face at a position of 7/16 sheet thickness as a representative value of the steel sheet.

An expansion test was performed by punching a hole having a diameter of 10 mm in the center of a test piece of 100 mm per side, expanding the initial hole by a conical punch having an apical angle of 60°, and finding the expansion rate λ (following equation) of the hole diameter d at the point of time when a crack penetrates through the steel sheet with respect to the initial hole diameter of 10 mm.

$$\lambda=\{(d-10)/10\}\times 100(\%)$$

In Table 9, the mechanical properties, expansion rates, springbacks, wall camber, and dimensional accuracies of 1.4 thick hot-rolled steel sheets and cold-rolled steel sheets produced by the above method are shown. In all steel types except the steel H in Table 12, examples according to steel types of numbers "-2" and "-3" correspond to the present invention, while examples of numbers "-1" and "-3" are outside of the present invention. The structure was comprised of, for all other than the steel H, a percent area of the martensite, residual austenite, and pearlite of less than 5% and ferrite or bainite as the maximum phase in percent area. Note, in the steel sheets of E-1, H, I-1, and O-1, the worked grains remained with a percent area of 50 to 100%.

In steel sheets of numbers "-2" and "-3" of the examples of the present invention, in comparison with those of numbers "1" and "-4" outside of the invention, the springback and the wall warpage become small. As a result it is seen that the dimensional accuracy is improved. Also, in those of the present invention, the stretch flangeability is good in all cases. Namely, it becomes possible to produce high stretch flanging steel sheet having good shape fixability first by satisfying the X-ray random intensity ratios, r values, and structures of the crystal orientations limited in the present invention.

TABLE 7

| Steel type | C | Si | Mn | P | S | Al | Ti | Nb | V | Cr | Mo | Cu | Ni | B | N | O | Sn | Ca/Rem | Class |
|---|---|---|---|---|---|---|---|---|---|---|---|---|---|---|---|---|---|---|---|
| A | 0.0028 | 0.01 | 0.10 | 0.007 | 0.006 | 0.046 | 0.053 | — | — | — | — | — | — | 0.0003 | 0.0023 | 0.003 | — | | Steel of invention |
| B | 0.042 | 0.02 | 0.28 | 0.010 | 0.008 | 0.016 | — | — | — | — | — | — | — | 0.0021 | 0.0019 | 0.004 | — | | Steel of invention |
| C | 0.087 | 0.11 | 1.92 | 0.017 | 0.011 | 0.042 | 0.130 | — | — | 0.25 | — | — | — | — | 0.0035 | 0.001 | — | | Steel of invention |
| D | 0.158 | 0.65 | 3.10 | 0.007 | 0.008 | 0.020 | 0.061 | 0.013 | — | — | — | — | — | — | 0.0021 | 0.002 | — | | Comparative steel |
| E | 0.0033 | 0.02 | 1.23 | 0.102 | 0.005 | 0.053 | 0.061 | 0.008 | — | — | — | — | — | — | 0.0018 | 0.002 | — | | Comparative steel |
| F | 0.051 | 0.02 | 0.78 | 0.089 | 0.006 | 0.892 | — | — | — | — | 0.02 | — | — | — | 0.0020 | 0.003 | — | | Steel of invention |
| G | 0.051 | 0.12 | 1.08 | 0.011 | 0.006 | 0.042 | — | — | — | — | — | — | — | — | 0.0024 | 0.003 | — | | Steel of invention |
| H | 0.092 | 0.28 | 0.72 | 0.023 | 0.012 | 0.029 | 0.160 | — | — | — | — | — | — | — | 0.0016 | 0.002 | — | | Steel of invention |

TABLE 8

| | | Hot rolling conditions | | | Presence of additional | Cold rolling and annealing conditions | | |
|---|---|---|---|---|---|---|---|---|
| Steel type | Class of steel sheet | Hot rolling temperature 1 | Hot rolling temperature 2 | Lubrication | heat treatment after hot rolling | Cold rolling reduction rate | Annealing temperature | Class of invention |
| A | −1 Cold rolled | ○ | — | Δ | No | x | ○ | Outside invention |
| | −2 Cold rolled | ○ | — | ○ | No | ○ | ○ | Present invention |
| | −3 Hot rolled | ○ | — | ○ | Yes | — | — | Present invention |
| | −4 Hot rolled | x | — | Δ | No | — | — | Outside invention |
| B | −1 Cold rolled | ○ | — | Δ | No | x | ○ | Outside invention |
| | −2 Cold rolled | ○ | — | Δ | No | ○ | ○ | Present invention |
| | −3 Hot rolled | ○ | — | Δ | No | — | — | Present invention |
| | −4 Hot rolled | x | — | Δ | No | — | — | Outside invention |
| C | −1 Cold rolled | x | — | ○ | No | x | ○ | Outside invention |
| | −2 Cold rolled | ○ | — | ○ | No | ○ | ○ | Present invention |
| | −3 Hot rolled | ○ | — | ○ | No | — | — | Present invention |
| | −4 Hot rolled | x | — | ○ | No | — | — | Outside invention |
| D | −1 Cold rolled | ○ | — | Δ | Yes | ○ | x | Outside invention |
| | −2 Cold rolled | ○ | — | Δ | Yes | ○ | ○ | Outside invention |
| | −3 Hot rolled | ○ | — | Δ | Yes | — | — | Outside invention |
| | −4 Hot rolled | x | — | Δ | Yes | — | — | Outside invention |
| E | −1 Cold rolled | ○ | — | ○ | No | x | ○ | Outside invention |
| | −2 Cold rolled | ○ | — | ○ | No | ○ | ○ | Present invention |
| | −3 Hot rolled | ○ | — | ○ | No | — | — | Present invention |
| | −4 Hot rolled | x | — | Δ | No | — | — | Outside invention |
| F | −1 Cold rolled | x | — | Δ | No | x | ○ | Outside invention |
| | −2 Cold rolled | ○ | — | ○ | No | ○ | ○ | Present invention |
| | −3 Hot rolled | — | ○ | ○ | No | — | — | Present invention |
| | −4 Hot rolled | — | x | Δ | No | — | — | Outside invention |
| G | −1 Cold rolled | — | x | Δ | No | ○ | ○ | Outside invention |
| | −2 Cold rolled | — | ○ | ○ | No | ○ | ○ | Present invention |
| | −3 Hot rolled | ○ | — | ○ | Yes | — | — | Present invention |
| | −4 Hot rolled | x | — | Δ | Yes | — | — | Outside invention |
| H | −1 Cold rolled | x | — | ○ | No | ○ | ○ | Outside invention |
| | −2 Cold rolled | ○ | — | ○ | No | ○ | ○ | Present invention |
| | −3 Hot rolled | — | ○ | ○ | No | — | — | Present invention |
| | −4 Hot rolled | — | x | Δ | No | — | — | Outside invention |

TABLE 9

| Steel type | Class of steel sheet | Tensile properties: Yield strength (MPa) | Tensile properties: Tensile strength (MPa) | Tensile properties: Elongation (%) | Tensile properties: rL | Tensile properties: rC | X-ray mean intensity ratio of {100}<011>–{223}<110> orientation group | X-ray mean intensity ratio of {554}<225>, {111}<112>, {111}<110> orientation group | Springbacks (°) | Wall camber $1/\rho \times 10^3$ ($mm^{-1}$) | Dimensional accuracy (mm) | Expansion rates (%) | Class of invention |
|---|---|---|---|---|---|---|---|---|---|---|---|---|---|
| A | −1 Cold rolled | 178 | 313 | 55 | 2.12 | 2.56 | 2.8 | 10.8 | 8.2 | 2.6 | 19.4 | 134 | Outside invention |
| | −2 Cold rolled | 175 | 312 | 52 | 0.67 | 1.54 | 5.1 | 3.1 | 4.7 | 0.8 | 9.5 | 123 | Present invention |
| | −3 Hot rolled | 164 | 312 | 51 | 0.63 | 0.69 | 5.5 | 2.8 | 4.7 | 0.6 | 8.1 | 136 | Present invention |
| | −4 Hot rolled | 171 | 308 | 54 | 0.77 | 0.82 | 2.6 | 2.9 | 8.6 | 2.6 | 18.2 | 129 | Outside invention |
| B | −1 Cold rolled | 167 | 318 | 55 | 1.01 | 1.12 | 2.8 | 3.7 | 8.6 | 2.4 | 17.4 | 119 | Outside invention |
| | −2 Cold rolled | 182 | 328 | 49 | 0.66 | 1.10 | 4.1 | 2.6 | 3.8 | 1.5 | 12.7 | 123 | Present invention |
| | −3 Hot rolled | 184 | 322 | 50 | 0.58 | 0.67 | 5.6 | 2.5 | 3.3 | 0.7 | 8.8 | 122 | Present invention |
| | −4 Hot rolled | 189 | 326 | 45 | 0.88 | 0.98 | 2.4 | 2.1 | 8.5 | 2.6 | 18.2 | 123 | Outside invention |
| C | −1 Cold rolled | 470 | 615 | 28 | 0.91 | 0.99 | 2.3 | 3.9 | 15.7 | 7.0 | 42.3 | 91 | Outside invention |
| | −2 Cold rolled | 459 | 606 | 31 | 0.63 | 0.82 | 7.3 | 3.3 | 9.4 | 3.4 | 23.4 | 96 | Present invention |
| | −3 Hot rolled | 451 | 610 | 29 | 0.52 | 0.68 | 7.3 | 2.6 | 9.7 | 3.5 | 23.9 | 95 | Present invention |
| | −4 Hot rolled | 471 | 620 | 27 | 0.77 | 0.80 | 2.3 | 2.8 | 15.2 | 6.7 | 40.8 | 78 | Outside invention |
| D | −1 Cold rolled | 1076 | 1182 | 5 | * | * | 3.8 | 3.8 | # | # | # | 8 | Outside invention |
| | −2 Cold rolled | 1089 | 1201 | 4 | * | * | 6.1 | 2.8 | 23.7 | 16.2 | 90.6 | 13 | Outside invention |
| | −3 Hot rolled | 1103 | 1235 | 4 | * | * | 6.9 | 2.1 | 24.0 | 16.1 | 90.9 | 10 | Outside invention |
| | −4 Hot rolled | 1065 | 1196 | 5 | * | * | 4.1 | 2.6 | 27.5 | 15.9 | 89.0 | 7 | Outside invention |
| E | −1 Cold rolled | 313 | 465 | 37 | 0.88 | 1.35 | 1.4 | 4.3 | 11.8 | 5.1 | 31.8 | 98 | Outside invention |
| | −2 Cold rolled | 308 | 459 | 36 | 0.68 | 1.23 | 4.6 | 2.8 | 7.2 | 3.0 | 20.9 | 113 | Present invention |
| | −3 Hot rolled | 309 | 460 | 36 | 0.67 | 0.82 | 5.3 | 2.6 | 7.5 | 2.6 | 18.8 | 110 | Present invention |
| | −4 Hot rolled | 310 | 463 | 38 | 0.73 | 0.93 | 1.6 | 2.8 | 11.6 | 5.1 | 32.3 | 91 | Outside invention |
| F | −1 Cold rolled | 279 | 427 | 40 | 0.79 | 0.92 | 2.7 | 3.3 | 10.9 | 4.1 | 26.5 | 108 | Outside invention |
| | −2 Cold rolled | 275 | 421 | 42 | 0.67 | 0.86 | 3.7 | 2.2 | 6.8 | 2.9 | 20.1 | 114 | Present invention |
| | −3 Hot rolled | 275 | 421 | 41 | 0.38 | 0.51 | 4.5 | 1.9 | 6.9 | 2.5 | 18.1 | 115 | Present invention |
| | −4 Hot rolled | 276 | 421 | 41 | 0.73 | 0.86 | 2.9 | 1.6 | 11.3 | 4.2 | 27.8 | 119 | Outside invention |
| G | −1 Cold rolled | 280 | 435 | 39 | 0.93 | 1.09 | 2.7 | 2.9 | 14.2 | 4.7 | 29.7 | 105 | Outside invention |
| | −2 Cold rolled | 300 | 442 | 38 | 0.66 | 0.97 | 4.2 | 1.8 | 10.6 | 2.9 | 20.1 | 106 | Present invention |
| | −3 Hot rolled | 289 | 432 | 38 | 0.42 | 0.57 | 5.8 | 1.2 | 10.8 | 2.0 | 15.9 | 102 | Present invention |
| | −4 Hot rolled | 287 | 441 | 36 | 0.71 | 0.81 | 2.8 | 2.3 | 14.1 | 4.8 | 29.8 | 91 | Outside invention |
| H | −1 Cold rolled | 460 | 620 | 30 | 0.78 | 0.92 | 3.6 | 3.1 | 21.6 | 7.4 | 44.3 | 90 | Outside invention |
| | −2 Cold rolled | 463 | 615 | 32 | 0.65 | 0.76 | 6.0 | 2.4 | 18.8 | 4.2 | 27.1 | 91 | Present invention |
| | −3 Hot rolled | 464 | 621 | 27 | 0.47 | 0.56 | 6.7 | 2.3 | 18.6 | 3.9 | 25.4 | 96 | Present invention |
| | −4 Hot rolled | 469 | 623 | 31 | 0.72 | 0.80 | 3.0 | 2.6 | 23.1 | 7.1 | 42.9 | 86 | Outside invention |

*: Uniform elongation was small and r value could not be measured
#: Cracked

EXAMPLE 4

An explanation will be made of results of a study using steels of A to G having compositions shown in Table 10. These steels were cast and then hot rolled as they were, or after once cooling to room temperature and then reheating to 1250° C., to finally roll them to 1.4 mm thick, 3 mm thick, or 8.0 mm thick hot-rolled steel sheets. The 3.0 mm thick and 8.0 mm thick hot-rolled steel sheets were cold rolled to 1.4 mm thickness, then were annealed in a continuous annealing step. Then, shape fixability is evaluated for these steel sheet as same way as described in Example 2.

The X-ray measurement was executed by preparing a sample parallel to the sheet face at a position of 7/16 sheet thickness as a representative value of the steel sheet. An expansion test was performed as same way as described in Example 3.

The grain boundary occupancy of the iron carbide was found from M/N by drawing four straight lines on an optical microscope photo of a magnification of 200 and by using a number N of intersecting points of the straight lines and the grain boundaries and a number M of cases where the iron carbide existed at the position of the intersecting point among N intersecting points.

Table 11 shows whether or not the production conditions of the steel sheets are within the range of production conditions of the present invention. Under the "Hot rolling condition 1" where the hot rolling was completed at the $Ar_3$ transformation temperature or more, the case where the sum of the reduction rates at the $Ar_3$ transformation temperature to $(Ar_3+100)$° C. was 25% or more and the hot rolling ending temperature was within that temperature range was evaluated as "O" ("good") and the case where the sum of the reduction rates in that temperature zone was less than 25% evaluated as "X" ("poor").

Under the "Hot rolling condition 2-1", the case where the sum of the reduction rates within a temperature range of $(Ar_3+50)$ to $(Ar_3+150)$° C. was 25% or more was evaluated as "O" ("good") and the case where the sum of the reduction rates was less than 25% was evaluated as "X" ("poor"), while under the "Hot rolling condition 2-2", the case where the sum of the reduction rates within a temperature range of $(Ar_3-100)$ to $(Ar_3+50)$° C. was 5 to 35% was evaluated as "O" ("good") and the case not satisfying this condition was evaluated as "X" ("poor").

In any case, within each temperature range, where the friction coefficient for at least one pass is 0.2 or less, "O" ("good") was entered in the column "Lubrication", while where the friction coefficient in all passes exceeded 0.2, "Δ" ("fair") was entered. The hot rolling and coiling were carried out at the To temperature found by the above Equation (1) or less for all cases.

Where such a hot-rolled steel sheet is cold rolled to a thickness of 1.4 mm, when the cold rolling reduction rate was 80% or more, the "Cold rolling reduction rate" was evaluated as "X" ("poor"), while when it was "Less than 80%", it was evaluated as "O" ("good").

Also, where the annealing temperature was 600° C. to $(Ac_3+100)$° C., the "Annealing temperature" was evaluated as "O" ("good"), while incases other than this, "X" ("poor") was entered. Items not related as the conditions of the production were indicated by "-". Skin pass rolling was applied to all of the hot-rolled steel sheets and cold-rolled steel sheets within the range of 0.5 to 1.5%.

Table 12 shows the iron carbide grain boundary occupancy M/N of 1.4 mm thick hot-rolled steel sheets and cold-rolled steel sheets produced by the above method, the maximum grain size d of the iron carbide, and the mechanical properties, while Table 13 shows the X-ray random intensity ratios, dimensional accuracies, springbacks, wall camber, and expansion rates. In all steel types except steels I, J, and K in Table 20, examples according to steel types of "-2" and "-3" correspond to the present invention, and examples of numbers "-1" and "-4" are out of the invention. Note that, all of the structures of the steel sheets satisfying the conditions of the present invention were comprised of ferrite or bainite as the main phase.

The samples of numbers "-2" and "-3" of the present invention, in comparison with those of numbers "-1" and "-4" outside of the invention, had less springback and wall warpage become small and as a result were improved in the dimensional accuracy. The samples of the present invention are good also in the stretch flangeability in all cases.

On the other hand, in the steels I and J wherein the grain boundary occupancy M/N of the iron carbide and the maximum grain size d of the iron carbide do not satisfy the requirement of the present invention, the shape fixability is good, but the stretch flangeability is degraded. In the steel H, the shape fixability and stretch flangeability are also degraded.

Namely, production of a high stretch flanging steel sheet having good shape fixability becomes possible first after satisfying the ingredients, X-ray random intensity ratios of the crystal orientations, r values, and structures limited in the present invention.

Figure 4:
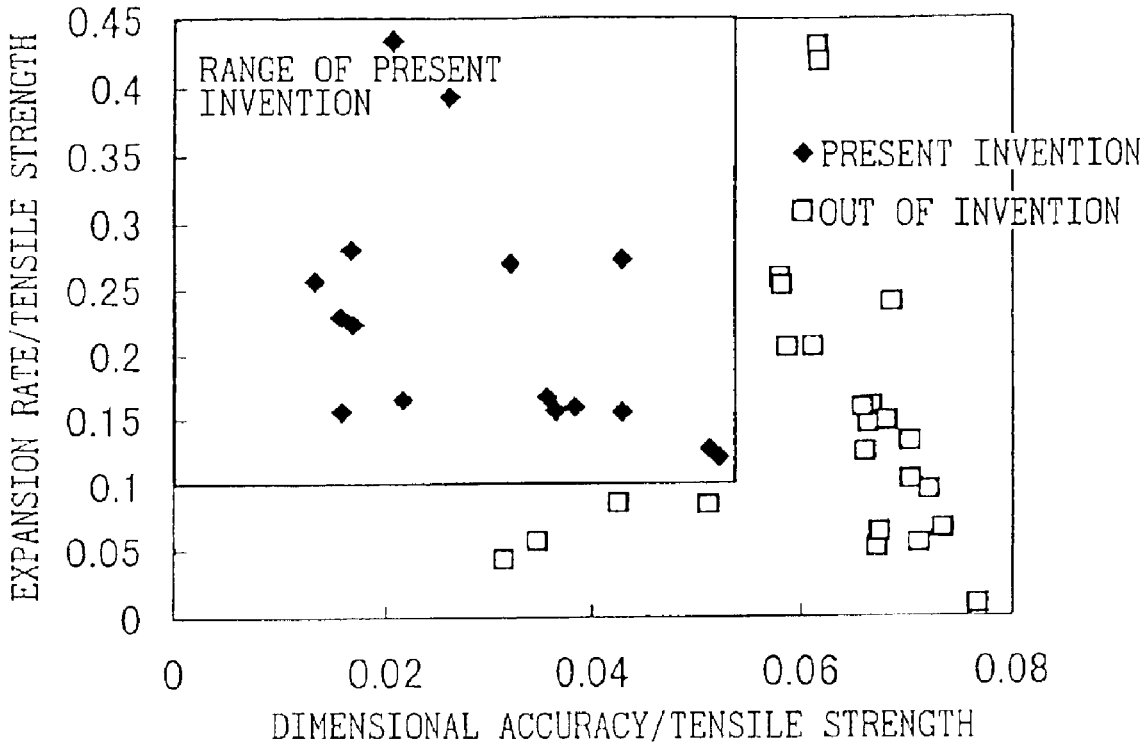
FIG. 4 is a graph showing the relationship between a dimensional accuracy and an expansion rate standardized by tensile strength.

The relationship of the dimensional accuracy and the expansion rate standardized by the tensile strength is shown in FIG. 4. From this relationship as well, it is obvious that the steels satisfying the conditions of the present invention are excellent in both of the dimensional accuracy and the stretch flangeability.

The mechanism behind the importance of the X-ray random intensity ratio and r value of the crystal orientation in the shape fixability is not clear at present. Probably, the springback and the wall warpage at the time of bending deformation become small by facilitating the advance of slip deformation at the time of bending deformation, and, as a result, the dimensional accuracy, that is, the shape fixability, is improved.

TABLE 10

| Steel type | C | Si | Mn | P | S | Al | Ti | Nb | Cr | B | N | O | Ca/Rem | Class |
|---|---|---|---|---|---|---|---|---|---|---|---|---|---|---|
| A | 0.0028 | 0.01 | 0.10 | 0.007 | 0.006 | 0.046 | 0.04 | 0.000 | 0 | 0.0003 | 0.0023 | 0.003 | — | Steel of invention |
| B | 0.034 | 0.01 | 0.32 | 0.012 | 0.007 | 0.049 | 0.08 | 0.018 | 0 | — | 0.0020 | 0.002 | — | Steel of invention |
| C | 0.046 | 0.02 | 0.41 | 0.010 | 0.008 | 0.016 | 0.13 | 0.000 | 0 | 0.0021 | 0.0019 | 0.004 | — | Steel of invention |
| D | 0.081 | 0.13 | 1.22 | 0.021 | 0.004 | 0.051 | 0.210 | 0.030 | 0 | — | 0.0023 | 0.002 | — | Steel of invention |
| E | 0.08 | 0.31 | 1.58 | 0.011 | 0.009 | 0.032 | 0.26 | 0.000 | 0.035 | — | 0.0031 | 0.003 | Ca:0.002 | Steel of invention |
| F | 0.09 | 0.62 | 2.25 | 0.010 | 0.006 | 0.031 | 0.00 | 0.008 | 0 | | 0.0020 | 0.002 | — | Comparative steel |
| G | 0.115 | 0.55 | 1.58 | 0.016 | 0.002 | 0.040 | 0.00 | 0.000 | 0.029 | — | 0.0026 | 0.001 | — | Comparative steel |

Underlines indicate outside present invention

TABLE 11

| | | Hot rolling conditions | | | | Cold rolling and annealing conditions | | |
|---|---|---|---|---|---|---|---|---|
| Steel type | Class of steel sheet | Hot rolling condition 1 | Hot rolling condition 2-1 | Hot rolling condition 2-2 | Lubrication | Cold rolling reduction rate | Annealing temperature | Class of invention |
| A | −1 Cold rolled | ○ | — | — | ○ | x | ○ | Outside invention |
| | −2 Cold rolled | ○ | — | — | ○ | ○ | ○ | Present invention |
| | −3 Hot rolled | ○ | — | — | ○ | — | — | Present invention |
| | −4 Hot rolled | x | — | — | ○ | — | — | Outside invention |
| B | −1 Cold rolled | x | — | — | ○ | ○ | ○ | Outside invention |
| | −2 Cold rolled | ○ | — | — | ○ | ○ | ○ | Present invention |
| | −3 Hot rolled | — | ○ | ○ | ○ | — | — | Present invention |
| | −4 Hot rolled | — | x | ○ | ○ | — | — | Outside invention |
| C | −1 Cold rolled | | ○ | ○ | Δ | x | ○ | Outside invention |
| | −2 Cold rolled | | ○ | ○ | Δ | ○ | ○ | Present invention |
| | −3 Hot rolled | ○ | — | — | Δ | — | — | Present invention |
| | −4 Hot rolled | x | — | — | Δ | — | — | Outside invention |
| D | −1 Cold rolled | ○ | — | — | Δ | x | ○ | Outside invention |
| | −2 Cold rolled | ○ | — | — | ○ | ○ | ○ | Present invention |
| | −3 Hot rolled | — | ○ | ○ | ○ | — | — | Present invention |
| | −4 Hot rolled | — | x | ○ | Δ | — | — | Outside invention |
| E | −1 Cold rolled | ○ | — | — | Δ | ○ | x | Outside invention |
| | −2 Cold rolled | ○ | — | — | Δ | ○ | ○ | Outside invention |
| | −3 Hot rolled | — | ○ | ○ | Δ | — | — | Outside invention |
| | −4 Hot rolled | — | ○ | x | Δ | — | — | Outside invention |
| F | −1 Cold rolled | — | ○ | x | Δ | ○ | x | Outside invention |
| | −2 Cold rolled | — | ○ | ○ | Δ | ○ | ○ | Present invention |
| | −3 Hot rolled | ○ | — | — | Δ | — | — | Present invention |
| | −4 Hot rolled | x | — | — | Δ | — | — | Outside invention |
| G | −1 Cold rolled | — | x | ○ | ○ | ○ | ○ | Outside invention |
| | −2 Cold rolled | — | ○ | ○ | ○ | ○ | ○ | Present invention |
| | −3 Hot rolled | — | ○ | ○ | ○ | — | — | Present invention |
| | −4 Hot rolled | — | x | ○ | ○ | — | — | Outside invention |

TABLE 12

| | | Grain boundary | | Mechanical properties | | | | | |
|---|---|---|---|---|---|---|---|---|---|
| Steel type | Class of steel sheet | occupancy of iron carbide (M/N) | Maximum diameter of iron carbide grain (μm) | Yield strength (MPa) | Tensile strength (MPa) | Elongation (%) | rL | rC | Class of invention |
| A | −1 Cold rolled | <0.001 | 0 | 167 | 313 | 56 | 1.95 | 2.36 | Outside invention |
| | −2 Cold rolled | <0.001 | 0 | 170 | 312 | 53 | 0.65 | 0.75 | Present invention |
| | −3 Hot rolled | <0.001 | 0 | 168 | 312 | 52 | 0.61 | 0.69 | Present invention |
| | −4 Hot rolled | <0.001 | 0 | 165 | 308 | 53 | 0.82 | 0.87 | Outside invention |
| B | −1 Cold rolled | 0.02 | 0.3 | 329 | 418 | 42 | 0.98 | 1.08 | Outside invention |
| | −2 Cold rolled | 0.03 | 0.4 | 343 | 426 | 41 | 0.68 | 0.74 | Present invention |
| | −3 Hot rolled | 0.03 | 0.4 | 333 | 416 | 42 | 0.59 | 0.62 | Present invention |
| | −4 Hot rolled | 0.03 | 0.4 | 394 | 442 | 10 | * | * | Outside invention |

TABLE 12-continued

| Steel type | | Class of steel sheet | Grain boundary: occupancy of iron carbide (M/N) | Grain boundary: Maximum diameter of iron carbide grain (μm) | Mechanical properties: Yield strength (MPa) | Mechanical properties: Tensile strength (MPa) | Mechanical properties: Elongation (%) | Mechanical properties: rL | Mechanical properties: rC | Class of invention |
|---|---|---|---|---|---|---|---|---|---|---|
| C | −1 | Cold rolled | 0.04 | 0.6 | 485 | 589 | 30 | 1.01 | 1.16 | Outside invention |
| | −2 | Cold rolled | 0.06 | 0.7 | 470 | 568 | 29 | 0.41 | 0.43 | Present invention |
| | −3 | Hot rolled | 0.05 | 0.7 | 468 | 561 | 29 | 0.43 | 0.48 | Present invention |
| | −4 | Hot rolled | 0.05 | 0.7 | 483 | 579 | 30 | 0.82 | 0.92 | Outside invention |
| D | −1 | Cold rolled | 0.06 | 0.5 | 504 | 601 | 30 | 1.10 | 1.11 | Outside invention |
| | −2 | Cold rolled | 0.05 | 0.6 | 494 | 587 | 31 | 0.49 | 0.63 | Present invention |
| | −3 | Hot rolled | 0.05 | 0.5 | 495 | 597 | 30 | 0.48 | 0.51 | Present invention |
| | −4 | Hot rolled | 0.05 | 0.5 | 494 | 593 | 29 | 0.82 | 0.94 | Outside invention |
| E | −1 | Cold rolled | 0.09 | 0.7 | 769 | 862 | 7 | * | * | Outside invention |
| | −2 | Cold rolled | 0.08 | 0.9 | 665 | 758 | 20 | 0.57 | 0.71 | Present invention |
| | −3 | Hot rolled | 0.08 | 0.7 | 660 | 752 | 21 | 0.52 | 0.56 | Present invention |
| | −4 | Hot rolled | 0.07 | 0.8 | 632 | 741 | 21 | 0.73 | 0.81 | Outside invention |
| F | −1 | Cold rolled | 0.23 | 3.2 | 561 | 651 | 27 | 0.78 | 0.90 | Outside invention |
| | −2 | Cold rolled | 0.26 | 3.5 | 505 | 601 | 30 | 0.46 | 0.50 | Outside invention |
| | −3 | Hot rolled | 0.21 | 3.7 | 483 | 613 | 31 | 0.69 | 0.75 | Outside invention |
| | −4 | Hot rolled | 0.27 | 3.4 | 475 | 589 | 32 | 0.72 | 0.73 | Outside invention |
| G | −1 | Cold rolled | 0.36 | 2.6 | 665 | 781 | 25 | 0.77 | 0.79 | Outside invention |
| | −2 | Cold rolled | 0.37 | 3.8 | 678 | 768 | 24 | 0.38 | 0.39 | Outside invention |
| | −3 | Hot rolled | 0.37 | 2.8 | 663 | 765 | 25 | 0.42 | 0.47 | Outside invention |
| | −4 | Hot rolled | 0.29 | 2.9 | 617 | 723 | 27 | 0.78 | 0.89 | Outside invention |

*: Uniform elongation was small and r value could not be measure
#: Cracked

TABLE 13

| Steel type | | Class of steel sheet | X-ray intensity ratio of {100}<011>–{223}<110> orientation group | X-ray intensity ratio of {100}<011>, or {112}<110>, orientation | X-ray intensity ratio of {554}<225>, {111}<112>, {111}<110> orientation group | Springbacks (°) | Wall camber $1/\rho \times 10^3 (mm^{-1})$ | Dimensional accuracy (mm) | Expansion rates (%) | Dimensional accuracy/Tensile strength (mm) | Expansion rates/Tensile strength | Class of invention |
|---|---|---|---|---|---|---|---|---|---|---|---|---|
| A | −1 | Cold rolled | 2.0 | {112}1.8 | 10.8 | 4.0 | 2.6 | 19.3 | 134 | 0.06 | 0.43 | Outside invention |
| | −2 | Cold rolled | 4.2 | {112}5.6 | 3.1 | 1.1 | 0.6 | 8.2 | 123 | 0.03 | 0.39 | Present invention |
| | −3 | Hot rolled | 5.5 | {112}7.4 | 2.6 | 0.9 | 0.2 | 6.4 | 136 | 0.02 | 0.44 | Present invention |
| | −4 | Hot rolled | 2.8 | {112}3.4 | 1.5 | 3.9 | 2.6 | 19.0 | 129 | 0.06 | 0.42 | Outside invention |
| B | −1 | Cold rolled | 2.4 | {112}3.2 | 2.5 | 7.5 | 3.7 | 24.2 | 108 | 0.06 | 0.26 | Outside invention |
| | −2 | Cold rolled | 3.4 | {112}4.5 | 3.0 | 6.1 | 2.6 | 18.3 | 116 | 0.04 | 0.27 | Present invention |
| | −3 | Hot rolled | 4.5 | {100}6.4 | 1.0 | 4.3 | 1.5 | 13.3 | 112 | 0.03 | 0.27 | Present invention |
| | −4 | Hot rolled | 2.6 | {100}3.2 | 0.9 | 9.4 | 4.8 | 30.3 | 106 | 0.07 | 0.24 | Outside invention |
| C | −1 | Cold rolled | 1.8 | {112}2.8 | 3.7 | 11.6 | 6.5 | 39.1 | 86 | 0.07 | 0.15 | Outside invention |
| | −2 | Cold rolled | 7.8 | {100}11.6 | 2.6 | 6.9 | 0.8 | 12.3 | 94 | 0.02 | 0.17 | Present invention |
| | −3 | Hot rolled | 6.8 | {100}7.5 | 2.5 | 7.3 | 2.8 | 20.0 | 94 | 0.04 | 0.17 | Present invention |
| | −4 | Hot rolled | 2.4 | {112}3.3 | 3.0 | 11.0 | 6.4 | 38.6 | 93 | 0.07 | 0.16 | Outside invention |
| D | −1 | Cold rolled | 1.3 | {112}1.9 | 4.1 | 11.8 | 6.4 | 39.5 | 95 | 0.07 | 0.16 | Outside invention |
| | −2 | Cold rolled | 7.3 | {112}15.4 | 2.8 | 8.3 | 0.3 | 9.3 | 92 | 0.02 | 0.16 | Present invention |
| | −3 | Hot rolled | 5.2 | {100}7.6 | 2.8 | 7.8 | 3.2 | 21.8 | 93 | 0.04 | 0.16 | Present invention |
| | −4 | Hot rolled | 2.5 | {100}3.3 | 1.7 | 11.4 | 6.9 | 41.6 | 79 | 0.07 | 0.13 | Outside invention |
| E | −1 | Cold rolled | 2.9 | {112}3.8 | 2.8 | # | # | # | 56 | # | 0.06 | Outside invention |
| | −2 | Cold rolled | 3.8 | {112}4.1 | 2.8 | 12.8 | 8.4 | 39.6 | 92 | 0.05 | 0.12 | Present invention |
| | −3 | Hot rolled | 3.6 | {100}4.2 | 2.6 | 11.2 | 7.4 | 38.6 | 96 | 0.05 | 0.13 | Present invention |
| | −4 | Hot rolled | 2.8 | {100}3.4 | 2.8 | 14.5 | 9.1 | 53.4 | 71 | 0.07 | 0.10 | Outside invention |
| F | −1 | Cold rolled | 2.7 | {100}3.5 | 3.1 | 12.9 | 8.0 | 47.8 | 43 | 0.07 | 0.07 | Outside invention |
| | −2 | Cold rolled | 6.0 | {100}8.7 | 1.2 | 8.5 | 4.8 | 25.6 | 52 | 0.04 | 0.09 | Outside invention |
| | −3 | Hot rolled | 3.5 | {112}3.3 | 2.1 | 9.0 | 4.9 | 31.4 | 52 | 0.05 | 0.08 | Outside invention |
| | −4 | Hot rolled | 2.8 | {112}3.5 | 2.6 | 11.7 | 6.8 | 41.4 | 61 | 0.07 | 0.10 | Outside invention |
| G | −1 | Cold rolled | 2.7 | {100}3.4 | 2.3 | 15.1 | 9.6 | 55.5 | 43 | 0.07 | 0.06 | Outside invention |
| | −2 | Cold rolled | 7.6 | {100}13.0 | 3.3 | 11.9 | 4.5 | 26.7 | 44 | 0.03 | 0.06 | Outside invention |
| | −3 | Hot rolled | 7.5 | {100}10.9 | 2.1 | 11.8 | 3.6 | 24.0 | 33 | 0.03 | 0.04 | Outside invention |
| | −4 | Hot rolled | 2.7 | {100}3.7 | 2.6 | 14.5 | 8.2 | 48.8 | 46 | 0.07 | 0.06 | Outside invention |

{112}: X-ray intensity of {112}<110> orientation is strong
{100}: X-ray intensity of {100}<110> orientation is strong

EXAMPLE 5-1

Steel strips obtained by heating the 25 types of steel materials shown in Table 14 to 1200° C. and hot rolling them under the hot rolling conditions within the range of the present invention were pickled by acid, then cold rolled to reduce the thickness to 1.0 mm. Thereafter, they were heated to the temperature $(Ac_1+Ac_3)/2$ expressed by the Ac, transformation temperature and $Ac_3$ transformation temperature calculated from the ingredients of the steels within the range of the annealing conditions of the present invention for 90 seconds, cooled at 5° C./second to 670° C., then cooled to 300° C. at 100° C./second. They were then reheated, then treated for bainite transformation at 400° C. for 5 minutes, then cooled to room temperature to obtain the cold-rolled steel sheets. Pre-deformation of 5% was applied to the direction (C direction) perpendicular to the cold rolling direction (L direction) of the cold-rolled steel sheets by uniaxial stretching, heat treatment was performed at 170° C. for 20 minutes for imitating baking treatment, then the dynamic properties of the steel sheets were examined and compared with static properties before the pre-deformation. The results thereof are shown in Table 15.

The shape fixability was evaluated by using samples in the form of strips having a length of 270 mm, a width of 50 mm, and the sheet thickness, shaping them to a hat shape with various blanking holding forces by a die having a punch width of 80 mm, punch shoulder R5 mm, and die shoulder R5 mm, then measuring the wall camber of wall portion as the curvature ρ (mm) and using a reciprocal 1000/ρ thereof. The smaller the 1000/ρ, the better the shape fixability. In general, it is known that the shape fixability is degraded when the strength of the steel sheet rises. From the results of shaping of actual parts by the present inventors, where 1000/ρ at the blanking holding force of 90 kN measured by the above method becomes (0.015×TS−4.5) or less with respect to the tensile strength TS of the steel sheet, the shape fixability conspicuously becomes good. Therefore, $1000/\rho \geqq \alpha$ (0.015×TS−4.5) was evaluated as the condition of good shape fixability. Here, if the blanking holding force is increased, 1000/ρ tends to decrease. However, the predominance of the shape fixability of the steel sheet does not change no matter what blanking holding force is selected. Accordingly, the evaluation at the blanking holding force of 90 kN is very representative of the shape fixability of the steel sheet.

For the deformation behavior at high speed, a one-bar method high speed tensile test device was used to perform a tensile test under the condition of a mean strain rate of 500 to 1500/s. σdyn was measured from the obtained stress-strain curve. Also, a static tensile test was performed using an Instron type tensile tester under conditions of a strain rate of 0.001 to 0.005/s. σst and TS were measured from the obtained stress-strain curve.

Figure 5:
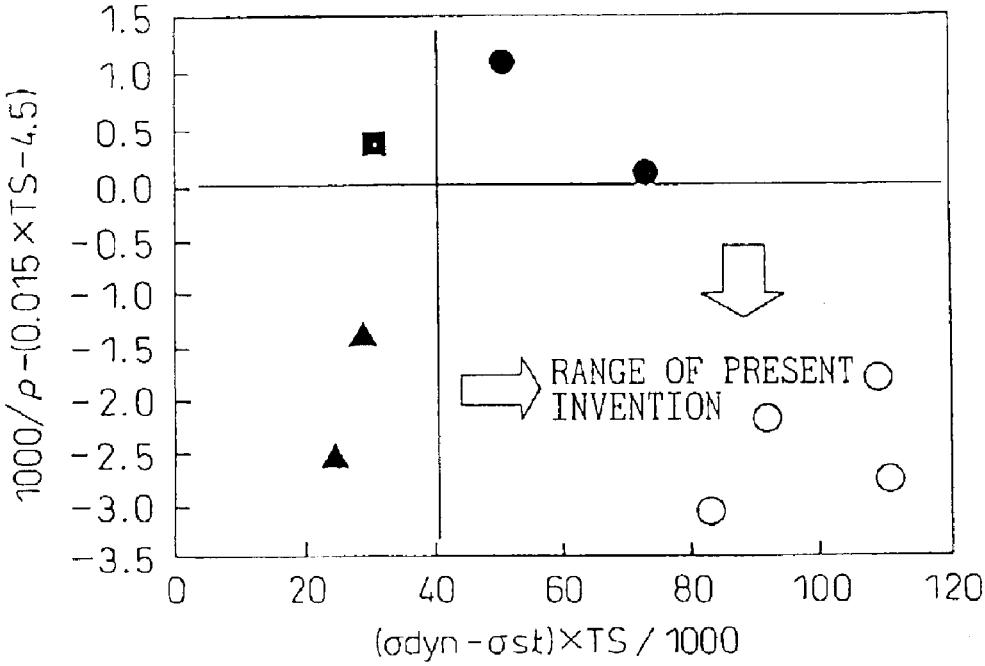
FIG. 5 is a graph showing the relationship between $(\sigma dyn-\sigma st)\times TS/1000$ and $1000/\rho-(0.015\times TS-4.5)$.

For samples having the compositions of steel within the range of the present invention, the value indicated in the column "*1" in the table is positive, that is, (σdyn−σst)×TS/1000 is 40 or more as aimed at, and, as shown in the column of "*2", the indicator 1000/ρ of the shape fixability is (0.015×TS−4.5) or less, so it is seen that these steels have both good shape fixability and absorption of impact energy. These relationships are shown in FIG. 5.

TABLE 14

| Symbol | Chemical composition (weight %) | | | | | | | | | | | | | | | | | | | | | | Remarks |
|---|---|---|---|---|---|---|---|---|---|---|---|---|---|---|---|---|---|---|---|---|---|---|---|
| | C | Si | Al | Si + Al | Mn | Ni | Cr | Cu | Mo | Sn | *1 | Co | Nb | Ti | V | *2 | P | S | N | B | Ca | Rem | |
| P1 | 0.05 | 1.20 | 0.040 | 1.240 | 1.50 | | | | | | 1.50 | | | | | 0 | 0.010 | 0.003 | 0.003 | | | | Steel of invention |
| P2 | 0.12 | 1.50 | 0.050 | 1.550 | 1.50 | | | | | | 1.50 | | | | | 0 | 0.012 | 0.005 | 0.002 | | | | Steel of invention |
| P3 | 0.20 | 1.20 | 0.040 | 1.240 | 1.50 | | | | | | 1.50 | | | | | 0 | 0.008 | 0.002 | 0.003 | | | | Steel of invention |
| P4 | 0.26 | 1.20 | 0.050 | 1.250 | 1.50 | | | | | | 1.50 | 0.2 | | | | 0 | 0.007 | 0.003 | 0.002 | | | | Steel of invention |
| P5 | 0.12 | 2.00 | 0.040 | 2.040 | 0.50 | 0.8 | | | | | 1.30 | | | | | 0 | 0.008 | 0.003 | 0.003 | | | | Steel of invention |
| P6 | 0.12 | 1.80 | 0.030 | 1.830 | 0.15 | | 1.8 | | | | 1.95 | | | | | 0 | 0.007 | 0.002 | 0.003 | | | | Steel of invention |
| P7 | 0.12 | 1.20 | 0.050 | 1.250 | 1.00 | | | 0.6 | | | 1.60 | | | | | 0 | 0.013 | 0.003 | 0.002 | | | | Steel of invention |
| P8 | 0.12 | 1.20 | 0.040 | 1.240 | 0.15 | 1.5 | | | 0.2 | | 1.85 | | | | | 0 | 0.012 | 0.005 | 0.003 | | | 0.002 | Steel of invention |
| P9 | 0.12 | 1.20 | 0.040 | 1.240 | 1.20 | | 2.0 | | | | 3.20 | | | | | 0 | 0.010 | 0.003 | 0.003 | | | | Steel of invention |
| P10 | 0.10 | 0.50 | 1.200 | 1.700 | 1.50 | | | | | 0.004 | 1.50 | | | | | 0 | 0.013 | 0.005 | 0.002 | | 0.001 | | Steel of invention |
| P11 | 0.14 | 0.01 | 1.500 | 1.510 | 1.50 | | | | | | 1.50 | 0.4 | | | | 0 | 0.012 | 0.003 | 0.002 | | 0.001 | | Steel of invention |
| P12 | 0.25 | 1.50 | 0.040 | 1.540 | 2.00 | | | | | | 2.00 | | | | | 0 | 0.012 | 0.005 | 0.002 | 0.002 | | | Steel of invention |
| P13 | 0.15 | 1.00 | 0.050 | 1.050 | 1.70 | | | | | | 1.70 | | | | | 0 | 0.100 | 0.003 | 0.003 | | | | Steel of invention |
| P14 | 0.10 | 1.20 | 0.040 | 1.240 | 1.50 | | | | | | 1.50 | | 0.01 | | | 0.01 | 0.008 | 0.003 | 0.003 | | | | Steel of invention |
| P15 | 0.10 | 1.20 | 0.040 | 1.240 | 1.50 | | | | | 0.01 | 1.51 | | | 0.02 | | 0.02 | 0.008 | 0.003 | 0.003 | | | | Steel of invention |
| P16 | 0.10 | 1.20 | 0.040 | 1.240 | 1.50 | | | | | | 1.50 | | 0.02 | | 0.03 | 0.05 | 0.008 | 0.003 | 0.003 | | | | Steel of invention |
| C1 | 0.02 | 1.20 | 0.040 | 1.240 | 1.50 | | | | | | 1.50 | | | | | 0 | 0.010 | 0.003 | 0.003 | | | | Comparative steel |
| C2 | 0.35 | 1.00 | 0.050 | 1.050 | 1.20 | | | | | | 1.20 | | | | | 0 | 0.008 | 0.002 | 0.003 | | | | Comparative steel |
| C3 | 0.12 | 0.20 | 0.040 | 0.240 | 1.50 | | | | | | 1.50 | | | | | 0 | 0.010 | 0.003 | 0.002 | | | | Comparative steel |
| C4 | 0.12 | 3.50 | 0.050 | 3.550 | 1.50 | | | | | | 1.50 | | | | | 0 | 0.010 | 0.003 | 0.003 | | | | Comparative steel |
| C5 | 0.10 | 1.50 | 0.040 | 1.540 | 1.50 | | | | | | 1.50 | | | | | 0 | 0.250 | 0.003 | 0.003 | | | | Comparative steel |
| C6 | 0.12 | 1.20 | 0.040 | 1.240 | 1.50 | | | | | | 1.50 | | | | | 0 | 0.010 | 0.003 | 0.003 | 0.012 | | | Comparative steel |
| C7 | 0.10 | 1.20 | 0.040 | 1.240 | 1.50 | 1.5 | | 1.0 | | | 4.00 | | | | | 0 | 0.010 | 0.002 | 0.003 | | | | Comparative steel |
| C8 | 0.12 | 1.50 | 0.050 | 1.550 | 0.10 | 0.2 | | | | | 0.30 | | | | | 0 | 0.010 | 0.002 | 0.003 | | | | Comparative steel |
| C9 | 0.12 | 1.20 | 0.040 | 1.240 | 1.50 | | | | | | 1.50 | | 0.20 | 0.15 | | 0.35 | 0.010 | 0.002 | 0.003 | | | | Comparative steel |

*1: Mn % + Ni % + Cr % + Cu % + Mo % + Sn %
*2: Nb % + Ti % + V %
underlines indicate outside present invention
Empty cells indicate nothing added

TABLE 15

| No | Steel | Skinpass rolling reduction rate % | Maximu phase of volume fraction ratio | Ferrite volume fraction ratio | Amount of Residual γ value | M value | r value of steel sheet rL | r value of steel sheet rC | Predefor-mation (%) | Predeformation | Residual γ amout after pre-defor-mation (Vg 5%) | Vg/VgO | Static property TS (MPa) | σ dyn-σ st (MPa) | *1 | X-ray in-tensity ratio of {100}<011>—{223}<110> orientation group | X-ray mean intensity ratio of {554}<225>, {111}<112>, {111}<110> orientation group | Evaluation of shape fixability *2 | Remarks |
|---|---|---|---|---|---|---|---|---|---|---|---|---|---|---|---|---|---|---|---|
| 1 | P1 | 0.8 | ferrite | 76 | 3.7 | 30.6 | 0.44 | 0.65 | 5 | C direction (Single axis) | 2.9 | 0.78 | 564 | 162 | 91 | 8.53 | 1.64 | ○ | Steel of invention |
| 2 | P2 | 0.8 | ferrite | 68 | 8.9 | 37.9 | 0.49 | 0.64 | 5 | C direction (Single axis) | 5.8 | 0.61 | 638 | 149 | 95 | 8.46 | 2.23 | ○ | Steel of invention |
| 3 | P3 | 0.8 | ferrite | 56 | 14.2 | 20.7 | 0.62 | 0.70 | 5 | C direction (Single axis) | 8.1 | 0.60 | 821 | 124 | 102 | 7.87 | 1.43 | ○ | Steel of invention |
| 4 | P4 | 0.8 | ferrite | 48 | 17.2 | 12.2 | 0.63 | 0.79 | 5 | C direction (Single axis) | 11.2 | 0.65 | 528 | 92 | 85 | 4.61 | 2.89 | ○ | Steel of invention |
| 5 | P5 | 0.8 | ferrite | 64 | 8.1 | 96.2 | 0.46 | 0.72 | 5 | C direction (Single axis) | 4.7 | 0.58 | 665 | 162 | 008 | 4.50 | 1.06 | ○ | Steel of invention |
| 6 | P6 | 0.8 | ferrite | 68 | 9.4 | 116.9 | 0.61 | 0.77 | 5 | C direction (Single axis) | 5.2 | 0.55 | 671 | 179 | 120 | 5.49 | 2.03 | ○ | Steel of invention |
| 7 | P7 | 0.8 | ferrite | 73 | 7.9 | −2.6 | 0.58 | 0.67 | 5 | C direction (Single axis) | 5.1 | 0.65 | 649 | 175 | 114 | 9.35 | 2.97 | ○ | Steel of invention |
| 8 | P8 | 0.8 | ferrite | 68 | 10.5 | −5.6 | 0.63 | 0.73 | 5 | C direction (Single axis) | 5.6 | 0.53 | 712 | 135 | 96 | 7.28 | 3.13 | ○ | Steel of invention |
| 9 | P9 | 0.8 | ferrite | 45 | 10.2 | 31.9 | 0.67 | 0.73 | 5 | C direction (Single axis) | 4.9 | 0.48 | 722 | 128 | 92 | 4.55 | 2.21 | ○ | Steel of invention |
| 10 | P10 | 0.8 | ferrite | 75 | 7.1 | 59.3 | 0.56 | 0.73 | 5 | C direction (Single axis) | 4.7 | 0.66 | 589 | 188 | 111 | 6.42 | 2.32 | ○ | Steel of invention |
| 11 | P11 | 0.8 | ferrite | 62 | 8.9 | 114.9 | 0.60 | 0.77 | 5 | C direction (Single axis) | 5.1 | 0.57 | 603 | 173 | 104 | 6.84 | 3.32 | ○ | Steel of invention |
| 12 | P12 | 0.8 | Bainite | 38 | 16.9 | 102.7 | 0.48 | 0.85 | 5 | C direction (Single axis) | 9.3 | 0.55 | 1168 | 38 | 44 | 4.34 | 1.22 | ○ | Steel of invention |
| 13 | P13 | 0.8 | ferrite | 46 | 12.0 | 39.8 | 0.49 | 0.73 | 5 | C direction (Single axis) | 7.2 | 0.60 | 784 | 127 | 100 | 9.09 | 1.16 | ○ | Steel of invention |
| 14 | P14 | 0.8 | ferrite | 76 | 7.0 | −22.1 | 0.68 | 0.81 | 5 | C direction (Single axis) | 4.0 | 0.57 | 672 | 153 | 103 | 6.12 | 3.13 | ○ | Steel of invention |
| 15 | P15 | 0.8 | ferrite | 74 | 5.8 | 12.2 | 0.48 | 0.68 | 5 | C direction (Single axis) | 3.0 | 0.52 | 681 | 148 | 101 | 10.21 | 1.68 | ○ | Steel of invention |
| 16 | P16 | 0.8 | ferrite | 72 | 6.1 | 0.7 | 0.58 | 0.76 | 5 | C direction (Single axis) | 3.7 | 0.60 | 692 | 149 | 103 | 5.25 | 2.27 | ○ | Steel of invention |
| 17 | C1 | 0.8 | ferrite | 87 | 0.0 | — | 0.64 | 0.71 | 5 | C direction (Single axis) | 0.0 | — | 502 | 65 | 33 | 4.25 | 1.88 | ○ | Comparative steel |
| 18 | C1 | 0.8 | Bainite | 26 | 15.7 | 201.8 | 0.59 | 0.79 | 5 | C direction (Single axis) | 2.1 | 0.13 | 1130 | 0 | 0 | 9.24 | 3.17 | ○ | Comparative steel |
| 19 | C3 | 0.8 | ferrite | 68 | 0.0 | — | 0.57 | 0.75 | 5 | C direction (Single axis) | 0.0 | — | 562 | 55 | 31 | 6.63 | 2.46 | ○ | Comparative steel |
| 20 | C4 | 0.8 | Bainite | 75 | 8.1 | 209.1 | 0.55 | 0.78 | 5 | C direction (Single axis) | 2.7 | 0.33 | 859 | 28 | 24 | 8.42 | 2.92 | ○ | Comparative steel |
| 21 | C5 | 0.8 | ferrite | 72 | 6.3 | 196.2 | 0.52 | 0.73 | 5 | C direction (Single axis) | 1.8 | 0.29 | 856 | 31 | 27 | 7.87 | 2.80 | ○ | Comparative steel |
| 22 | C6 | 0.8 | ferrite | 69 | 5.1 | 204.8 | 0.60 | 0.68 | 5 | C direction (Single axis) | 1.6 | 0.32 | 721 | 52 | 37 | 4.25 | 1.83 | ○ | Comparative steel |
| 23 | C7 | 0.8 | ferrite | 48 | 7.0 | 202.1 | 0.54 | 0.69 | 5 | C direction (Single axis) | 1.9 | 0.27 | 889 | 15 | 13 | 10.12 | 2.26 | ○ | Comparative steel |
| 24 | C8 | 0.8 | ferrite | 78 | 0.0 | — | 0.52 | 0.64 | 5 | C direction (Single axis) | 0.0 | — | 520 | 36 | 19 | 5.08 | 1.61 | ○ | Comparative steel |
| 25 | C9 | 0.8 | Bainite | 74 | 8.2 | 264.7 | 0.51 | 0.75 | 5 | C direction (Single axis) | 2.3 | 0.28 | 749 | 41 | 31 | 7.92 | 2.42 | ○ | Comparative steel |

*1: (σ dyn-σ st) × TS/1000
*2: Case where 1000/ρ (0.015 × TS-4.5) is satisfied "○", not satisfied "x"
Underlines indicate outside present invention

EXAMPLE 5-2

A steel of P2 shown in Table 14 was heated to 1050 to 1280° C., then hot rolled to a thickness of 1.4 mm under the conditions shown in Table 16 and cooled and then coiled. Thereafter, the shape fixability and static and dynamic deformation properties were examined by a similar method to that of Example 5-1. The results thereof are shown in Table 25. In all of No. 2, No. 3, No. 5, and No. 7 under hot rolling conditions within the range of the present invention, the indicator (σdyn−σst)×TS/1000 of the absorption of impact energy indicated by "*1" was 40 or more and the indicator 1000/ρ of the shape fixability indicated by "*2" was (0.015×TS−4.5) or less, so it is seen that both good absorption of impact energy and shape fixability are provided.

EXAMPLE 5-3

The steel of P2 shown in Table 14 was heated to 1050 to 1280° C., hot rolled to a thickness of 5.0 mm within the range of the conditions of the present invention, cooled, and then coiled. Thereafter, it was cold rolled to a thickness of 1.4 mm and annealed under the conditions shown in Table 17. Thereafter, by a similar method to that for Example 5-1, the shape fixability and the static and dynamic deformation properties were examined. The results thereof are shown in Table 17. In No. 1, No. 7, and No. 9 wherein the annealing condition or bainite treatment temperature after cold rolling was out of the range of the conditions of the present invention, either or both of "*1" in the table indicating the absorption of impact energy and "*2" in the table as the indicator of the shape fixability are out of the range of the conditions of the present invention. On the other hand, it is seen that all other steel sheets (steel sheets cold rolled within the range of conditions of the present invention and then annealed) are provided with both good absorption of impact energy and shape fixability.

TABLE 16

| | | Hot rolling condition | | | | | | | Skin-pass | | Amount | r value | | | |
|---|---|---|---|---|---|---|---|---|---|---|---|---|---|---|---|
| No | Steel | $Ar_3$/ ° C. | To/ ° C. | FT/ ° C. | *R | condition lubricant | CR/ ° C./ sec | CT/ ° C. | reduction rate % | Ferrite volume fraction ratio | of residual γ (VgO %) | M value | of steel sheet rL | of steel sheet rC | Pre-deformation (%) |
| 1 | P2 | 791 | 450 | 815 | 65 | x | 45 | <200 | 0.8 | 73 | 1.2 | 303.2 | 0.27 | 0.55 | 5 |
| 2 | | | | 818 | 65 | x | 45 | 350 | 2.5 | 72 | 6.8 | 80.7 | 0.15 | 0.44 | 5 |
| 3 | | | | 810 | 65 | x | 45 | 420 | 0.8 | 75 | 9.8 | 106.3 | 0.34 | 0.51 | 5 |
| 4 | | | | 812 | 65 | x | 45 | 530 | 0.8 | 75 | 0.5 | 50.7 | 0.91 | 0.89 | 5 |
| 5 | | | | 815 | 78 | ○ | 45 | 420 | 0.8 | 72 | 7.2 | 37.9 | 0.21 | 0.48 | 5 |
| 6 | | | | 730 | 65 | x | 45 | 350 | 0.8 | 88 | 0 | — | 0.53 | 0.84 | 5 |
| 7 | | | | 830 | 65 | x | *A | 350 | 0.8 | 75 | 8.5 | 93.5 | 0.43 | 0.66 | 5 |
| 8 | | | | 865 | 18 | x | 45 | 400 | 0.8 | 63 | 6.8 | 117.5 | 0.81 | 0.89 | 5 |
| 9 | | | | 915 | 0 | x | 45 | 400 | 0.8 | 58 | 6.5 | 162.0 | 0.96 | 0.91 | 5 |

| No | Applied pre-deformation | BH treatment | Amount of residual γ after pre-deformation (Vg %) | Vg/VgO | Static property TS (MPa) | σ dyn-σ st (MPa) | *1 | X-ray mean intensity ratio of {100}<011>–{223}<110> orientation group | X-ray mean intensity ratio of {554}<225>, {111}<112>, {111}<110> orientation group | Evaluation of shape fixability *2 | Remarks |
|---|---|---|---|---|---|---|---|---|---|---|---|
| 1 | C direction | Done | 0.00 | 0.00 | 821 | 30 | 25 | 8.50 | 2.33 | ○ | Comparative example |
| 2 | single axis tension | | 2.60 | 0.38 | 693 | 120 | 83 | 8.83 | 1.30 | ○ | Present invention |
| 3 | | | 4.70 | 0.48 | 853 | 141 | 92 | 5.49 | 1.88 | ○ | Present invention |
| 4 | | | 0.28 | 0.55 | 840 | 48 | 31 | 2.48 | 2.26 | x | Comparative example |
| 5 | | | 4.70 | 0.65 | 630 | 176 | 111 | 10.43 | 2.23 | ○ | Present invention |
| 6 | | | 0.00 | 0.50 | 745 | 39 | 29 | 8.63 | 4.56 | ○ | Comparative example |
| 7 | | | 4.25 | 0.50 | 848 | 169 | 109 | 4.93 | 2.11 | ○ | Present invention |
| 8 | | | 2.86 | 0.42 | 678 | 108 | 73 | 2.28 | 1.95 | x | Comparative example |

TABLE 16-continued

| | | | | | | | | | | | |
|---|---|---|---|---|---|---|---|---|---|---|---|
| 9 | Equal in double axis | | 4.80 | 0.49 | 653 | 78 | 51 | 1.88 | 2.02 | x | Comparative example |

*1: (σ dyn-σ st) × TS/1000
*2: Case where 1000/ρ ≦ (0.015 × TS-4.5) is satisfied "○", not satisfied "x"
*A: Total reduction rates in the temperature ranges ($Ar_3$ − 50)–($Ar_3$ + 100)° C.
*R: Cooling is divided three patters, primary cooling is carried out 45° C./sec, intermediate cooling is carried out air cooling, final cooling is carried out 50° C./sec.
Underlines indicate outside present invention

TABLE 17

| No | Steel | $Ac_1$/ ° C. | $Ac_3$/ ° C. | To/ ° C. | Annealing temperature ° C. | Bainite treatment temperature ° C. | Residense time at 300° C.–480° C. (sec) | Skin-pass reduction rate % | Ferrite volume fraction ratio | Amount of Residual γ (VgO %) | M value | r value of steel sheet rL | r value of steel sheet rC | Pre-deformation (%) |
|---|---|---|---|---|---|---|---|---|---|---|---|---|---|---|
| 1 | P2 | 742 | 848 | 450 | 730 | 380 | 380 | 0.8 | 82 | 0.0 | — | 0.58 | 0.62 | 5 |
| 2 | | | | | 800 | 380 | 380 | 0.8 | 71 | 7.8 | 33.6 | 0.52 | 0.62 | 5 |
| 3 | | | | | | 380 | 380 | 0.8 | 71 | 7.6 | 7.9 | 0.43 | 0.48 | 5 |
| 4 | | | | | | 380 | 360 | 0.8 | 72 | 7.5 | 46.4 | 0.49 | 0.59 | 5 |
| 5 | | | | | | 400 | 40 | 0.8 | 70 | 6.9 | 55.0 | 0.47 | 0.51 | 5 |
| 6 | | | | | | 400 | 400 | 0.8 | 72 | 7.2 | 12.2 | 0.60 | 0.58 | 5 |
| 7 | | | | | | 550 | 450 | 0.8 | 73 | 0.0 | — | 0.82 | 0.88 | 5 |
| 8 | | | | | | 400 | 400 | 0.8 | 72 | 6.8 | 20.7 | 0.51 | 0.55 | 5 |
| 9 | | | | | 955 | 400 | 400 | 0.8 | 61 | 3.0 | 179.1 | 1.11 | 1.22 | 5 |

| No | Applied pre-deformation | BH treatment | Amount of residual γ after pre-deformation (Vg %) | Vg/VgO | Static property TS (MPa) | σ dyn-σ st (MPa) | *1 | X-ray mean intensity ratio of {100}<011>–{223}<110> orientation group | X-ray mean intensity ratio of {554}<225>, {111}<112>, {111}<110> orientation group | Evaluation of shape fixability *2 | Remarks |
|---|---|---|---|---|---|---|---|---|---|---|---|
| 1 | C direction single axis tension | Done | — | — | 621 | 41 | 25 | 4.88 | 1.44 | ○ | Comparative example |
| 2 | | | 5.3 | 0.68 | 642 | 127 | 82 | 6.78 | 2.08 | ○ | Present invention |
| 3 | | | 5.9 | 0.78 | 644 | 154 | 99 | 8.45 | 1.16 | ○ | Present invention |
| 4 | | | 4.8 | 0.64 | 783 | 116 | 91 | 7.82 | 2.15 | ○ | Present invention |
| 5 | | | 3.2 | 0.46 | 664 | 127 | 84 | 8.82 | 1.88 | ○ | Present invention |
| 6 | | | 3.9 | 0.54 | 643 | 103 | 66 | 6.34 | 2.16 | ○ | Present invention |
| 7 | | | — | — | 628 | 46 | 29 | 2.95 | 2.84 | x | Comparative example |
| 8 | | | 4.2 | 0.62 | 648 | 98 | 64 | 7.38 | 1.36 | ○ | Present invention |
| 9 | | | 1.1 | 0.37 | 672 | 51 | 34 | 2.11 | 3.54 | x | Comparative example |

*1: (σ dyn-σ st) × TS/1000
*2: Case where 1000/ρ ≦ (0.015 × TS-4.5) is satisfied "○", not satisfied "x"
Underlines indicate outside present invention

EXAMPLE 6-1

The 23 types of steels shown in Table 18 were hot rolled under the conditions shown in Table 19 to thereby produce 1.4 mm thick hot-rolled steel sheets. These hot-rolled steel sheets were pickled by acid, and then test pieces having a width of 50 mm and length of 270 mm were prepared and subjected to a hat bending test by using a die of a punch width of 78 mm, punch shoulder R5, and die shoulder R5. Then, shape fixability is evaluated for these steel sheet as same way as described in Example 2.

In Table 20, the results (volume fraction maximum phase, martensite volume fraction) obtained by examining the microstructures of the steel sheets, mechanical properties (maximum strength TS, yield strength or 0.2% yield strength YS, and the r values in the rolling direction and the vertical direction to that obtained by a tensile test using an Instron type tensile tester at a strain rate of 0.001 to 0.005/s), mean value of the X-ray random intensity ratios of the group of {100}<011> to {223}<110> orientations at a sheet face at least at ½ sheet thickness, mean value of the X-ray random intensity ratios of three crystal orientations of {554}<225>, {111}<112>, and {111}<110>, and the dimensional accuracies and wall warpages obtained by the above bending test were shown.

Figure 6:
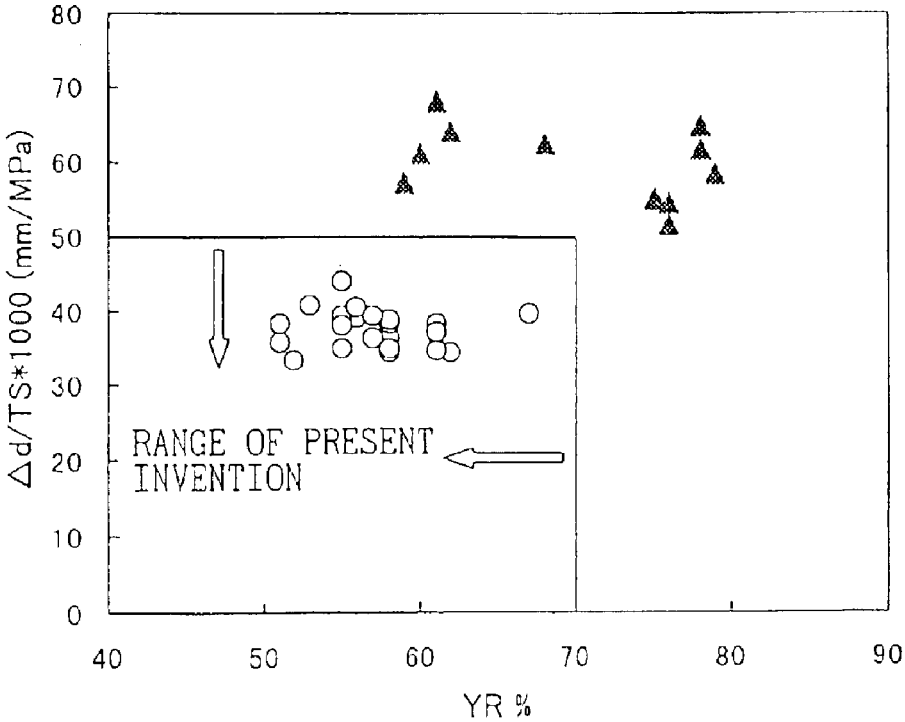
FIG. 6 is a graph showing the relationship between a ratio of a shape fixability (dimensional accuracy) and TS and YR.

The shape fixability can be finally decided by the dimensional accuracy (Δd). It is well known that the dimensional accuracy is degraded as the strength of the steel sheet rises, so, here, results shown in Table 29 were plotted with respect to YR with Δd/TS as an indicator (FIG. 6). Also, the results of Example 2 mentioned later are simultaneously plotted in FIG. 6.

As clear from Table 20 and FIG. 6, it is seen that steels within the range of the present invention are provided with both good shape fixability and low YR.

TABLE 18

| Symbol | Chemical composition (mass %) | | | | | | | | | | | | | | | | | | | | | | | Remarks |
|---|---|---|---|---|---|---|---|---|---|---|---|---|---|---|---|---|---|---|---|---|---|---|---|---|
| | C | Si | Al | Si + Al | Mn | Ni | Cr | Cu | Mo | W | Co | Sn | *1 | Nb | Ti | V | *2 | P | S | N | B | Ca | Rem | |
| P1 | 0.05 | 1.2 | 0.040 | 1.240 | 1.10 | | | | | | | | 1.10 | | | | 0 | 0.010 | 0.003 | 0.003 | 0.0005 | | | Steel of invention |
| P2 | 0.06 | 1.2 | 0.050 | 1.250 | 1.10 | | | | | | | | 1.10 | | | | 0 | 0.012 | 0.005 | 0.002 | 0.0008 | | | Steel of invention |
| P3 | 0.08 | 1.2 | 0.040 | 1.240 | 1.10 | | | | | | | | 1.10 | | | | 0 | 0.008 | 0.002 | 0.003 | | | | Steel of invention |
| P4 | 0.06 | 1.2 | 0.050 | 1.250 | 1.10 | | | | | | 0.2 | 0.02 | 1.32 | | | | 0 | 0.007 | 0.003 | 0.002 | | | | Steel of invention |
| P5 | 0.06 | 1.55 | 0.040 | 1.590 | 0.50 | 0.8 | | | | | | | 1.30 | | | | 0 | 0.008 | 0.003 | 0.003 | | | | Steel of invention |
| P6 | 0.06 | 1.2 | 0.030 | 1.230 | 0.15 | | 1.8 | | | | | | 1.95 | 0.04 | | | 0.04 | 0.007 | 0.002 | 0.003 | | | | Steel of invention |
| P7 | 0.06 | 1.2 | 0.050 | 1.250 | 1.00 | | | 0.6 | | | | | 1.60 | | | | 0 | 0.013 | 0.003 | 0.002 | 0.0012 | | | Steel of invention |
| P8 | 0.06 | 1.2 | 0.040 | 1.240 | 0.15 | 1.5 | | | 0.2 | | | | 1.85 | | | | 0 | 0.012 | 0.005 | 0.003 | | | 0.002 | Steel of invention |
| P9 | 0.06 | 1.2 | 0.040 | 1.240 | 0.06 | | 0.8 | | | 0.1 | | | 1.50 | | | | 0 | 0.010 | 0.003 | 0.003 | | | | Steel of invention |
| P10 | 0.06 | 0.5 | 0.035 | 0.535 | 1.50 | | | | | | | | 1.50 | 0.08 | 0.12 | | 0.2 | 0.013 | 0.005 | 0.002 | | 0.001 | | Steel of invention |
| P11 | 0.08 | 0.01 | 0.300 | 0.310 | 1.50 | | | | | | 0.4 | | 1.90 | | | | 0 | 0.012 | 0.003 | 0.002 | | 0.001 | | Steel of invention |
| P12 | 0.05 | 1.5 | 0.040 | 1.540 | 1.10 | | | | | | | | 1.10 | 0.015 | | | 0.015 | 0.012 | 0.005 | 0.002 | 0.002 | | | Steel of invention |
| P13 | 0.08 | 1.0 | 0.050 | 1.050 | 0.90 | | | | | | | | 0.90 | | | | 0 | 0.100 | 0.003 | 0.003 | | | | Steel of invention |
| P14 | 0.05 | 0.9 | 0.040 | 0.940 | 1.10 | | | | | | | | 1.10 | 0.01 | | | 0.01 | 0.008 | 0.003 | 0.003 | | | | Steel of invention |
| P15 | 0.05 | 0.9 | 0.040 | 0.940 | 1.10 | | | | | | | 0.05 | 1.15 | | 0.02 | | 0.02 | 0.008 | 0.003 | 0.003 | | | | Steel of invention |
| P16 | 0.05 | 0.9 | 0.040 | 0.940 | 1.10 | | | | | | | | 1.10 | 0.02 | | 0.03 | 0.05 | 0.008 | 0.003 | 0.003 | | | | Steel of invention |
| P17 | 0.16 | 0.1 | 0.035 | 0.135 | 2.30 | | | | | | | | 2.30 | 0.03 | 0.15 | | 0.18 | 0.012 | 0.005 | 0.003 | | | | Steel of invention |
| C1 | 0.01 | 1.2 | 0.040 | 1.240 | 1.50 | | | | | | | | 1.50 | | | | 0 | 0.010 | 0.003 | 0.003 | | | | Comparative steel |
| C2 | 0.36 | 1.0 | 0.050 | 1.050 | 1.20 | | | | | | | | 1.20 | | | | 0 | 0.008 | 0.002 | 0.003 | | | | Comparative steel |
| C3 | 0.05 | 3.2 | 0.040 | 3.240 | 1.10 | | | | | | | | 1.10 | | | | 0 | 0.010 | 0.003 | 0.002 | | | | Comparative steel |
| C4 | 0.05 | 1.2 | 0.040 | 1.240 | 1.50 | 1.5 | | 1.0 | | | | | 4.00 | | | | 0 | 0.010 | 0.003 | 0.003 | | | | Comparative steel |
| C5 | 0.06 | 1.0 | 0.050 | 1.050 | 0.05 | | | | | | | | 0.05 | | | | 0 | 0.010 | 0.002 | 0.003 | | | | Comparative steel |
| C6 | 0.06 | 0.9 | 0.040 | 0.940 | 1.00 | | | | | | | | 1.00 | 0.20 | 0.18 | | 0.38 | 0.010 | 0.002 | 0.003 | | | | Comparative steel |

Underlines indicate outside present invention.
Empty cells indicate nothing added.
*1 = Mn + Ni + Cr + Cu + Mo + W + Co + Sn
*2 = Nb + Ti + V

TABLE 19

| Symbol | Ar3 ° C. | To ° C. | Slab heating condition[1] | Finish rolling starting temperature ° C. | Hot rolling ending temperature ° C. | Initial thickness mm | Finished thickness mm | Reduction rate at Ar3 + 100° C. or less | Effective strain ε* | Presence of lubrication[3] | Mean cooling rate ° C./sec[4] | Cooling pattern[5] | Coiling temperature ° C. |
|---|---|---|---|---|---|---|---|---|---|---|---|---|---|
| P1 | 828 | 610 | 1200 | 980 | 850 | 21.4 | 2.3 | ○ | 0.493 | No | 55 | 3-stage | <200 |
| P2 | 825 | 606 | 1200 | 980 | 850 | 21.4 | 2.3 | ○ | 0.493 | No | 55 | Linear | <200 |
| P3 | 817 | 597 | 1200 | 980 | 850 | 21.4 | 2.3 | ○ | 0.493 | No | 55 | Linear | <200 |
| P4 | 824 | 611 | 1200 | 980 | 850 | 21.4 | 2.3 | ○ | 0.493 | No | 55 | Linear | <200 |
| P5 | 854 | 625 | 1200 | 1030 | 880 | 52.8 | 2.3 | ○ | 0.546 | No | 65 | Linear | <200 |
| P6 | 828 | 604 | 1200DR | 980 | 850 | 52.8 | 2.3 | ○ | 0.693 | No | 55 | Linear | <200 |
| P7 | 780 | 606 | 1200 | 980 | 830 | 21.4 | 2.3 | ○ | 0.565 | No | 40 | Linear | <200 |
| P8 | 825 | 633 | 1200 | 980 | 850 | 21.4 | 2.3 | ○ | 0.493 | No | 55 | Linear | <200 |
| P9 | 834 | 609 | 1200 | 980 | 850 | 21.4 | 2.3 | ○ | 0.493 | No | 55 | Linear | <200 |
| P10 | 765 | 590 | 1200 | 980 | 800 | 21.4 | 2.3 | ○ | 0.679 | No | 45 | Linear | <200 |
| P11 | 753 | 601 | 1200 | 980 | 800 | 21.4 | 2.3 | ○ | 0.679 | No | 45 | Linear | <200 |
| P12 | 838 | 608 | 1200 | 980 | 850 | 52.8 | 2.3 | ○ | 0.935 | Yes | 55 | 3-stage | <200 |
| P13 | 856 | 609 | 1500HCR | 980 | 880 | 52.8 | 2.3 | ○ | 0.567 | No | 60 | Late-stage | <200 |
| P14 | 817 | 612 | 1200 | 980 | 850 | 52.8 | 2.3 | ○ | 0.935 | No | 55 | Late-stage | <200 |
| P15 | 817 | 612 | 1200 | 980 | 850 | 52.8 | 2.3 | ○ | 0.935 | No | 55 | Linear | <200 |
| P16 | 817 | 611 | 1200 | 980 | 850 | 52.8 | 2.3 | ○ | 0.935 | No | 55 | Linear | <200 |
| P17 | 646 | 506 | 1200 | 860 | 730 | 21.4 | 2.3 | ○ | 1.210 | No | 40 | Linear | <200 |
| C1 | 804 | 607 | 1200 | 980 | 850 | 21.4 | 2.3 | ○ | 0.493 | No | 55 | Linear | <200 |
| C2 | 711 | 471 | 1200 | 980 | 780 | 21.4 | 2.3 | ○ | 0.761 | No | 40 | Linear | <200 |
| C3 | 894 | 597 | 1200 | 1050 | 930 | 21.4 | 2.3 | ○ | 0.211 | No | 60 | Linear | <200 |
| C4 | 630 | 562 | 1200 | 980 | 780 | 21.4 | 2.3 | x | 0.761 | No | 35 | Linear | <200 |
| C5 | 915 | 663 | 1200 | 1050 | 910 | 21.4 | 2.3 | ○ | 0.300 | No | 75 | Linear | <200 |
| C6 | 824 | 613 | 1200 | 980 | 850 | 21.4 | 2.3 | ○ | 0.493 | No | 55 | Linear | <200 |

[1]Figures are slab heating temperature.
DR indicates a heating furnace insertion temperature of at least Ae3, HCR a heating furnace insertion temperature of 250° C. to Ae3, and others less than 250° C.
[2]Case where sum of reduction rates in temperature range of Ar3 − 50° C. to Ar3 + 100° C. is 25% or more is indicated by "○" ("good"), while case where it is less than 25% is indicated by "x" ("poor").
[3]Case where lubrication is given at least at one pass in the temperature range of Ar3 − 50° C. to Ar3 + 100° C. and friction coefficient calculated from the reduction load is not more than 0.2 is indicated as "Yes".
[4]Mean cooling rate is mean cooling rate from end of hot rolling to coiling (calculated as 200° C).
[5]There are three types of cooling patterns: linear cooling (linear), cooling with intermediate air-cooling (3-stage), and cooling with delayed start (late-stage).
Underlines indicate outside present invention.

TABLE 20

| Symbol | Volume fraction maximum phase | Martensite volume fraction % | TS MPa | YS MPa | YR % | *1 | *2 | rL | rC | Dimensional accuracy Δd(mm) | Wall camber 1000/ρ (1/mm) | Springback(*) | Weldability *3 | Remarks |
|---|---|---|---|---|---|---|---|---|---|---|---|---|---|---|
| P1 | Ferrite | 4.4 | 564 | 327 | 58 | 8.53 | 1.64 | 0.44 | 0.65 | 20.51 | 3.25 | 5.57 | ○ | Example of invention |
| P2 | Ferrite | 4.8 | 638 | 364 | 57 | 8.46 | 2.23 | 0.49 | 0.64 | 23.22 | 4.14 | 5.39 | ○ | Example of invention |
| P3 | Ferrite | 6.3 | 721 | 397 | 55 | 7.87 | 2.49 | 0.62 | 0.70 | 25.19 | 4.90 | 7.98 | ○ | Example of invention |
| P4 | Ferrite | 11.6 | 658 | 401 | 61 | 4.65 | 2.43 | 0.63 | 0.79 | 25.10 | 4.25 | 6.59 | ○ | Example of invention |
| P5 | Ferrite | 4.2 | 711 | 476 | 67 | 4.50 | 1.06 | 0.46 | 0.72 | 28.22 | 5.48 | 6.24 | ○ | Example of invention |
| P6 | Ferrite | 8.2 | 688 | 365 | 53 | 5.49 | 2.03 | 0.61 | 0.77 | 27.90 | 4.65 | 7.83 | ○ | Example of invention |
| P7 | Ferrite | 6.8 | 657 | 368 | 56 | 9.35 | 2.44 | 0.58 | 0.67 | 25.72 | 4.18 | 5.24 | ○ | Example of invention |
| P8 | Ferrite | 13.0 | 712 | 392 | 55 | 7.28 | 2.48 | 0.63 | 0.73 | 28.04 | 4.97 | 7.96 | ○ | Example of invention |
| P9 | Ferrite | 5.1 | 649 | 331 | 51 | 4.55 | 2.21 | 0.67 | 0.73 | 23.26 | 4.14 | 6.19 | ○ | Example of invention |
| P10 | Ferrite | 11.9 | 832 | 516 | 62 | 6.42 | 2.32 | 0.56 | 0.73 | 28.64 | 5.77 | 7.63 | ○ | Example of invention |
| P11 | Bainite | 5.6 | 603 | 350 | 58 | 6.84 | 2.44 | 0.60 | 0.77 | 20.69 | 4.27 | 5.83 | ○ | Example of invention |
| P12 | Ferrite | 10.9 | 649 | 331 | 51 | 4.34 | 1.22 | 0.48 | 0.65 | 24.86 | 4.25 | 5.83 | ○ | Example of invention |
| P13 | Ferrite | 16.9 | 718 | 416 | 58 | 9.09 | 1.16 | 0.49 | 0.73 | 27.49 | 4.98 | 7.78 | ○ | Example of invention |

TABLE 20-continued

| Symbol | Volume fraction maximum phase | Marten-volume fraction % | TS MPa | YS MPa | YR % | *1 | *2 | rL | rC | Dimen-sional accuracy Δd(mm) | Wall camber 1000/ρ (1/mm) | Spring-back(*) | Weld-ability *3 | Remarks |
|---|---|---|---|---|---|---|---|---|---|---|---|---|---|---|
| P14 | Ferrite | 10.3 | 672 | 410 | 61 | 6.12 | 2.46 | 0.68 | 0.81 | 24.93 | 4.58 | 8.02 | ○ | Example of invention |
| P15 | Ferrite | 10.1 | 612 | 318 | 52 | 10.21 | 1.68 | 0.48 | 0.68 | 20.39 | 3.75 | 6.78 | ○ | Example of invention |
| P16 | Ferrite | 12.0 | 632 | 348 | 55 | 5.25 | 2.27 | 0.58 | 0.76 | 24.05 | 4.23 | 7.13 | ○ | Example of invention |
| P17 | Bainite | 21.5 | 1276 | 740 | 58 | 4.38 | 1.22 | 0.51 | 0.59 | 49.42 | 10.98 | 11.01 | ○ | Example of |
| C1 | Ferrite | 0.0 | 502 | 392 | 78 | 2.85 | 2.99 | 0.94 | 0.98 | 30.92 | 4.65 | 8.89 | ○ | Comparative example |
| C2 | Bainite | 29.0 | 1130 | 689 | 61 | 3.87 | 3.12 | 0.84 | 0.82 | 76.94 | 14.45 | 15.51 | x | Comparative example |
| C3 | Ferrite | 0.0 | 562 | 422 | 75 | 2.11 | 3.67 | 1.05 | 1.23 | 30.98 | 6.28 | 9.53 | ○ | Comparative example |
| C4 | Ferrite | 1.9 | 889 | 605 | 68 | 4.11 | 3.21 | 0.74 | 0.84 | 55.34 | 11.14 | 13.52 | ○ | Comparative example |
| C5 | Ferrite | 0.0 | 520 | 411 | 79 | 1.98 | 2.60 | 0.85 | 0.97 | 30.29 | 5.09 | 8.83 | ○ | Comparative example |
| C6 | Ferrite | 2.4 | 749 | 569 | 76 | 2.55 | 2.70 | 0.73 | 0.90 | 40.77 | 7.52 | 11.67 | ○ | Comparative example |

*1: Mean value of X-ray random intensity ratios of {100}<011> to {223}<110> group of orientations of sheet face at ½ sheet thickness.
*2: Mean value of three X-ray random intensity ratios of {554}<225>, {111}<112> and {111}<110>
*3: Case where cruciform joint weld tensile breakage strength is at least 8S% that of ordinary mild steel is indicated as "○" ("good"), while case where it is less is indicated as "x" ("poor").
Underlines indicate outside present invention.

EXAMPLE 6-2

A steel P3 in Table 18 was heated to 1200° C., then hot rolled, cold rolled, and annealed under the conditions shown in Table 21 to prepare a cold rolled annealed steel sheet of 1.4 mm, then evaluated in the same way as in Example 6-1.

In Table 22, the microstructures, mechanical properties, and bending test results of the obtained cold-rolled and annealed materials are shown.

As clear from Table 22 and FIG. 6, it is seen that steels within the range of the present invention are provided with both good shape fixability and low YR.

TABLE 21

| Symbol | Ac1 ° C. | Ac3 ° C. | Ar3 ° C. | To temperature ° C. | Finishing hot rolling start temperature ° C. | Hot rolling temperature ° C. | Initial thickness mm | Finished thickness mm | Reduction rate at Ar3 + 100° C. or less %[1] | Effective strain ϵ* | Presence of lubrication[2] | Coiling temperature ° C. | Cold rolling reduction rate % | Annealing temperature ° C. | Cooling rate to 400° C. ° C./s[3] | Cooling pattern down to 400° C.[4] | Remarks |
|---|---|---|---|---|---|---|---|---|---|---|---|---|---|---|---|---|---|
| P3 | 746 | 875 | 817 | 597 | 980 | 815 | 43 | 4.2 | ○ | 0.617 | ○ | 480 | 40 | 800 | 40 | (c) | Example of invention |
| | | | | | 980 | 850 | 51.2 | 5.0 | ○ | 0.492 | ○ | 480 | 50 | 840 | 40 | (c) | Example of invention |
| | | | | | 980 | 850 | 43 | 4.2 | ○ | 0.492 | ○ | 480 | 40 | 800 | 0.5 | (c) | Comparative example |
| | | | | | 980 | 835 | 43 | 4.2 | ○ | 0.544 | ○ | 480 | 40 | 815 | 40 | (b) | Example of invention |
| | | | | | 980 | 820 | 51.2 | 5.0 | ○ | 0.599 | ○ | 480 | 50 | 800 | 120 | (c) | Example of invention |
| | | | | | 980 | 820 | 36.9 | 3.6 | ○ | 0.599 | ○ | 480 | 30 | 820 | 40 | (a) | Example of invention |
| | | | | | 980 | 850 | 46.5 | 5.0 | ○ | 0.428 | ○ | 480 | 50 | 720 | 75 | (c) | Comparative example |
| | | | | | 980 | 850 | 46.5 | 5.0 | ○ | 0.428 | ○ | 480 | 50 | 905 | 40 | (c) | Comparative example |
| | | | | | 1035 | 915 | 46.5 | 5.0 | x | 0.250 | ○ | 480 | 50 | 800 | 40 | (c) | Comparative example |
| | | | | | 980 | 850 | 46.5 | 5.0 | ○ | 0.428 | ○ | 660 | 50 | 800 | 40 | (c) | Comparative example |

[1]Case where sum of reduction rates in temperature range of Ar3 − 250° C. to Ar3 + 100° C. is 25% or more is indicated by "○" ("good"), while case where it is less than 25% is indicated by "x" ("poor").
[2]Case where lubrication is given at least at one pass in the temperature range of Ar3 − 250° C. to Ar3 + 100° C. and friction coefficient calculated from the reduction load is not more than 0.2 is indicated as "○" ("good"), while case where it is over 0.2 is indicated as "x" ("poor").
[3]Figures are mean cooling rate to 400° C. after annealing in ° C./sec.
[4](a): Cooling to room temperature without stopping in between (cooling rate of 3 to 100° C./sec)
(b): Cooling to 300° C. or less, then reheating and heat treating in temperature range of 200° C. to 400° C. for 15 seconds to 30 minutes, then cooling to room temperature.
(c): Cooling by cooling rate in range of 3 to 100° C./sec in range of 200° C. to 400° C., heat treating in that temperature range for 15 seconds to 30 minutes, then cooling to room temperature.
Underlines indicate outside present invention.

TABLE 22

| Symbol | Volume fraction maximum phase | Marten-volume fraction % | TS MPa | YS MPa | YR % | *1 | *2 | rL | rC | Dimen-sional accuracy Δd(mm) | Wall camber 1000/ρ (1/mm) | Spring-back(*) | Weld-ability *3 | Remarks |
|---|---|---|---|---|---|---|---|---|---|---|---|---|---|---|
| P3 | Ferrite | 7.5 | 742 | 430 | 58 | 8.53 | 1.64 | 0.49 | 0.59 | 39.9 | 6.4 | 6.2 | ○ | Example of invention |
| | Ferrite | 11.2 | 763 | 435 | 57 | 8.46 | 2.23 | 0.47 | 0.65 | 39.1 | 6.6 | 6.3 | ○ | Example of invention |
| | Ferrite | 0 | 692 | 540 | 78 | 2.37 | 1.67 | 0.78 | 0.79 | 47.2 | 7.8 | 11.2 | ○ | Comparative example |
| | Ferrite | 8.1 | 734 | 411 | 56 | 5.44 | 1.36 | 0.46 | 0.58 | 37.2 | 6.3 | 7.3 | ○ | Example of invention |
| | Ferrite | 11.8 | 758 | 417 | 55 | 6.31 | 0.98 | 0.47 | 0.59 | 39.9 | 6.6 | 7.5 | ○ | Example of invention |
| | Ferrite | 10.3 | 732 | 447 | 61 | 4.22 | 1.43 | 0.54 | 0.65 | 37.6 | 6.2 | 5.9 | ○ | Example of invention |
| | Ferrite | 0 | 675 | 513 | 76 | 3.12 | 3.82 | 0.93 | 0.98 | 43.2 | 7.6 | 12.0 | ○ | Comparative example |
| | Ferrite | 12.1 | 792 | 491 | 62 | 2.20 | 1.85 | 0.87 | 0.81 | 66.0 | 9.1 | 12.1 | ○ | Comparative example |
| | Ferrite | 7.5 | 755 | 445 | 59 | 1.18 | 2.15 | 1.11 | 1.34 | 52.6 | 9.1 | 11.0 | ○ | Comparative example |
| | Ferrite | 10.6 | 739 | 443 | 60 | 1.93 | 1.88 | 0.77 | 0.89 | 53.2 | 9.1 | 11.5 | ○ | Comparative example |

*1: Mean value of X-ray random intensity ratios of {100}<011> to {223}<110> group of orientations of sheet face at ½ sheet thickness.
*2: Mean value of three X-ray random intensity ratios of {554}<225>, {111}<112>, and {111}<110>
*3: Case where cruciform joint weld tensile breakage strength is at least 85% that of ordinary mild steel is indicated as "○" ("good"), while case where it is less is indicated as "x" ("poor").
Underlines indicate outside present invention.

EXAMPLE 7

An explanation will be made of results of a study using steels of A to I having compositions shown in Table 23. These steels were cast and then hot rolled as they were or after once cooling to room temperature, then reheating to a temperature range of 900° C. to 1300° C., to finally shape them to 1.4 mm thick, 3.0 mm thick, or 8.0 mm thick hot-rolled steel sheets. The hot-rolled steel sheets having the thickness of 3.0 mm and the thickness of 8.0 mm were cold rolled to reduce them to the thickness of 1.4 mm, then annealed in a continuous annealing step.

Then, shape fixiability is evaluated for these steel sheet as same way as described in Example 2.

Table 24 shows whether or not the production conditions of the steel sheets are within the range of the production conditions of the present invention. The "Hot rolling temperature" was evaluated as "O" ("good") where the sum of reduction rates at the $Ar_3$ temperature to $(Ar_3+100)$° C. was 25% and the hot rolling ending temperature was within that temperature range, while was evaluated as "X" ("poor") where the sum of the reduction rates in that temperature zone was less than 25%.

In that temperature range, where the friction coefficient for at least one pass is 0.2 or less, "O" ("good") was entered in the column "Lubrication", while where the friction coefficient in all passes exceeded 0.2, "Δ" ("fair") was entered. In the column "Cooling rate", the mean cooling rate from the hot rolling ending temperature to To (° C.) is shown. The coiling was all performed at 250° C. to To (° C.) found by the above Equation (1).

Where such hot-rolled steel sheets were cold rolled to a 1.4 mm thickness, when the cold rolling reduction rate was 80% or more, the "Cold rolling reduction rate" was evaluated as "X" ("poor"), while when it was "Less than 80%", it was evaluated as "O" ("good"). Also, where the annealing temperature was 600° C. to $(Ac_3+100)$° C., the "Annealing temperature" was evaluated as "O" ("good"), while in cases other than that, it was evaluated as "X" ("poor"). Items not related as the conditions of production were indicated as "-". Skin pass rolling was applied with a reduction rate of 0.5 to 1.5% to both the hot-rolled steel sheets and the cold-rolled steel sheets.

The X-ray measurement was performed by preparing a sample parallel to the sheet face at a position of 7/16 sheet thickness as a representative value of the steel sheet.

The mechanical properties of the 1.4 mm thick hot-rolled steel sheets and cold-rolled steel sheets produced by the above method are shown in Table 25, and the dimensional accuracies, springbacks, and the wall camber are shown in Table 26. In all steel types except the steel H in Table 25 and Table 26, examples of numbers "-2" and "-3" are those of the present invention. In them, it is seen that the springback and the wall warpage become small and the dimensional accuracy is improved in comparison with those of numbers "-1" and "-4" outside the invention.

Figure 7:
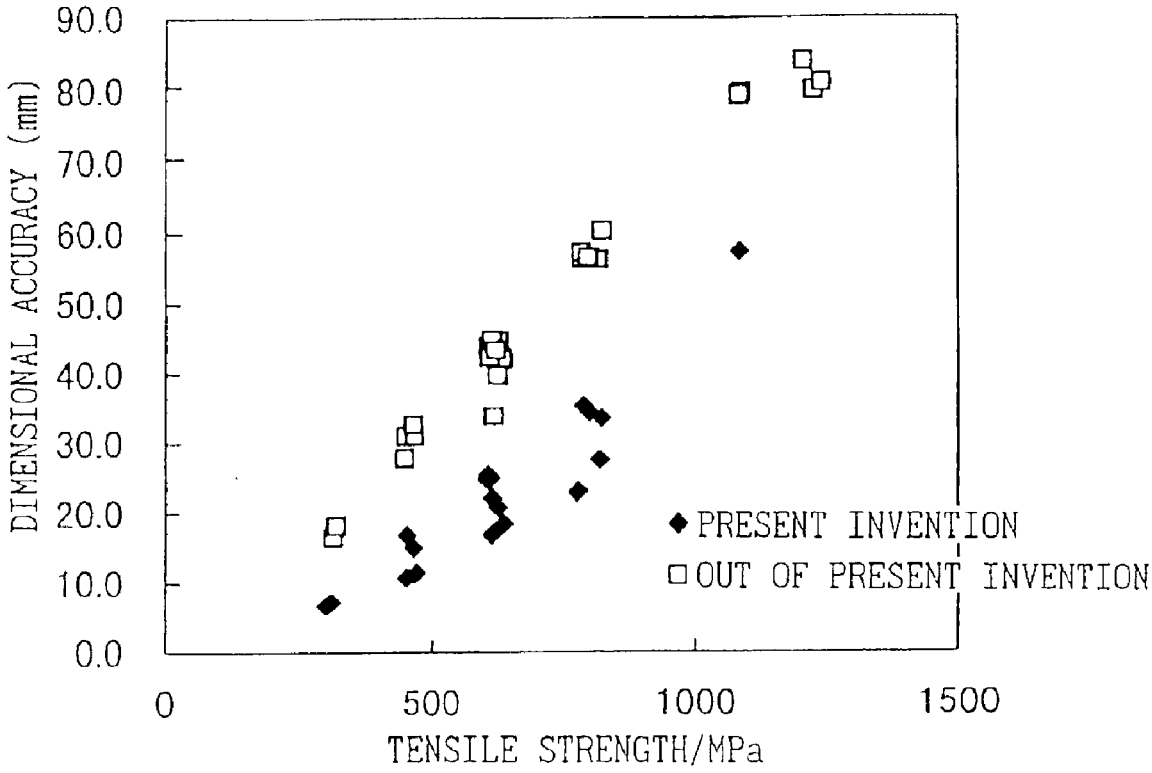
FIG. 7 is a graph showing the relationship between the tensile strength and the dimensional accuracy.

Also, in FIG. 7, the relationships of the tensile strength and dimensional accuracy shown in Table 25 and Table 26 are shown. As apparent also from these relationships, at any strength level, good shape fixability is obtained first after satisfying the X-ray random intensity ratios and r values of the crystal orientations limited in the present invention.

TABLE 23

| Steel type | C | Si | Mn | P | S | Al | Ti | Nb | V | Cr | Mo | Cu | Ni | B | N | O | Sn | Ca/Rem | Class |
|---|---|---|---|---|---|---|---|---|---|---|---|---|---|---|---|---|---|---|---|
| A | 0.0028 | 0.01 | 0.10 | 0.007 | 0.006 | 0.046 | 0.053 | 0.012 | — | — | — | — | — | 0.0003 | 0.0023 | 0.003 | — | — | Steel of invention |
| B | 0.048 | 0.42 | 1.16 | 0.023 | 0.004 | 0.049 | — | — | — | — | — | — | — | — | 0.0030 | 0.002 | — | — | Steel of invention |
| C | 0.052 | 0.38 | 1.09 | 0.010 | 0.008 | 0.016 | 0.042 | 0.015 | — | — | — | 0.02 | 0.01 | — | 0.0019 | 0.004 | — | — | Steel of invention |
| D | 0.08 | 0.28 | 1.35 | 0.017 | 0.005 | 0.042 | — | 0.035 | — | — | — | — | — | — | 0.0027 | 0.002 | — | — | Steel of invention |
| E | 0.09 | 0.62 | 2.25 | 0.010 | 0.006 | 0.031 | 0.050 | — | — | — | — | — | — | 0.001 | 0.0018 | 0.002 | — | — | Steel of invention |
| F | 0.152 | 0.56 | 3.12 | 0.006 | 0.005 | 0.034 | 0.056 | 0.023 | — | — | — | — | — | — | 0.0024 | 0.004 | — | — | Comparative steel |
| G | 0.11 | 1.23 | 1.48 | 0.012 | 0.005 | 0.042 | — | — | — | — | 0.01 | — | — | — | 0.0027 | 0.003 | — | — | Steel of invention |
| H | 0.15 | 2.04 | 1.73 | 0.021 | 0.006 | 0.049 | — | — | 0.02 | — | — | — | — | — | 0.0029 | 0.004 | — | Ca: 0.002 | Steel of invention |
| I | 0.154 | 0.33 | 2.21 | 0.025 | 0.012 | 0.034 | — | — | — | — | — | — | — | — | 0.0018 | 0.002 | — | — | Steel of invention |

(Note)
Underlines indicate conditions outside range of present invention.

TABLE 24

| | | Hot rolling condition | | | Cold rolling Annealing conditions | | |
|---|---|---|---|---|---|---|---|
| Steel type | Class of steel sheet | Hot rolling temperature | Lubricant | Cooling rate (° C./s) | Cold rolling reduction rate | Annealing temperature | Remarks |
| A | −1 Cold rolled | ○ | Δ | 7 | x | ○ | Outside invention |
| | −2 Cold rolled | ○ | Δ | 20 | ○ | ○ | Present invention |
| | −3 Hot rolled | ○ | Δ | 30 | — | — | Present invention |
| | −4 Hot rolled | x | Δ | 30 | — | — | Outside invention |
| B | −1 Cold rolled | x | ○ | 50 | ○ | ○ | Outside invention |
| | −2 Cold rolled | ○ | ○ | 30 | ○ | ○ | Present invention |
| | −3 Hot rolled | ○ | ○ | 60 | — | — | Present invention |
| | −4 Hot rolled | x | ○ | 20 | — | — | Outside invention |
| C | −1 Cold rolled | ○ | ○ | 40 | x | ○ | Outside invention |
| | −2 Cold rolled | ○ | ○ | 30 | ○ | ○ | Present invention |
| | −3 Hot rolled | ○ | ○ | 20 | — | — | Present invention |
| | −4 Hot rolled | x | ○ | 30 | — | — | Outside invention |
| D | −1 Cold rolled | ○ | Δ | 30 | ○ | x | Outside invention |
| | −2 Cold rolled | ○ | Δ | 30 | ○ | ○ | Present invention |
| | −3 Hot rolled | ○ | Δ | 30 | — | — | Present invention |
| | −4 Hot rolled | x | Δ | 30 | — | — | Outside invention |
| E | −1 Cold rolled | x | Δ | 70 | ○ | ○ | Outside invention |
| | −2 Cold rolled | ○ | ○ | 70 | ○ | ○ | Present invention |
| | −3 Hot rolled | ○ | ○ | 70 | — | — | Present invention |
| | −4 Hot rolled | x | Δ | 70 | — | — | Outside invention |
| F | −1 Cold rolled | ○ | Δ | 18 | x | ○ | Outside invention |
| | −2 Cold rolled | ○ | Δ | 18 | ○ | ○ | Present invention |
| | −3 Hot rolled | ○ | Δ | 16 | — | — | Present invention |
| | −4 Hot rolled | ○ | Δ | 3 | — | — | Outside invention |
| G | −1 Cold rolled | ○ | Δ | 25 | x | x | Outside invention |
| | −2 Cold rolled | ○ | ○ | 20 | ○ | ○ | Present invention |
| | −3 Hot rolled | ○ | ○ | 20 | — | — | Present invention |
| | −4 Hot rolled | x | Δ | 25 | — | — | Outside invention |
| H | −1 Cold rolled | ○ | ○ | 25 | ○ | x | Outside invention |
| | −2 Cold rolled | ○ | ○ | 40 | ○ | ○ | Present invention |
| | −3 Hot rolled | ○ | ○ | 40 | — | — | Present invention |
| | −4 Hot rolled | x | Δ | 30 | — | — | Outside invention |

TABLE 24-continued

| Steel type | Class of steel sheet | Hot rolling temperature | Lubricant | Cooling rate (° C./s) | Cold rolling reduction rate | Annealing temperature | Remarks |
|---|---|---|---|---|---|---|---|
| | | Hot rolling condition | | | Cold rolling | Cold rolling Annealing conditions | |
| I | −1 Cold rolled | x | Δ | 70 | ○ | ○ | Outside invention |
| | −2 Cold rolled | ○ | ○ | 70 | ○ | ○ | Outside invention |
| | −3 Hot rolled | ○ | ○ | 70 | — | — | Outside invention |
| | −4 Hot rolled | x | Δ | 70 | — | — | Outside invention |

TABLE 25

| Steel type | Class of steel sheet | Yield strength (MPa) | Tensile strength (MPa) | Elongation (%) | rL | rC | Remarks |
|---|---|---|---|---|---|---|---|
| | | Mechanical properties | | | | | |
| A | −1 Cold rolled | 167 | 312 | 55 | 2.12 | 2.45 | Outside invention |
| | −2 Cold rolled | 164 | 308 | 55 | 0.61 | 0.81 | Present invention |
| | −3 Hot rolled | 157 | 297 | 54 | 0.59 | 0.74 | Present invention |
| | −4 Hot rolled | 171 | 318 | 53 | 0.87 | 0.91 | Outside invention |
| B | −1 Cold rolled | 294 | 448 | 40 | 0.89 | 0.92 | Outside invention |
| | −2 Cold rolled | 300 | 452 | 40 | 0.64 | 0.79 | Present invention |
| | −3 Hot rolled | 296 | 450 | 39 | 0.56 | 0.71 | Present invention |
| | −4 Hot rolled | 296 | 451 | 38 | 0.78 | 0.82 | Outside invention |
| C | −1 Cold rolled | 321 | 467 | 36 | 1.01 | 1.18 | Outside invention |
| | −2 Cold rolled | 320 | 471 | 36 | 0.46 | 0.60 | Present invention |
| | −3 Hot rolled | 315 | 465 | 35 | 0.53 | 0.68 | Present invention |
| | −4 Hot rolled | 313 | 465 | 36 | 0.83 | 0.99 | Outside invention |
| D | −1 Cold rolled | 545 | 627 | 7 | * | * | Outside invention |
| | −2 Cold rolled | 452 | 615 | 29 | 0.5 | 0.64 | Present invention |
| | −3 Hot rolled | 473 | 638 | 27 | 0.48 | 0.62 | Present invention |
| | −4 Hot rolled | 470 | 635 | 28 | 0.92 | 1.09 | Outside invention |
| E | −1 Cold rolled | 478 | 788 | 25 | 0.77 | 0.81 | Outside invention |
| | −2 Cold rolled | 470 | 782 | 24 | 0.45 | 0.59 | Present invention |
| | −3 Hot rolled | 469 | 779 | 25 | 0.43 | 0.57 | Present invention |
| | −4 Hot rolled | 472 | 786 | 25 | 0.83 | 0.72 | Outside invention |
| F | −1 Cold rolled | 1119 | 1243 | 3 | * | * | Outside invention |
| | −2 Cold rolled | 1080 | 1206 | 6 | * | * | Outside invention |
| | −3 Hot rolled | 1100 | 1226 | 5 | * | * | Outside invention |
| | −4 Hot rolled | 1121 | 1242 | 5 | * | * | Outside invention |
| G | −1 Cold rolled | 535 | 613 | 9 | * | * | Outside invention |
| | −2 Cold rolled | 442 | 610 | 36 | 0.68 | 0.83 | Present invention |
| | −3 Hot rolled | 444 | 609 | 35 | 0.67 | 0.82 | Present invention |
| | −4 Hot rolled | 448 | 616 | 35 | 1.01 | 1.00 | Outside invention |
| H | −1 Cold rolled | 706 | 798 | 6 | * | * | Outside invention |
| | −2 Cold rolled | 623 | 802 | 28 | 0.6 | 0.75 | Present invention |
| | −3 Hot rolled | 614 | 792 | 29 | 0.62 | 0.77 | Present invention |
| | −4 Hot rolled | 620 | 800 | 29 | 0.86 | 0.95 | Outside invention |
| L | −1 Cold rolled | 742 | 1089 | 24 | 0.86 | 0.89 | Outside invention |
| | −2 Cold rolled | 735 | 1084 | 24 | 0.61 | 0.74 | Present invention |
| | −3 Hot rolled | 740 | 1111 | 25 | 0.62 | 0.77 | Present invention |
| | −4 Hot rolled | 726 | 1084 | 26 | 0.87 | 0.95 | Outside invention |

*: Uniform elongation was small and r value could not be measured.

TABLE 26

| Steel type | Class of steel sheet | X-ray intensity ratio of {001}<110>–{223}<110> orientation group | X-ray intensity ratio of {112}<110> | X-ray intensity ratio of {554}<225>, {111}<110> orientation group | Amount of springback (°) | Wall camber $1/\rho \times 10^3$ ($mm^{-1}$) | Dimensional accuracy (mm) | Remarks |
|---|---|---|---|---|---|---|---|---|
| A | −1 Cold rolled | 2.8 | 3.6 | 9.6 | 7.4 | 2.3 | 16.4 | Outside invention |
| | −2 Cold rolled | 4.9 | 8.7 | 2.7 | 4.4 | 0.9 | 7.2 | Present invention |
| | −3 Hot rolled | 5.2 | 9.5 | 2.3 | 3.6 | 0.6 | 6.7 | Present invention |
| | −4 Hot rolled | 2.5 | 3.0 | 1.9 | 7.3 | 2.4 | 18.1 | Outside invention |

TABLE 26-continued

| Steel type | Class of steel sheet | X-ray intensity ratio of {001}<110>–{223}<110> orientation group | X-ray intensity ratio of {112}<110> | X-ray intensity ratio of {554}<225>, {111}<110> orientation group | Amount of springback (°) | Wall camber $1/\rho \times 10^3$ ($mm^{-1}$) | Dimensional accuracy (mm) | Remarks |
|---|---|---|---|---|---|---|---|---|
| B | −1 Cold rolled | 2.6 | 3.3 | 2.9 | 10.8 | 4.2 | 27.8 | Outside invention |
| | −2 Cold rolled | 4.6 | 6.2 | 2.6 | 7.0 | 2.1 | 16.8 | Present invention |
| | −3 Hot rolled | 6.1 | 9.9 | 2.4 | 7.3 | 1.2 | 10.7 | Present invention |
| | −4 Hot rolled | 2.3 | 2.3 | 2.7 | 10.9 | 4.8 | 30.9 | Outside invention |
| C | −1 Cold rolled | 2.2 | 2.8 | 4.2 | 11.5 | 5.0 | 30.9 | Outside invention |
| | −2 Cold rolled | 10.2 | 14.7 | 2.6 | 7.3 | 1.3 | 11.4 | Present invention |
| | −3 Hot rolled | 9.3 | 11.5 | 2.4 | 7.0 | 1.8 | 15.0 | Present invention |
| | −4 Hot rolled | 2.3 | 3.1 | 2.3 | 10.6 | 5.1 | 32.5 | Outside invention |
| D | −1 Cold rolled | 2.6 | 2.6 | 2.6 | 14.9 | 6.7 | 39.7 | Outside invention |
| | −2 Cold rolled | 9.2 | 12.8 | 2.3 | 10.6 | 2.3 | 16.8 | Present invention |
| | −3 Hot rolled | 10.1 | 13.9 | 2.1 | 10.9 | 2.6 | 18.4 | Present invention |
| | −4 Hot rolled | 2.0 | 2.7 | 2.9 | 15.2 | 6.9 | 42.0 | Outside invention |
| E | −1 Cold rolled | 2.6 | 3.1 | 3.0 | 18.8 | 9.7 | 56.4 | Outside invention |
| | −2 Cold rolled | 9.1 | 15.4 | 3.0 | 13.7 | 3.3 | 23.0 | Present invention |
| | −3 Hot rolled | 9.4 | 16.3 | 2.4 | 13.9 | 3.4 | 22.8 | Present invention |
| | −4 Hot rolled | 2.7 | 3.2 | 2.4 | 18.2 | 9.8 | 57.2 | Outside invention |
| F | −1 Cold rolled | 2.6 | 3.0 | 4.2 | # | # | # | Outside invention |
| | −2 Cold rolled | 6.2 | 8.6 | 2.9 | 27.3 | 15.6 | 83.9 | Outside invention |
| | −3 Hot rolled | 5.6 | 6.7 | 2.3 | 28.7 | 17.0 | 79.9 | Outside invention |
| | −4 Hot rolled | 2.9 | 3.5 | 2.7 | 28.9 | 16.2 | 81.0 | Outside invention |
| G | −1 Cold rolled | 2.7 | 2.6 | 3.7 | 14.2 | 6.9 | 42.3 | Outside invention |
| | −2 Cold rolled | 3.2 | 4.2 | 2.4 | 10.6 | 4.2 | 25.2 | Present invention |
| | −3 Hot rolled | 3.4 | 4.9 | 2.6 | 9.9 | 4.0 | 25.4 | Present invention |
| | −4 Hot rolled | 1.7 | 2.1 | 2.1 | 14.3 | 7.4 | 44.8 | Outside invention |
| H | −1 Cold rolled | 1.8 | 2.3 | 2.9 | # | # | # | Outside invention |
| | −2 Cold rolled | 5.2 | 8.2 | 2.3 | 13.9 | 5.4 | 34.3 | Present invention |
| | −3 Hot rolled | 4.6 | 7.1 | 2.0 | 14.4 | 5.9 | 35.3 | Present invention |
| | −4 Hot rolled | 2.5 | 2.5 | 2.0 | 18.3 | 9.7 | 56.5 | Outside invention |
| I | −1 Cold rolled | 2.3 | 2.3 | 2.9 | 25.1 | 14.1 | 79.7 | Outside invention |
| | −2 Cold rolled | 5.2 | 8.3 | 2.1 | 19.9 | 10.1 | 57.3 | Present invention |
| | −3 Hot rolled | 4.7 | 7.4 | 2.2 | 20.5 | 9.6 | 55.6 | Present invention |
| | −4 Hot rolled | 1.9 | 2.5 | 2.0 | 25.0 | 14.0 | 79.3 | Outside invention |

#: Cracked

EXAMPLE 8

An explanation will be made of results of a study using steels of A to I having the compositions shown in Table 27. These steels were cast and then hot rolled as they were or after once cooling to room temperature, and then reheating to a temperature range of 900° C. to 1300° C., to finally shape them to 1.4 mm thick, 3.0 mm thick, or 8.0 mm thick hot-rolled steel sheets.

The hot-rolled steel sheets having the thickness of 3.0 mm and the thickness of 8.0 mm were cold rolled to reduce them to a thickness of 1.4 mm, then annealed by a continuous annealing step. Then, shape fixability is evaluated for these steel sheet as same as described in Example 2.

Table 28 shows whether or not the production conditions of the steel sheets are within the range of the present invention. The "Hot rolling condition 1" was evaluated as "O" ("good") where the sum of reduction rates within a temperature range of ($Ar_3$+50) to ($Ar_3$+150)° C. was 25% or more, while was evaluated as "X" ("poor") where the sum of the reduction rates in that temperature zone was less than 25%. The "Hot rolling condition 2" was evaluated as "O" ("good") where the sum of reduction rates within a temperature range of ($Ar_3$−100) to ($Ar_3$+30)° C. was 5 to 35%, while was evaluated as "X" ("poor") where that condition was not satisfied.

In both cases, where the friction coefficient for at least one pass in each temperature range is 0.2 or less, "O" ("good") was entered in the column "Lubrication", while where the friction coefficient in all passes exceeded 0.2, "Δ" ("fair") was entered. "C-3" indicates cooling to room temperature at 50° C./s after hot rolling, then heat treating for recovery at 650° C. The coiling was all performed at 250° C. to To (° C.) found by the previous described Equation (1).

Where such hot-rolled steel sheets were cold rolled to a 1.4 mm thickness, when the cold rolling reduction rate was 80% or more, the "Cold rolling reduction rate" was evaluated as "X" ("poor"), while when it was "Less than 80%", it was evaluated as "O" ("good"). Also, where the annealing temperature was 600° C. to ($Ac_3$+100)° C., the "Annealing temperature" was evaluated as "O" ("good"), while in cases other than that, it was evaluated as "X" ("poor"). Items not related as the conditions of production were indicated as "-". Skin pass rolling was applied with a reduction rate of 0.5 to 1.5% to both the hot-rolled steel sheets and the cold-rolled steel sheets.

The X-ray measurement was performed by preparing a sample parallel to the sheet face at a position of 7/16 sheet thickness as a representative value of the steel sheet.

Figure 8:
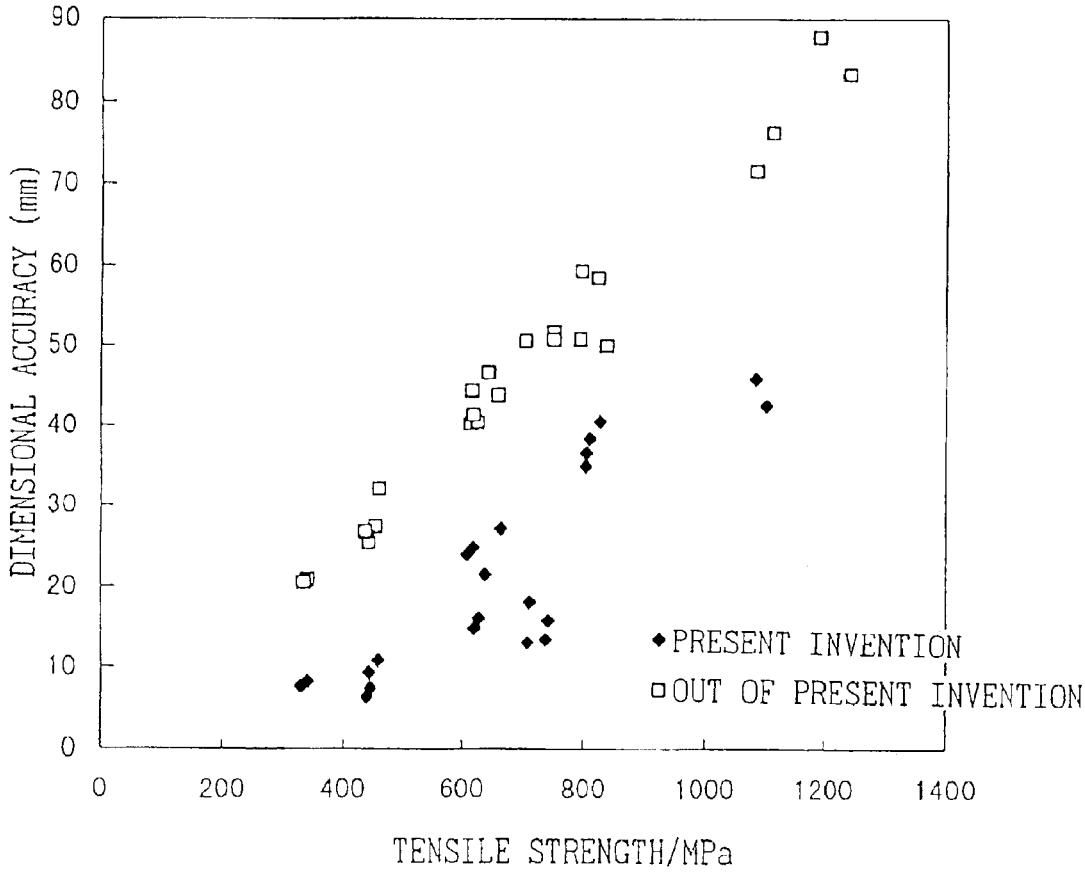
FIG. 8 is a graph showing the relationship between the tensile strength and the dimensional accuracy.

The mechanical properties of the 1.4 mm thick hot-rolled steel sheets and cold-rolled steel sheets produced by the above method are shown in Table 29, and the random intensity ratios measured by X-ray, dimensional accuracies, springbacks, and the wall warpages are shown in Table 30. In all steel types except the steel L in Table 38 and Table 30, examples of numbers "-2" and "-3" are those of the present invention. In them, it is seen that the springback and the wall warpage become small and the dimensional accuracy is improved in comparison with those of numbers "-1" and "-4" outside the invention. Also, in FIG. 8, the relationships of the tensile strength and dimensional accuracy shown in Table 38 and Table 39 are shown. As apparent also from these relationships, at any strength level, good shape fixability is obtained first after satisfying the X-ray random intensity ratios and r values of the crystal orientations limited in the present invention.

TABLE 27

| Steel type | C | Si | Mn | P | S | Al | Ti | Nb | V | Cr | Mo | Cu | Ni | B | N | O | Sn | Ca/Rem | Class |
|---|---|---|---|---|---|---|---|---|---|---|---|---|---|---|---|---|---|---|---|
| A | 0.0036 | 0.02 | 0.13 | 0.004 | 0.004 | 0.036 | 0.038 | — | — | — | — | — | — | 0.0004 | 0.0027 | 0.002 | — | — | Steel of invention |
| B | 0.052 | 0.38 | 1.09 | 0.014 | 0.003 | 0.670 | 0.015 | 0.004 | — | — | — | — | — | — | 0.0030 | 0.002 | — | — | Steel of invention |
| C | 0.11 | 1.52 | 1.73 | 0.017 | 0.002 | 1.100 | — | 0.032 | — | — | — | — | — | — | 0.0023 | 0.004 | — | — | Steel of invention |
| D | 0.08 | 0.28 | 1.35 | 0.017 | 0.005 | 0.042 | — | 0.007 | — | — | — | — | — | — | 0.0018 | 0.003 | — | Ca:0.003 | Steel of invention |
| E | 0.11 | 0.36 | 1.38 | 0.016 | 0.004 | 0.078 | — | — | — | — | — | — | — | — | 0.0024 | 0.003 | — | — | Steel of invention |
| F | 0.08 | 2.30 | 1.06 | 0.012 | 0.006 | 0.470 | 0.046 | — | — | — | 0.02 | — | — | | 0.0019 | 0.002 | — | — | Steel of invention |
| G | 0.12 | 1.20 | 1.38 | 0.016 | 0.004 | 0.078 | — | — | — | 0.04 | — | — | — | — | 0.0029 | 0.002 | — | — | Steel of invention |
| H | 0.16 | 1.53 | 1.71 | 0.016 | 0.007 | 0.038 | — | | — | — | — | — | — | | 0.0031 | 0.002 | | — | Steel of invention |
| I | 0.13 | 2.04 | 2.82 | 0.260 | 0.003 | 0.045 | — | — | — | — | — | — | — | — | 0.0027 | 0.004 | — | | Comparative steel |

Underlines indicate outside range of present invention.

TABLE 28

| | | | Hot rolling conditions | | | Cold rolling Annealing conditions | | |
|---|---|---|---|---|---|---|---|---|
| Steel type | | Class of steel sheet | Hot Rolling condition 1 | Hot Rolling condition 2 | Lubricant | Cold rolling reduction rate | Annealing temperature | Remarks |
| A | −1 | Cold rolled | ○ | x | Δ | x | ○ | Outside invention |
| | −2 | Cold rolled | ○ | ○ | Δ | ○ | ○ | Present invention |
| | −3 | Hot rolled | ○ | ○ | Δ | — | — | Present invention |
| | −4 | Hot rolled | ○ | x | Δ | — | — | Outside invention |
| B | −1 | Cold rolled | ○ | x | ○ | ○ | x | Outside invention |
| | −2 | Cold rolled | ○ | ○ | ○ | ○ | ○ | Present invention |
| | −3 | Hot rolled | ○ | ○ | ○ | — | — | Present invention |
| | −4 | Hot rolled | x | ○ | ○ | — | — | Outside invention |
| C | −1 | Cold rolled | ○ | x | ○ | x | ○ | Outside invention |
| | −2 | Cold rolled | ○ | ○ | ○ | ○ | ○ | Present invention |
| | −3 | Hot rolled | ○ | ○ | ○ | — | — | Present invention |
| | −4 | Hot rolled | x | x | ○ | — | — | Outside invention |
| D | −1 | Cold rolled | ○ | x | Δ | ○ | x | Outside invention |
| | −2 | Cold rolled | ○ | ○ | Δ | ○ | ○ | Present invention |
| | −3 | Hot rolled | ○ | ○ | Δ | — | — | Present invention |
| | −4 | Hot rolled | ○ | x | Δ | — | — | Outside invention |
| E | −1 | Cold rolled | x | ○ | Δ | ○ | ○ | Outside invention |
| | −2 | Cold rolled | ○ | ○ | ○ | ○ | ○ | Present invention |
| | −3 | Hot rolled | ○ | ○ | ○ | — | — | Present invention |
| | −4 | Hot rolled | x | ○ | Δ | — | — | Outside invention |
| F | −1 | Cold rolled | x | ○ | Δ | ○ | ○ | Outside invention |
| | −2 | Cold rolled | ○ | ○ | Δ | ○ | ○ | Present invention |
| | −3 | Hot rolled | ○ | ○ | Δ | — | — | Present invention |
| | −4 | Hot rolled | x | x | Δ | — | — | Outside invention |
| G | −2 | Cold rolled | x | ○ | ○ | x | ○ | Outside invention |
| | −2 | Cold rolled | ○ | ○ | ○ | ○ | ○ | Present invention |
| | −3 | Hot rolled | ○ | ○ | ○ | — | — | Present invention |
| | −4 | Hot rolled | x | ○ | Δ | — | — | Outside invention |
| H | −1 | Cold rolled | ○ | ○ | ○ | ○ | x | Outside invention |
| | −2 | Cold rolled | ○ | ○ | ○ | ○ | ○ | Present invention |
| | −3 | Hot rolled | ○ | ○ | ○ | — | — | Present invention |
| | −4 | Hot rolled | ○ | x | Δ | — | — | Outside invention |
| I | −1 | Cold rolled | ○ | x | Δ | ○ | x | Outside invention |
| | −2 | Cold rolled | ○ | ○ | ○ | ○ | ○ | Present invention |
| | −3 | Hot rolled | ○ | ○ | ○ | — | — | Present invention |
| | −4 | Hot rolled | ○ | x | Δ | — | — | Outside invention |

TABLE 29

| Steel type | Class of steel sheet | Tensile strength value: Yield strength (MPa) | Tensile strength (MPa) | Elongation (%) | rL | rC | Remarks |
|---|---|---|---|---|---|---|---|
| A | −1 Cold rolled | 196 | 342 | 51 | 2.31 | 2.45 | Outside invention |
| | −2 Cold rolled | 190 | 340 | 50 | 0.58 | 0.62 | Present invention |
| | −3 Hot rolled | 185 | 330 | 50 | 0.59 | 0.63 | Present invention |
| | −4 Hot rolled | 186 | 335 | 51 | 0.98 | 1.02 | Outside invention |
| B | −1 Cold rolled | 301 | 460 | 40 | 1.01 | 0.98 | Outside invention |
| | −2 Cold rolled | 303 | 458 | 38 | 0.6 | 0.63 | Present invention |
| | −3 Hot rolled | 292 | 443 | 39 | 0.58 | 0.67 | Present invention |
| | −4 Hot rolled | 296 | 453 | 39 | 0.86 | 0.91 | Outside invention |
| C | −1 Cold rolled | 645 | 692 | 7 | * | * | Outside invention |
| | −2 Cold rolled | 536 | 708 | 27 | 0.38 | 0.45 | Present invention |
| | −3 Hot rolled | 535 | 711 | 26 | 0.42 | 0.46 | Present invention |
| | −4 Hot rolled | 531 | 703 | 27 | 0.89 | 0.92 | Outside invention |
| D | −1 Cold rolled | 645 | 823 | 22 | 0.73 | 0.76 | Outside invention |
| | −2 Cold rolled | 646 | 827 | 22 | 0.54 | 0.63 | Present invention |
| | −3 Hot rolled | 628 | 810 | 23 | 0.52 | 0.60 | Present invention |
| | −4 Hot rolled | 655 | 838 | 21 | 0.71 | 0.70 | Outside invention |
| E | −1 Cold rolled | 386 | 642 | 28 | 0.89 | 0.92 | Outside invention |
| | −2 Cold rolled | 376 | 663 | 27 | 0.63 | 0.72 | Present invention |
| | −3 Hot rolled | 369 | 638 | 28 | 0.66 | 0.75 | Present invention |
| | −4 Hot rolled | 387 | 659 | 27 | 0.88 | 0.86 | Outside invention |
| F | −1 Cold rolled | 581 | 750 | 25 | 0.76 | 0.79 | Outside invention |
| | −2 Cold rolled | 569 | 738 | 26 | 0.5 | 0.61 | Present invention |
| | −3 Hot rolled | 572 | 742 | 25 | 0.55 | 0.59 | Present invention |
| | −4 Hot rolled | 579 | 750 | 24 | 0.73 | 0.75 | Outside invention |
| G | −1 Cold rolled | 589 | 625 | 8 | * | * | Outside invention |
| | −2 Cold rolled | 450 | 620 | 36 | 0.41 | 0.45 | Present invention |
| | −3 Hot rolled | 457 | 628 | 37 | 0.42 | 0.44 | Present invention |
| | −4 Hot rolled | 445 | 618 | 36 | 0.79 | 0.83 | Outside invention |
| H | −1 Cold rolled | 712 | 796 | 6 | * | * | Outside invention |
| | −2 Cold rolled | 616 | 805 | 28 | 0.49 | * | Present invention |
| | −3 Hot rolled | 610 | 803 | 30 | 0.46 | * | Present invention |
| | −4 Hot rolled | 604 | 794 | 28 | 0.69 | 0.76 | Outside invention |
| I | −1 Cold rolled | 1089 | 1189 | 5 | * | * | Outside invention |
| | −2 Cold rolled | 1112 | 1241 | 4 | * | * | Outside invention |
| | −3 Hot rolled | 1110 | 1206 | 3 | * | * | Outside invention |
| | −4 Hot rolled | 1084 | 1198 | 3 | * | * | Outside invention |

*: Uniform elongation was small and γ value could not be measured

TABLE 30

| Steel type | Class of steel sheet | X-ray intensity ratio of {100}<110>–{223}<110> orientation group | X-ray intensity ratio of {100}<110> | X-ray intensity ratio of {554}<225>, {111}<112>, {111}<110> orientation group | Amount of Spring-back (° C.) | Wall camber $1/\rho \times 10^3$ ($mm^{-1}$) | Dimensional accuracy (mm) | Remarks |
|---|---|---|---|---|---|---|---|---|
| A | −1 Cold rolled | 2.3 | 3.6 | 9.8 | 7.7 | 2.9 | 20.8 | Outside invention |
| | −2 Cold rolled | 4.3 | 6.5 | 2.6 | 4.6 | 0.5 | 8.2 | Present invention |
| | −3 Hot rolled | 4.2 | 6.6 | 2.9 | 4.0 | 0.3 | 7.6 | Present invention |
| | −4 Hot rolled | 2.1 | 3.7 | 2.7 | 8.1 | 2.9 | 20.5 | Outside invention |
| B | −1 Cold rolled | 1.9 | 2.3 | 2.3 | 10.8 | 5.0 | 32.1 | Outside invention |
| | −2 Cold rolled | 3.7 | 8.5 | 2.3 | 6.5 | 1.0 | 10.8 | Present invention |
| | −3 Hot rolled | 4.3 | 8.7 | 1.9 | 6.5 | 0.7 | 9.3 | Present invention |
| | −4 Hot rolled | 2.3 | 2.9 | 3.3 | 10.6 | 4.4 | 27.3 | Outside invention |
| C | −1 Cold rolled | 2.1 | 3.2 | 4.5 | # | # | # | Outside invention |
| | −2 Cold rolled | 4.5 | 13.5 | 2.7 | 11.6 | 1.6 | 13.0 | Present invention |
| | −3 Hot rolled | 4.6 | 12.1 | 2.4 | 11.6 | 2.3 | 18.1 | Present invention |
| | −4 Hot rolled | 2.8 | 3.6 | 2.7 | 16.2 | 8.5 | 50.6 | Outside invention |
| D | −1 Cold rolled | 2.0 | 2.5 | 2.4 | 19.3 | 10.1 | 58.4 | Outside invention |
| | −2 Cold rolled | 4.9 | 6.3 | 2.6 | 13.8 | 6.7 | 40.6 | Present invention |
| | −3 Hot rolled | 5.3 | 6.5 | 2.0 | 14.3 | 6.4 | 38.4 | Present invention |
| | −4 Hot rolled | 2.8 | 3.8 | 2.3 | 16.3 | 8.9 | 50.0 | Outside invention |
| E | −1 Cold rolled | 2.3 | 2.7 | 2.3 | 15.0 | 7.8 | 46.6 | Outside invention |
| | −2 Cold rolled | 3.5 | 7.6 | 2.9 | 11.1 | 4.0 | 27.1 | Present invention |
| | −3 Hot rolled | 3.9 | 8.5 | 3.2 | 10.8 | 3.2 | 21.5 | Present invention |
| | −4 Hot rolled | 2.3 | 2.7 | 2.8 | 15.5 | 7.3 | 43.8 | Outside invention |

TABLE 30-continued

| Steel type | Class of steel sheet | X-ray intensity ratio of {100}<110>–{223}<110> orientation group | X-ray intensity ratio of {100}<110> | X-ray intensity ratio of {554}<225>, {111}<112>, {111}<110> orientation group | Amount of Spring-back (° C.) | Wall camber $1/\rho \times 10^3$ ($mm^{-1}$) | Dimensional accuracy (mm) | Remarks |
|---|---|---|---|---|---|---|---|---|
| F | −1 Cold rolled | 2.0 | 2.6 | 2.7 | 17.4 | 8.9 | 51.7 | Outside invention |
| | −2 Cold rolled | 4.7 | 14.0 | 2.1 | 12.8 | 1.7 | 13.4 | Present invention |
| | −3 Hot rolled | 4.7 | 13.4 | 2.6 | 12.1 | 2.1 | 15.9 | Present invention |
| | −4 Hot rolled | 2.0 | 2.3 | 3.0 | 17.0 | 8.7 | 50.7 | Outside invention |
| G | −1 Cold rolled | 2.6 | 3.5 | 3.9 | 14.8 | 6.8 | 40.5 | Outside invention |
| | −2 Cold rolled | 6.8 | 10.8 | 2.6 | 9.7 | 1.9 | 14.9 | Present invention |
| | −3 Hot rolled | 6.6 | 10.4 | 2.1 | 10.6 | 2.2 | 16.2 | Present invention |
| | −4 Hot rolled | 1.6 | 2.3 | 2.4 | 15.0 | 6.7 | 41.4 | Outside invention |
| H | −1 Cold rolled | 1.7 | 2.6 | 2.5 | 18.6 | 10.1 | 59.3 | Outside invention |
| | −2 Cold rolled | 5.9 | 7.3 | 2.6 | 13.4 | 5.9 | 36.6 | Present invention |
| | −3 Hot rolled | 6.4 | 8.1 | 2.3 | 13.5 | 5.5 | 34.9 | Present invention |
| | −4 Hot rolled | 2.9 | 2.8 | 1.6 | 16.9 | 8.9 | 50.8 | Outside invention |
| I | −1 Cold rolled | 1.8 | 2.1 | 2.1 | 27.2 | 15.8 | 87.8 | Outside invention |
| | −2 Cold rolled | 4.2 | 4.5 | 1.8 | 27.1 | 14.9 | 83.4 | Outside invention |
| | −3 Hot rolled | 4.6 | 4.3 | 1.9 | # | # | # | Outside invention |
| | −4 Hot rolled | 1.8 | 1.9 | 2.1 | # | # | # | Outside invention |

#: Cracked

Capability of Utilization in Industry

By the present invention, it becomes possible to provide steel sheets having little springback and excellent in shape fixability, mainly in bending, and other mechanical properties. Particularly, it becomes possible to use the high strength steel sheet even for parts in which it was conventionally difficult to apply high strength steel sheet due to the problem of poor shaping. In order to reduce the weight of automobiles, the use of high strength steel sheet is very necessary. By the present invention, the weight of the automobile body can be further reduced.

What is claimed is:

1. A thin ferritic steel sheet with a particular shape fixability, comprising:

at least one section having first and second mean values of x-ray random intensity ratios that are at least 3.0 and at most 3.5, respectively, wherein the x-ray random intensity ratios of the first mean value are of a group of {100}<011>to {223}<110>orientations at least at ½ of a thickness of the sheet, and wherein the x-ray random intensity ratios of the second mean value are of orientations of {554}<225>, {111}<112>, and {111}<110>.

2. The thin ferritic steel sheet according to claim 1, wherein at least one of an r value in a rolling direction of the sheet and the r value in a direction at a right angle to the rolling direction is 0.7 or less.

3. The thin ferritic steel sheet according to claim 1, wherein the x-ray random intensity ratios of the first mean value are of {112}<110> orientation, and wherein the first mean value is at least 4.0.

4. The thin ferritic steel sheet according to claim 1, wherein the x-ray random intensity ratios of the second mean value are of {100}<011> orientation, and wherein the second mean value is at least 4.0.

5. The thin ferritic steel sheet according to claim 1, wherein an occupancy of iron carbide at grain boundaries of the sheet is at most 0.1, and wherein a maximum grain size of the iron carbide is at most 1 $\mu$m.

6. The thin ferritic steel sheet according to claim 1, wherein the at least one section includes a multi phase structure, wherein one of ferrite and bainite in the at least one section is the maximum phase in terms of a percent area, and wherein a sum of a percent area of pearlite, martensite, and residual austenite in the at least one section is at most 30%.

7. The thin ferritic steel sheet according to claim 1, wherein the steel sheet comprises; in terms of weight C: 0.001 to 0.3%, Si: 0.001 to 3.5%, Mn: less than 3%, P: 0.005 to 0.15%, S: less than 0.03%, Al: 0.01 to 3.0%, N: less than 0.01%, O: less than 0.01%, and remainder Fe and unavoidable impurities.

8. The thin ferritic steel sheet according to claim 1, wherein the steel sheet contains at least one element selected from the group consisting of, in terms of weight %, Ti: less than 0.20%, Nb: less than 0.20%, V: less than 0.20%, Cr: less than 1.5%, B: less than 0.007%, Mo: less than 1%, Cu: less than 3%, Ni: less than 3%, Sn: less than 0.3%, Co: less than 3%, Ca: 0.0005 to 0.005%, and REM: 0.001 to 0.02%.

9. The thin ferritic steel sheet according to claim 7, wherein the steel sheet satisfies the following equations.

$$203\sqrt{C}+15.2Ni+44.7Si+104V+31.5Mo+30Mn+11Cr+20Cu+700P+200A1<30 \quad (1)$$

$$44.7Si+700P+200A1>40 \quad (2).$$

10. The thin ferritic steel sheet according to claim 1, wherein the steel sheet is plated.

11. A method for producing a thin ferritic steel sheet with a particular shape fixability, comprising the steps of;

hot rolling, by one of reheating to a temperature range of 1000° C. to 1300° C. and without reheating, a cast slab which contains, in terms of weight %, C: 0.001 to 0.3%, Si: 0.001 to 3.5%, Mn: less than 3%, P: 0.005 to 0.15%,
S: less than 0.03%,
Al: 0.01 to 3.0%,
N: less than 0.01%,
O: less than 0.01 %, and remainder Fe and unavoidable impurities, with a total reduction rate of 25% or more at ($Ar_3$−100) to ($Ar_3$+100)° C., terminating the hot rolling step at ($Ar_3$−100)° C. or more, and cooling the hot rolled steel sheet, and then coiling the cooled steel sheet so that the steel sheet has first and second mean values of x-ray random intensity ratios that are at least 3.0 and at most 3.5, respectively, wherein the x-ray random intensity ratios of the first mean value are of a group of {100}<011> to {223}<110> orientations at least at ½ of the sheet thickness, and wherein the x-ray random intensity ratios of the second mean value are of orientations of {554}<225>, {111}<112>, and {111}<110>.

12. A method for producing a thin ferritic steel sheet with a particular shape fixability, comprising the steps of;

hot rolling, by one of reheating to a temperature range of 1000° C. to 1300° C. and without reheating, a cast slab that contains, in terms of weight %,
C: 0.001 to 0.3%,
Si: 0.001to35%,
Mn: less than 3%,
P: 0.005 to 0.15%,
S: less than 0.03%,
Al: 0.01 to 3.0%,
N: less than 0.01%,
O: less than 0.01%, and remainder Fe and unavoidable impurities, with one of a total reduction rate of 25% and more at ($Ar_3$+50) to ($Ar_3$150)° C., and continuing the hot rolling with reduction rates of 5 to 35% at ($Ar_3$−100) to ($Ar_3$50)° C., terminating the hot rolling at ($Ar_3$−100) to ($Ar_3$+50)° C., and cooling the hot rolled steel sheet, and then coiling the cooled steel sheet so that the steel sheet has first and second mean values of x-ray random intensity ratios that are at least 3.0 and at most 3.5, respectively, wherein the x-ray random intensity ratios of the first mean value are of a group of {100}<011> to {223}<110> orientations at least at ½ of the sheet thickness, and wherein the x-ray random intensity ratios of the second mean value are of orientations of {554}<225>, {111}<112>, and {111}<110>.

13. A method for producing a thin ferritic steel sheet with a particular shape fixability, comprising the steps of;

roughing hot rolling, using one of a temperature range of 1000° C. to 1300° C. and without reheating, a cast slab that contains, in terms of weight %,
C: 0.001 to 0.3%,
Si: 0.001 to 3.5%,
Mn: less than 3%,
P: 0.005 to 0.15%,
S: less than 0.03%,
Al: 0.01 to 3.0%,
N: less than 0.01%,
O: less than 0.01%, and remainder Fe and unavoidable impurities, exceeding a transformation temperature of $Ar_3$, completing the hot rolling step at a temperature below an $Ar_3$ transformation temperature, terminating the hot rolling step at a temperature below the $Ar_3$ transformation temperature, and cooling the hot roiled steel sheet, and then coiling the cooled steel sheet, so that the steel sheet has first and second mean values of x-ray random intensity ratios that are at least 3.0 and at most 3.5, respectively, wherein the x-ray random intensity ratios of the first mean value are of a group of {100}<011> to {223}<110> orientations at least at ½ of the sheet thickness, and wherein the x-ray random intensity ratios of the second mean value are of orientations of {554}<225>, {111}<112>, and {111}<110>.

14. The method according to claim 11, wherein the x-ray random intensity ratios of the first mean value are of {112}<110> orientation, and wherein the first mean value is at least 4.0.

15. The method according to claim 11, wherein the x-ray random intensity ratios of the second mean value are of {100}<011> orientation, and wherein the second mean value is at least 4.0.

16. The method according to claim 11, wherein the cast slab further contains at least one element selected from the group consisting of, in terms of weight %, Ti: less than 0.20%, Nb: less than 0.20%, V: less than 0.20%, Cr: less than 1.5%, B: less than 0.007%, Mo: less than 1%, Cu: less than 3%, Ni: less than 3%, Sn: less than 0.3%, Co: less than 3%, Ca: 0.0005 to 0.005%, and REM: 0.001 to 0.02%.

17. The method according to claim 11, wherein the steel sheet is coiled at a temperature To that is determined by the chemical composition of the steel sheet shown in the following equations:

$$To=-650.4\times\{C\ \%/(1.82\times C\ \%-0.001\}+B$$

where B is obtained from ingredients of the steel sheet expressed by massy $$B=-50.6\times Mneq+894.3$$

$$Mneq=Mn\ \%+0.24\times Ni\ \%+0.13\times Si\ \%+0.38\times Mo\ \%+0.55\times Cr\ \%+0.16\times Cu\ \%-0.50\times Al\ \%+-0.45\times Co\ \%+0.90\times V\ \%.$$

18. The method according to claim 11, wherein the hot rolling step is controlled so that the effective strain ϵ* that is calculated by the following equation is at least 0.4:

$$\varepsilon^* = \sum_{j=1}^{n-1} \varepsilon_j \exp\left[-\sum_{i=j}^{n-1}\left(\frac{t_i}{\tau_i}\right)^{2/3}\right] + \varepsilon_n$$

wherein n is a number of rolling stands of finish hot rolling, ϵi is strain added at an i-th stand, ti is a traveling time(seconds) between the i-th to i+l-th stands, and ϵi is determinable by the following equation using a gas constant R(=1.987) and a hot rolling temperature Ti(K) of the i-th stand:

$$ri=8{,}46\times10^{-9}\cdot\exp\{43800/R/Ti\}.$$

19. The method according to claim 11, wherein the hot rolling step is carried out with a friction coefficient of less than 0.2 for at least one pass in the hot rolling step.

20. The method according to claim 11, wherein the cooling step is controlled to an average cooling rate of more than 10° C./sec from hot rolling terminating temperature to a critical temperature to determined by the chemical composition of the steel sheet, and the cooling step is carried out at a temperature less than To.

21. The method according to claim 11, wherein the hot rolled steel sheet is pickled by acid, wherein, after the steel sheet is pickled, the steel sheet is cold rolled at a reduction rate of less than 80%, wherein, after the steel sheet is cold rolled, the cold rolled steel sheet is reheated between 600° C. and (Ac3+100)° C., and then cooled.

22. The method according to claim 11, wherein the hot rolled steel sheet is pickled by acid, wherein, after the steel sheet is pickled, the steel sheet is cold rolled with a reduction rate of less than 80%, wherein, after the steel sheet is cold rolled, the steel sheet is annealed at a temperature between $Ac_1$, and $Ac_3$ transformation temperature, and then cooled to a temperature below 500° C. at a cooling rate of 1 to 250° C./sec.

23. The method according to claim 12, wherein the x-ray random intensity ratios of the first mean value are of {112}<110> orientation, and wherein the first mean value is at least 4.0.

24. The method according to claim 12, wherein the x-ray random intensity ratios of the second mean value are of {100}<011> orientation, and wherein the second mean value is at least 4.0.

25. The method according to claim 12, wherein the cast slab further contains at least one element selected from the group consisting of, in terms of weight %, Ti: less than 0.20%, Nb: less than 0.20%, V: less than 0.20%, Cr: less than 1.5%, B: less than 0.007%, Mo: less than 1%, Cu: less than 3%, Ni: less than 3%, Sn: less than 0.3%, Co: less than 3%, Ca: 0.0005 to 0.005%, and REM: 0.001 to 0.02%.

26. The method according to claim 12, wherein the steel sheet is coiled at a temperature To that is determined by the chemical composition of the steel sheet shown in the following equations:

$$To=-650.4\times\{C\ \%/(1.82\times C\ \%-0.001\}+B$$

where B is obtained from ingredients of the steel sheet expressed by massy $$B=-50.6\times Mneq+894.3$$

$$Mneq=Mn\ \%+0.24\times Ni\ \%+0.13\times Si\ \%+0.38\times Mo\ \%+0.55\times Cr\ \%+0.16\times Cu\ \%-0.50\times A1\%+-0.45\times Co\ \%+0.90\times V\ \%.$$

27. The method according to claim 12, wherein the hot rolling step is controlled so that the effective strain $\epsilon^*$ that is calculated by the following equation is at least 0.4:

$$\varepsilon^* = \sum_{j=1}^{n-1} \varepsilon_j \exp\left[-\sum_{i=j}^{n-1}\left(\frac{t_i}{\tau_i}\right)^{2/3}\right] + \varepsilon_n$$

wherein n is a number of rolling stands of finish hot rolling, $\epsilon i$ is strain added at an i-th stand, ti is a traveling time(seconds) between the i-th to i+l-th stands, and $\epsilon i$ is determinable by the following equation using a gas constant R(=1.987) and a hot rolling temperature Ti(K) of the i-th stand:

$$ri=8{,}46\times10^{-9}\cdot\exp\{43800/R/Ti\}.$$

28. The method according to claim 12, wherein the hot rolling step is carried out with a friction coefficient of less than 0.2 for at least one pass in the hot rolling step.

29. The method according to claim 12, wherein the cooling step is controlled to an average cooling rate of more than 10° C./sec from hot rolling terminating temperature to a critical temperature to determined by the chemical composition of the steel sheet, and the cooling step is carried out at a temperature less than To.

30. The method according to claim 12, wherein the hot rolled steel sheet is pickled by acid, wherein, after the steel sheet is pickled, the steel sheet is cold rolled at a reduction rate of less than 80%, wherein, after the steel sheet is cold rolled, the cold rolled steel sheet is reheated between 600° C. and (Ac3+100)° C., and then cooled.

31. The method according to claim 12, wherein the hot rolled steel sheet is pickled by acid, wherein, after the steel sheet is pickled, the steel sheet is cold rolled with a reduction rate of less than 80%, wherein, after the steel sheet is cold rolled, the steel sheet is annealed at a temperature between $Ac_1$, and $Ac_3$ transformation temperature, and then cooled to a temperature below 500° C. at a cooling rate of 1 to 250° C./sec.

32. The method according to claim 13, wherein the x-ray random intensity ratios of the first mean value are of {112}<110> orientation, and wherein the first mean value is at least 4.0.

33. The method according to claim 13, wherein the x-ray random intensity ratios of the second mean value are of {100}<011> orientation, and wherein the second mean value is at least 4.0.

34. The method according to claim 13, wherein the cast slab further contains at least one element selected from the group consisting of, in terms of weight %, Ti: less than 0.20%, Nb: less than 0.20%, V: less than 0.20%, Cr: less than 1.5%, B: less than 0.007%, Mo: less than 1%, Cu: less than 3%, Ni: less than 3%, Sn: less than 0.3%, Co: less than 3%, Ca: 0.0005 to 0.005%, and REM: 0.001 to 0.02%.

35. The method according to claim 13, wherein the steel sheet is coiled at a temperature To that is determined by the chemical composition of the steel sheet shown in the following equations:

$$To=-650.4\times\{C\ \%/(1.82\times C\ \%-0.001\}+B$$

where B is obtained from ingredients of the steel sheet expressed by massy $$B=-50.6\times Mneq+894.3$$

$$Mneq=Mn\ \%+0.24\times Ni\ \%+0.13\times Si\ \%+0.38\times Mo\ \%+0.55\times Cr\ \%+0.16\times Cu\ \%-0.50\times A1\%+-0.45\times Co\ \%+0.90\times V\ \%.$$

36. The method according to claim 13, wherein the hot rolling step is controlled so that the effective strain $\epsilon^*$ that is calculated by the following equation is at least 0.4:

$$\varepsilon^* = \sum_{j=1}^{n-1} \varepsilon_j \exp\left[-\sum_{i=j}^{n-1}\left(\frac{t_i}{\tau_i}\right)^{2/3}\right] + \varepsilon_n$$

wherein n is a number of rolling stands of finish hot rolling, $\epsilon i$ is strain added at an i-th stand, ti is a traveling time(seconds) between the i-th to i+l-th stands, and $\epsilon i$ is determinable by the following equation using a gas constant R(=1.987) and a hot rolling temperature Ti(K) of the i-th stand:

$$ri=8{,}46\times10^{-9}\cdot\exp\{43800/R/Ti\}.$$

37. The method according to claim 13, wherein the hot rolling step is carried out with a friction coefficient of less than 0.2 for at least one pass in the hot rolling step.

38. The method according to claim 13, wherein the cooling step is controlled to an average cooling rate of more than 10° C./sec from hot rolling terminating temperature to a critical temperature to determined by the chemical composition of the steel sheet, and the cooling step is carried out at a temperature less than To.

39. The method according to claim 13, wherein the hot rolled steel sheet is pickled by acid, wherein, after the steel sheet is pickled, the steel sheet is cold rolled at a reduction rate of less than 80%, wherein, after the steel sheet is cold rolled, the cold rolled steel sheet is reheated between 600° C. and (Ac3+100)° C., and then cooled.

40. The method according to claim 13, wherein the hot rolled steel sheet is pickled by acid, wherein, after the steel sheet is pickled, the steel sheet is cold rolled with a reduction rate of less than 80%, wherein, after the steel sheet is cold rolled, the steel sheet is annealed at a temperature between $Ac_1$, and $Ac_3$ transformation temperature, and then cooled to a temperature below 500° C. at a cooling rate of 1 to 250° C./sec.

* * * * *

UNITED STATES PATENT AND TRADEMARK OFFICE

CERTIFICATE OF CORRECTION

PATENT NO. : 6,962,631 B2
DATED : November 8, 2005
INVENTOR(S) : Sugiura et al.

It is certified that error appears in the above-identified patent and that said Letters Patent is hereby corrected as shown below:

Column 3,
Line 7, "In a high strength steel sheet having good workability and absorption of impact energy, however, the method of improving the shape." should read
-- In a high strength steel sheet having good workability and absorption of impact energy, however, the method of improving the shape fixability has not been clarified. --.

Column 6,
Line 53, (In the subscript under the second summation) "i-j" should read
-- i=j --.
Line 61, "8,46" should read -- 8.46 --.

Column 90,
Line 54, equation (1), "A1" should read -- AI --.
Line 56, equation (2), "A1" should read -- AI --.
Line 63, "1000º C. to 1300º C." should read -- 1000º C to 1300º C --.

Column 91,
Line 7, "($Ar_3$+100)º C.," should read -- ($Ar_3$+100)º C, --.
Line 8, "($Ar_3$-100)º C. or more" should read -- ($Ar_3$-100)º C or more --.
Lines 22 and 52, "1000º C. to 1300º C." should read -- 1000º C to 1300º C --.
Line 33, "($Ar_3$150)º C.," should read -- ($Ar_3$+150)º C, --.
Line 35, "($Ar_3$50)º C.," should read -- ($Ar_3$+50)º C --.
Line 36, "($Ar_3$+50)º C.," should read -- ($Ar_3$+50)º C, --.

Column 92,
Line 1, "hot roiled steel sheet" should read -- hot rolled steel sheet --.
Line 34, "expressed by massy" should read -- expressed by mass --.
Line 46, (In the subscript under the second summation) "i-j" should read
-- i=j --.
Line 62, "10º C./sec" should read -- 10º C/sec" --.

UNITED STATES PATENT AND TRADEMARK OFFICE

CERTIFICATE OF CORRECTION

PATENT NO. : 6,962,631 B2
DATED : November 8, 2005
INVENTOR(S) : Sugiura et al.

It is certified that error appears in the above-identified patent and that said Letters Patent is hereby corrected as shown below:

Column 93,
Line 4, "C. and" should read -- C and --.
Line 11, "500º C." should read -- 500º C --.
Line 12, "C./sec" should read -- C/sec --.
Line 36, "expressed by massy" should read -- expressed by mass --.
Line 64, "10º C./sec" should read -- 10º C/sec --.
Line 65, "to determined" should read -- to be determined --.

Column 94,
Line 6, "C. and (Ac3+100)º C.," should read -- C and ($Ac_3$+100)º C, --.
Line 13, "500º C." should read -- 500º C --.
Line 14, "C./sec" should read -- C/sec --.
Line 38, "expressed by massy" should read -- expressed by mass --.
Line 66, "10º C./sec" should read -- 10º C/sec --.

Column 95,
Line 8, "C. and (Ac3+100)º C.," should read -- C and ($Ac_3$+100)º C, --.

Column 96,
Line 5, "500º C." should read -- 500º C --.
Line 6, "C./sec." should read -- C/sec. --.

Signed and Sealed this

Eleventh Day of April, 2006

JON W. DUDAS
*Director of the United States Patent and Trademark Office*

UNITED STATES PATENT AND TRADEMARK OFFICE

CERTIFICATE OF CORRECTION

PATENT NO. : 6,962,631 B2
APPLICATION NO. : 10/380844
DATED : November 8, 2005
INVENTOR(S) : Sugiura et al.

It is certified that error appears in the above-identified patent and that said Letters Patent is hereby corrected as shown below:

In column 90, line 54, equation (1), “A1” should read --AI--.

In column 90, line 56, equation (2), “A1” should read --AI--.

In column 91, line 52, “1000°C. to 1300°C.” should read -- 1000°C to 1300°C --.

Signed and Sealed this

Fifth Day of September, 2006

JON W. DUDAS
*Director of the United States Patent and Trademark Office*